US006612099B2

(12) United States Patent
Stravitz

(10) Patent No.: US 6,612,099 B2
(45) Date of Patent: Sep. 2, 2003

(54) WASTE DISPOSAL DEVICES INCLUDING CARTRIDGE OF FLEXIBLE TUBING

(75) Inventor: David M. Stravitz, New York City, NY (US)

(73) Assignee: Saniquest Industries Corp., New York, NY (US)

( * ) Notice: Subject to any disclaimer, the term of this patent is extended or adjusted under 35 U.S.C. 154(b) by 0 days.

(21) Appl. No.: 10/138,058

(22) Filed: May 2, 2002

(65) Prior Publication Data

US 2002/0162304 A1 Nov. 7, 2002

Related U.S. Application Data

(60) Provisional application No. 60/288,186, filed on May 2, 2001, provisional application No. 60/337,355, filed on Nov. 8, 2001, and provisional application No. 60/359,148, filed on Feb. 20, 2002.

(51) Int. Cl.[7] ..... B65B 9/10
(52) U.S. Cl. ..... 53/526; 53/567
(58) Field of Search ..... 53/138.8, 526, 53/118, 138.3, 138.7, 587, 211, 213, 370, 567, 576, 577

(56) References Cited

U.S. PATENT DOCUMENTS 4,162,602 A * 7/1979 Achelpohl et al. ..... 53/415
4,561,563 A * 12/1985 Woods ..... 220/592.17
4,760,784 A * 8/1988 Whiteside ..... 100/220
4,869,049 A * 9/1989 Richards et al. ..... 53/459
5,184,575 A * 2/1993 Reinartz ..... 119/163
5,590,512 A * 1/1997 Richards et al. ..... 53/567
5,655,680 A * 8/1997 Asbach et al. ..... 220/495.11
5,813,200 A * 9/1998 Jacoby et al. ..... 53/567
5,884,556 A * 3/1999 Klepacki et al. ..... 100/349
6,000,323 A * 12/1999 Schlegel ..... 100/35
6,128,890 A * 10/2000 Firth ..... 53/567
6,170,240 B1 * 1/2001 Jacoby et al. ..... 53/567
6,370,847 B1 * 4/2002 Jensen et al. ..... 53/459
6,453,640 B1 * 9/2002 Hayashi ..... 53/138.3

* cited by examiner

*Primary Examiner*—Stephen F. Gerrity
*Assistant Examiner*—John Paradiso
(74) *Attorney, Agent, or Firm*—Frishauf, Holtz, Goodman & Chick, P.C.

(57) ABSTRACT

Waste disposal device including a container defining a waste storage chamber and a cartridge arranged in the container and containing a length of flexible tubing for encapsulating waste packages. A retention mechanism is arranged in the container to hold the waste package. A rotation mechanism is provided to cause relative rotation between the cartridge and the retention mechanism in order to form a twist above a waste package when the waste package is being held by the retention mechanism and thereby encapsulate the waste package in the tubing. Encapsulation of the waste package prevents the release of odors from the waste package and thus, the invention provides a convenient and sanitary disposal of the waste packages. A series of encapsulated waste packages is thus created in the container, each package contained within a portion of the tubing and sealed at each end by the twisting process. Once encapsulated, the waste package is urged further into the container upon a subsequent insertion of another waste package or by a compacting mechanism which rolls the encapsulated waste packages into a compacted roll.

89 Claims, 32 Drawing Sheets

WASTE DISPOSAL DEVICES INCLUDING CARTRIDGE OF FLEXIBLE TUBING

CROSS-REFERENCE TO RELATED APPLICATIONS

This application claims priority under 35 U.S.C. §119(e) of U.S. provisional application Serial No. 60/288,186 filed May 2, 2001, U.S. provisional patent application Serial No. 60/337,355 filed Nov. 8, 2001 and U.S. provisional patent application Serial No. 60/359,148 filed Feb. 20, 2002, the contents of all of which are incorporated herein by reference.

FIELD OF THE INVENTION

The present invention relates generally to waste disposal devices using packs of flexible tubing, and more particularly, to improved health care apparatus for the sanitary and odorless packaging and disposal of diapers and similar or related waste, medical waste, industrial waste and any other waste wherein sanitary and substantially odorless disposal is desired.

The present invention also relates to replaceable cartridges of tubing for a waste disposal device and rotation mechanisms for rotating such a tubing cartridge, some of which provide for automatic rotation of the tubing cartridge.

The present invention also relates to waste disposal devices using packs of flexible tubing and including a compacting mechanism which compacts the waste.

BACKGROUND OF THE INVENTION

In households having an infant or very young child wearing disposable diapers, a diaper pail is usually placed in the bathroom or nursery for the receipt and disposal of soiled diapers.

One prior art construction of a diaper pail comprises a large garbage can-like container which receives a plastic bag. The bag is inserted into the interior of the container, with the upper portion thereof being folded over a top rim of the container to maintain the bag in engagement therewith. A cover member is attached to the container and is movable between a closed position in which the cover member is situated over the top rim of the container to cover the open end of the bag, and an open position in which the open end of the bag is uncovered and thereby enables the placement of a soiled diaper into the bag. A foot pedal is provided and coupled to the cover member to enable the cover member to be moved from the closed position to the open position by depressing the foot pedal.

Another prior art diaper pail is sold under the trademark "Diaper Genie". Diaper pails of the "Diaper Genie"™ type are shown in U.S. Pat. Nos. 4,869,049 (Richards et al.), 5,590,512 (Richards et al.), 5,813,200 (Jacoby et al.), 6,128,890 (Firth) and 6,170,240 (Jacoby et al.).

The diaper pails shown in these patents generally comprise a container formed with an internal ring-shaped flange. A tubular core or cartridge rests on the flange and houses a continuous length of flexible, substantially non-resilient plastic tubing. A twist rim is rotatably coupled to the cartridge such that rotation of the twist rim causes twisting of the tubing. Means are provided to hold a diaper stationary when the twist rim rotates to twist the tubing and seal an end of the diaper to form a twisted closure. A cover is removably attached to the container and includes a lid. To prepare the diaper pail for use, the cover is removed, an end of the tubing is removed from the cartridge and pulled upward and tied into a knot. The knotted end is then placed into the container over an annular flange to form a waste insertion reservoir or chamber bounded by the tubing. The cover is re-attached to the container and the diaper pail is ready for use. In use, a soiled diaper is inserted into the waste insertion reservoir bounded by the tubing and the twist rim is then manually rotated as the diaper is held stationary to cause the diaper to be encapsulated in the tubing by the formation of a twist in the tubing above the diaper. Rotation of the twist rim also causes an additional amount of tubing to be removed from the cartridge and be pushed into the waste insertion reservoir to prepare it for a subsequent insertion of a diaper. The subsequent insertion of another diaper into the waste insertion reservoir causes the previously encapsulated diaper to pass into the hollow interior of the container. A series of connected, closed and encapsulated waste packages is created and the encapsulation process can be continued until the tubing is exhausted or the container is full. When the container is full but tubing remains, the uppermost package is severed above its upper twisted closure, the severed end of the tubing is tied into a knot and an access door pivotally connected to the bottom end of the container is opened for the removal of the packages.

A major inconvenience of diaper pails of the "Diaper Genie"™ type is that it is necessary to manually tie both ends of the tubing to use the diaper pail. That is, initially, upon insertion of a new cartridge, an end of the tubing is removed from the cartridge and must be tied into a knot, the knotted end then being pushed into the container to form the waste insertion chamber. Thereafter, when the container is fall but tubing remains in the cartridge, the tubing is severed at a location above the upper twisted closure of the uppermost encapsulated waste package and the severed end of the tubing must be tied into a knot to prevent the series of waste packages from unwinding. The free end of the tubing remaining in the cartridge is again tied into a knot and pushed into the container to enable another series of encapsulated waste packages to be formed.

The necessary, multiple tyings of the tubing is bothersome and moreover, when the knots are not made sufficiently strong, unpleasant odors emanating from the waste packages can escape through the knots.

Another problem with diaper pails of the "Diaper Genie"™ type is that cutting the tubing is difficult and requires the use of a manually operable cutting instrument. This cutting instrument does not enable easy cutting of the tubing.

Yet another problem with diaper pails of the "Diaper Genie"™ type is that the series of waste packages are removed from the diaper pail through an access door pivotally connected to the bottom end of the container. The series of waste packages has been found to be difficult to handle during transfer to a waste receptacle such as a trash bag. Cleaning of the device is also difficult.

Still another problem with known diaper pails and other waste pails is that the person inserting a diaper or other waste material (such as medical waste) into the pail may not remember to rotate the twist rim after insertion of a soiled diaper or other waste. In this case, the waste is not encapsulated by the tubing and malodorous vapors or other potentially hazardous contaminants can escape from the pail. Although this would not prevent future use of the pail as the twist rim could be rotated before the next insertion of waste, it would likely result in the release of odors or other potentially hazardous contaminants. A waste pail which provides for automatic formation of a twist above a waste item after insertion of the waste into the pail is therefore desirable.

Another problem with known diaper and waste pails is that because the diaper or waste pail comes into contact with the series of waste packages, it is liable to become dirty and cleaning of the pail is cumbersome as the access door must be opened, the pail turned over and then the inside surfaces cleaned. A diaper or waste pail which affords easier cleaning for the surfaces which come into contact with the series of waste packages is therefore desirable.

OBJECTS AND SUMMARY OF THE INVENTION

It is an object of the present invention to provide new and improved waste disposal devices, in particular for use in the disposal of disposable diapers, medical wastes and industrial waste.

It is another object of the present invention to provide improved waste disposal devices for the medical and health case industries for use in, for example, hospitals, doctors' offices, operating rooms, nursing homes, out-patient care and the home health care industry for disposal of non "sharps" including adult diapers, bloody/soiled bandages, dressings, disposable bibs, "chucks" and clothing, medical gloves and dialysis machine filters and other disposal medical waste.

It is yet another object of the present invention to provide new and improved waste disposal devices which use flexible tubing to dispose of waste packages.

It is still another object of the present invention to provide new and improved waste disposal devices in which encapsulation of waste packages occurs automatically upon closing a cover of the device or depressing a foot pedal.

It is another object of the present invention to provide new and improved waste disposal devices in which waste products are encapsulated and compacted.

It is yet another object of the present invention to provide new and improved waste disposal devices in which tying of flexible tubing used to dispose of waste packages is unnecessary.

It is a further object of the present invention to provide a new and improved waste disposal device which effectively contains and prevents the release of odors from waste packages.

It is still another object of the present invention to provide new and improved cartridges for waste disposal devices which retain flexible tubing.

It is yet another object of the present invention to provide new and improved waste disposal devices in which a series of encapsulated waste packages are formed and can be removed from the device in an easy and expeditious manner.

It is another object of the present invention to provide new and improved diaper pails which alleviate a problem in known diaper pails, namely the need to remember to rotate a twist rim on a diaper pail after insertion of a soiled diaper in order to encapsulate the diaper.

It is yet another object of the present invention to provide an automatic twist mechanism for a diaper (or other waste) pail which eliminates problems associated with the required manual twisting of a twist rim in order to encapsulate a soiled diaper or other waste product.

In order to achieve at least some of the above objects, a waste disposal device in accordance with the invention generally includes a container defining a waste receiving chamber and a cartridge arranged in the container and containing a length of flexible tubing for encapsulating waste packages after placement of a waste package in the container, with the encapsulated waste packages being retained in the waste receiving chamber. A lid is coupled to the container and is movable between an open position in which the waste receiving chamber is accessible and a closed position in which the waste receiving chamber is covered. A retention mechanism is arranged in the container to hold the waste package.

A rotation mechanism is provided to cause relative rotation between the cartridge and the retention mechanism in order to cause a twist to be formed above a waste package when the waste package is being held by the retention mechanism and thereby encapsulate the waste package in the tubing. That is, either the cartridge is rotated while the retention mechanism is stationary or the retention mechanism is rotated while the cartridge is stationary.

Encapsulation of the waste package prevents the release of odors from the waste package and thus, the invention provides a convenient and sanitary disposal of the waste packages. Once encapsulated, the waste package is urged further into the container upon a subsequent insertion of another waste package. A series of encapsulated waste packages is thus created in the waste receiving chamber of the container, each package contained within a portion of the tubing and sealed at each end by the twisting process. However, the front end of the tubing is not sealed by the twisting process and must be closed by another method, possibly as disclosed below.

It is conceivable that the cartridge can also be rotated upon rotation of the retention mechanism, although this would require some additional operation in order to form a twist in the tubing and encapsulation of the waste packages.

The rotation mechanism may take many forms. In some embodiments, the rotation mechanism is actuated automatically by pressing or depressing a foot pedal, pushbutton or the like. In the alternative, the rotation mechanism may be actuated automatically based on closing and/or opening of the lid. In this manner, one does not need to remember to turn a twist rim, as in conventional waste disposal devices of a similar type, in order to cause a waste package to be encapsulated.

An exemplifying embodiment of a retention mechanism includes a frame defining a waste passage through which the waste package passes and resilient springs connected to the frame and extending inward into the waste passage to engage with and hold the waste package. The frame may be fixed to the container in embodiments wherein the cartridge is being rotated and the retention mechanism is stationary. In embodiments wherein the retention mechanism is rotated and the cartridge stationary, the retention mechanism can additionally include a support flange connected to the frame for supporting the cartridge and an annular ring connected to the support flange and including a gear rim or other toothed structure. The retention mechanism is rotatably supported on the container by, for example, a flange on which the annular ring rests. The gear rim is designed to be rotated by the rotation mechanism to thereby cause rotation of the frame and any waste package held by the resilient springs. An appropriate mechanism is provided to prevent rotation of the cartridge supporting on the support flange of the retention mechanism. Instead of supporting the cartridge directly on the support flange or the retention mechanism in general, it can be removably secured to the container apart from the retention mechanism.

One embodiment of a rotation mechanism for rotating the retention mechanism including the gear rim described above, as well as others disclosed herein having a gear rim, includes a motor having a shaft and providing rotational movement to the shaft and a gear arranged on the shaft and in engagement with the gear rim. As such, rotation of the shaft causes rotation of the gear and gear rim which in turn causes rotation of the frame and any waste package held by the resilient springs connected to the frame. The rotation mechanism may be housed in a compartment defined by a wall inside the container, to prevent the waste packages from damaging the rotation mechanism. The wall includes a slot through which the gear rim extends into engagement with the gear mounted on the shaft. In the alternative, the gear may extend through the slot into engagement with the gear rim.

A compacting mechanism may be provided to compact the waste packages. This is particularly advantageous for medical waste such as is generated by doctors in doctor's offices. The compacting mechanism can be actuated by the same motor which causes rotation of the retention mechanism. In an exemplifying embodiment, the compacting mechanism includes a rotatable shaft extending between opposite sides of the waste chamber, preferably supported on both sides, with a front end of the tubing from the cartridge being connected to the shaft prior to use of the waste disposal device. When the motor is actuated, the shaft is rotated and the tubing having waste packages encapsulated therein is rolled around the shaft thereby compacting any waste package encapsulated by the tubing. The waste package are encapsulated by the formation of twists above the waste packages in the manner described above.

Another rotation mechanism for rotating a retention mechanism having a gear rim as described above comprises a series of gears mounted on a flange in the container and a pedal mounted exterior of the container and connected to a pulley. A cable passes over this pulley and is fixed at one end to the container and windable about a shaft at its other end so that movement of the pedal in a slot causes the shaft to rotate. A gear is mounted on the shaft and a clutch assembly is interposed between the gear and the gear rim in order to transfer the rotational force of the gear to the gear rim. The clutch assembly is constructed to provide for a unidirectional transmission of rotational force from the gear to the gear rim. To this end, the clutch assembly may comprise a clutch member having a gear portion in meshing engagement with the gear mounted on the shaft. The clutch member is mounted about a drive spindle connected to a drive gear which in turn is in meshing engagement with an idler gear. The idler gear is in meshing engagement with a gear rim formed on the retention mechanism. The clutch member is constructed to engage or disengage from the drive spindle so that the rotational force is transferred to the drive only upon movement of the pedal in one direction and not the opposite direction.

An alternative rotation mechanism for rotating a retention mechanism without a gear rim includes a pulley attached to the retention mechanism and a pulley attached to the shaft of the motor or to the shaft of the compacting mechanism, if present. A cable is threaded through the pulleys and guided by guide pulleys if necessary so that the rotation of the shaft of the motor or the shaft of the compacting mechanism is converted into rotational movement of the retention mechanism via the cable. The retention mechanism in this case includes a frame, resilient springs connected to the frame, the pulley and an annular ring around the frame with the retention mechanism being rotatably supported on the container by, for example, the annular ring resting on a flange of the container.

In an embodiment wherein the rotation mechanism is manually actuated, the rotation mechanism comprises a handle situated at least partially outside of the container and movable in a slot in an outer wall of the container and a mechanism for converting movement of the handle into unidirectional rotational movement of the frame of the retention mechanism to thereby rotate the frame, the resilient springs and a waste package engaged by the resilient springs relative to the tubing in the cartridge. Uni-directional rotational movement of the frame is necessary to prevent unwinding of the twists in the tubing. One manner to accomplish this is to provide an inner ring connected to the frame and having grooves on an inner face and a first, movable outer ring surrounding the inner ring and connected to the handle. The first outer ring includes a pin engaging with the grooves on the inner ring so that upon sliding movement of the handle, the first outer ring rotates, and via the engagement of the pin with the grooves in the inner ring, the inner ring and frame rotate. Also, a second, stationary outer ring is connected to the container and has grooves on an inner face. A pin connected to the inner ring engages with the grooves on the second outer ring to prevent return movement of the frame. As such, the frame rotates only when the handle is moved in a "forward" direction and not when the handle is moved in a "reverse" direction. Repeated forward and reverse movement of the handles will thus result in multiple twists in the tubing.

To allow for easy removal of the series of encapsulated waste packages from the container, a pail, or another comparable removable waste receptacle, may be placed in the container on a base for receiving the encapsulated waste packages and an access door is formed in an outer wall of the container to enable removal and emptying of the pail. The pail may be lined with a trash bag so that when the pail is removed, the trash bag is closed and sealed with the series of encapsulated waste packages therein.

In the alternative, a hamper can be provided having an outer wall constituting a portion of the outer wall of the container and defining the waste receiving chamber. The hamper may be pivotally attached to the container so that by pivoting the hamper outward, the series of encapsulated waste packages is exposed and thus easily removable from the hamper.

In the embodiments described above, the retention mechanism includes resilient springs which engage the waste package and prevent its rotation relative to the retention mechanism. Other mechanisms for preventing rotation of waste packages relative to a retaining structure are also contemplated within the scope of the invention.

For example, in another embodiment of a waste disposal device, the retention mechanism is constructed in connection with a rotatable pail situated in the container so that the first waste package is held stationary by the pail itself. The rotation mechanism in this embodiment is designed to rotate the pail while the cartridge is stationary. To this end, the rotation mechanism may comprise a turntable arranged below the pail, a string for manually causing rotation of the turntable (by pulling the string), with the turntable being in engagement with the pail via cooperating formations on the turntable and pail, and a mechanism for returning the turntable to is original position to be ready for a subsequent rotation via pulling of the string. The mechanism by which the turntable returns to its original position may be a torsion spring or the like.

The cartridge used in the waste disposal devices in accordance with the invention can be any conventional cartridge containing flexible tubing and defining a waste insertion chamber. However, a drawback of known cartridges is that the tubing generally must be tied or knotted both at the beginning and end of use. Therefore, in order to achieve additional objects of the invention, the waste disposal devices in accordance with the invention are designed to use a cartridge having tubing which can be closed and sealed at both ends without requiring tying of knots. One construction of such a cartridge includes a casing defining a cavity containing tubing and including opposed substantially cylindrical inner and outer walls and an annular lower wall extending between the inner and outer walls and an annular cover connected to the casing and enclosing the tubing in the cavity such that a ring-shaped opening is defined between an inner edge of the cover and the inner wall for passage of the tubing therethrough.

The closing and sealing of the front end of the tubing outside of the cavity is obtained by, for example, a metal clip or clasp attached to the front end of the tubing.

The closing and sealing of the rear end of the tubing, i.e., that end connected to the cartridge, is obtained by constructing the cartridge to fold about itself. For example, score lines can be arranged on the cover to enable the cover to be folded about the score lines and score lines or slits arranged in the casing in alignment with the score lines of the cover to enable the casing to bend or break in conjunction with the folding of the cover about the score lines. If the casing is made of cardboard, then only score lines are required, not slits.

One or both of the folded parts of the cover may be provided with a connection mechanism to enable the folded parts of the cover to stay together. The connection mechanism may be adhesive, hook and loop fasteners or ties and clasps formed or stamped in the cover.

The above-described embodiments involve rotation of the retention mechanism relative to the stationary cartridge. In an embodiment wherein the cartridge is rotated relative to the retention mechanism, a rotation mechanism is provided which automatically rotates the cartridge upon movement of the lid. The automatic rotation of the cartridge could also be performed automatically in conjunction with the movement of the lid or as a consequence of the movement of the lid. Rotation of the cartridge after insertion of a waste package into the waste insertion chamber causes the tubing to twist and encapsulate the waste package. The automatic rotation of the cartridge is achieved preferably only upon closing of the lid so that when the lid is closed, the cartridge is rotated and the tubing is twisted. In this manner, one does not need to remember to turn a twist rim, as in conventional waste disposal devices of a similar type, in order to cause a waste package to be encapsulated. Opening of the lid will not cause rotation of the cartridge and thus the encapsulated waste package will not be opened.

This type of rotation mechanism can take many forms with the objective being to convert the movement of the lid, which is invariably performed after insertion of a soiled waste package, into a rotation of the cartridge to thereby cause twisting of the tubing. In one embodiment, a rack gear is attached to the lid and a gear assembly is arranged in the container with one gear adapted to frictionally engage the teeth of the rack gear upon downward movement of the lid. The gear assembly includes a circular plate with projections or a drive gear with teeth which mesh with a series of projections formed on the periphery of the cartridge. This drive gear is coupled through a gear assembly to the gear in engagement with the rack gear so that the movement of the rack gear causes rotation of all of the gears in the gear assembly and the drive gear and thus rotation of the cartridge. Instead of a rack gear, a toothed plate can be used.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE PREFERRED EMBODIMENTS

Figure 1:
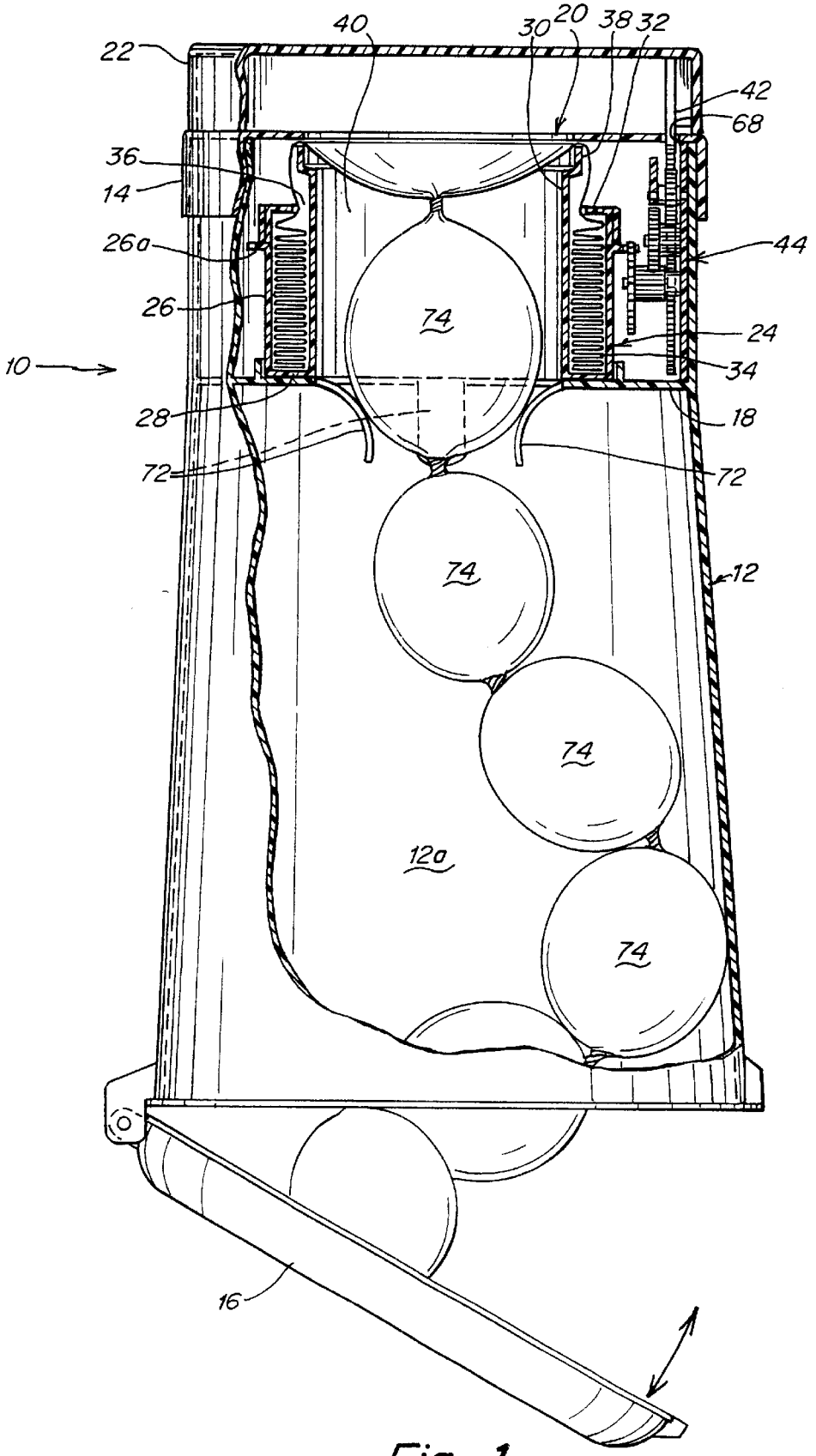
FIG. 1 is a partially cut-away side view of a first embodiment of a waste disposal device in accordance with the invention.

Several embodiments of waste disposal devices in accordance with the invention are described below. Generally, the waste disposal devices provide for relative rotation between a cartridge of flexible tubing and a retention unit, mechanism or member which holds a waste package stationary, i.e., either the cartridge is rotated relative to the retention unit or the retention unit is rotated while the cartridge is stationary. In this manner, the flexible tubing is caused to twist above the waste package thereby encapsulating the waste package in the tubing. The encapsulated waste package is then urged into a waste receiving chamber of the waste disposal device upon the insertion of another waste package into the device to be encapsulated or in some embodiments, provisions are made to enable the encapsulated waste package to be drawn into the waste receiving chamber without dependency on the subsequent insertion of another waste package. Repeated insertions of waste packages causes the formation of a series of encapsulated waste packages which can be removed from the container when the container is full or the tubing is exhausted.

It is contemplated that the features of different embodiments described herein can be used together with one another in the same waste disposal device to the extent possible. For example, new and unique cartridges of flexible tubing are disclosed below and it is envisioned that these cartridges can be used in all of disclosed waste disposal devices. On the other hand, some of the waste disposal devices described below are shown for use with this new cartridge. Nevertheless, it is contemplated that these waste disposal devices can be used with other cartridges including conventional cartridges, which might entail use of an appropriate adapter, one of which is described below.

Throughout the several views, the same reference numerals will be used to designate the same or similar elements. Variations in the elements may be present in the drawings and if so, it is to demonstrate that the elements can have different forms.

Referring first to FIGS. 1–4, a waste disposal device in accordance with one form of the present invention is shown. The waste disposal device 10 comprises a generally cylindrical container 12 defining a waste receiving compartment 12*a*, a removable cover 14 arranged on the top of the container 12 and an access door 16 pivotally connected to the bottom of the container 12. Cover 14 fits snugly to the upper rim of the container 12 and defines a waste insertion opening 20. A lid 22 is pivotally connected to the cover 14 so as to be movable between an open position in which the waste insertion opening 20 is exposed to enable insertion of a waste package such as soiled diaper into the container 12 and a closed position in which the lid 22 overlies and closes the waste insertion opening 20. A flange 18 is located inside the container 12 along the inner surface of the container 12, and may be integrally formed with the container 12. Flange 18 can conform to the cross-sectional shape of the container 12, which may be cylindrical or otherwise.

A removable cartridge 24 rests on the flange 18 and contains a circumferentially pleated length of flexible tubing 34. Tubing 34 may constitute a polybag. Cartridge 24 includes a cylindrical outer wall 26, a lower wall 28, an inner wall 30 and an upper wall 32 which together define a cavity for receiving the circumferentially pleated length of flexible tubing 34. A ring-shaped opening 36 is defined between the inner wall 30 and the upper wall 32 for passage of the tubing 34. Inner wall 30 is provided with an annular flange or lip 38 over which the tubing 34 passes into a waste insertion chamber 40 defined by the inner wall 28. Waste insertion chamber 40 aligns with the waste insertion opening 20 defined in the cover 14. The cartridge 24 is removed when the tubing 34 is used up by separating the cover 14 from the container 12, and a full cartridge is then placed onto the flange 18 and the cover 14 fit onto the container 12.

A rotation mechanism is provided to enable movement of the lid 22 to be converted into rotation of the cartridge 24. More particularly, the downward movement of the lid 22 causes automatic rotation of the cartridge 24, with the rotation of the cartridge 24 causing twisting of the tubing 34 above the waste package in the waste insertion chamber 40. In this manner, the twist rim present in conventional waste disposal devices of a similar type is not required.

Specifically, the mechanical rotation mechanism, which causes rotation of the cartridge 24 upon the downward movement of the lid 22 to its closed position, includes a toothed member such as a rack gear 42 fixed to the lid 22 and a cooperating gear assembly 44 arranged in connection with the container 12.

Rack gear 42 has an arcuate shape and includes a series of teeth formed on at least a portion of the outer arcuate surface with spaces being present between the teeth. An elongate slot 68 is provided in the cover 14 through which the rack gear 42 passes for engagement with the gear assembly 44 (see FIG. 2). Instead of a rack gear 42, a toothed plate or any other member having teeth on an edge could be used. The rack gear 42 could also be provided with teeth on the inner arcuate surface in which case, the gear assembly 44 would be positioned inward of the rack gear 42 between the rack gear 42 and the rear of the container 12. Other cooperating, force-transmitting constructions could be used to enable the movement of the lid 22 to be transferred to an element of the gear assembly.

Gear assembly 44 is mounted on a plate 46 so that the gear assembly 44 and plate 46 can be formed as a discrete component insertable into a pre-formed site in the container 12. As shown, plate 46 is mounted on an inner wall of the container 12 between mounting brackets 70 which define elongate slots for receiving opposed edges of the plate 46. In this manner, the plate 46 containing the gear assembly 44 thereon is easily and removably mounted to the container 12. The plate 46 can also be formed integral with the container.

Figure 3:
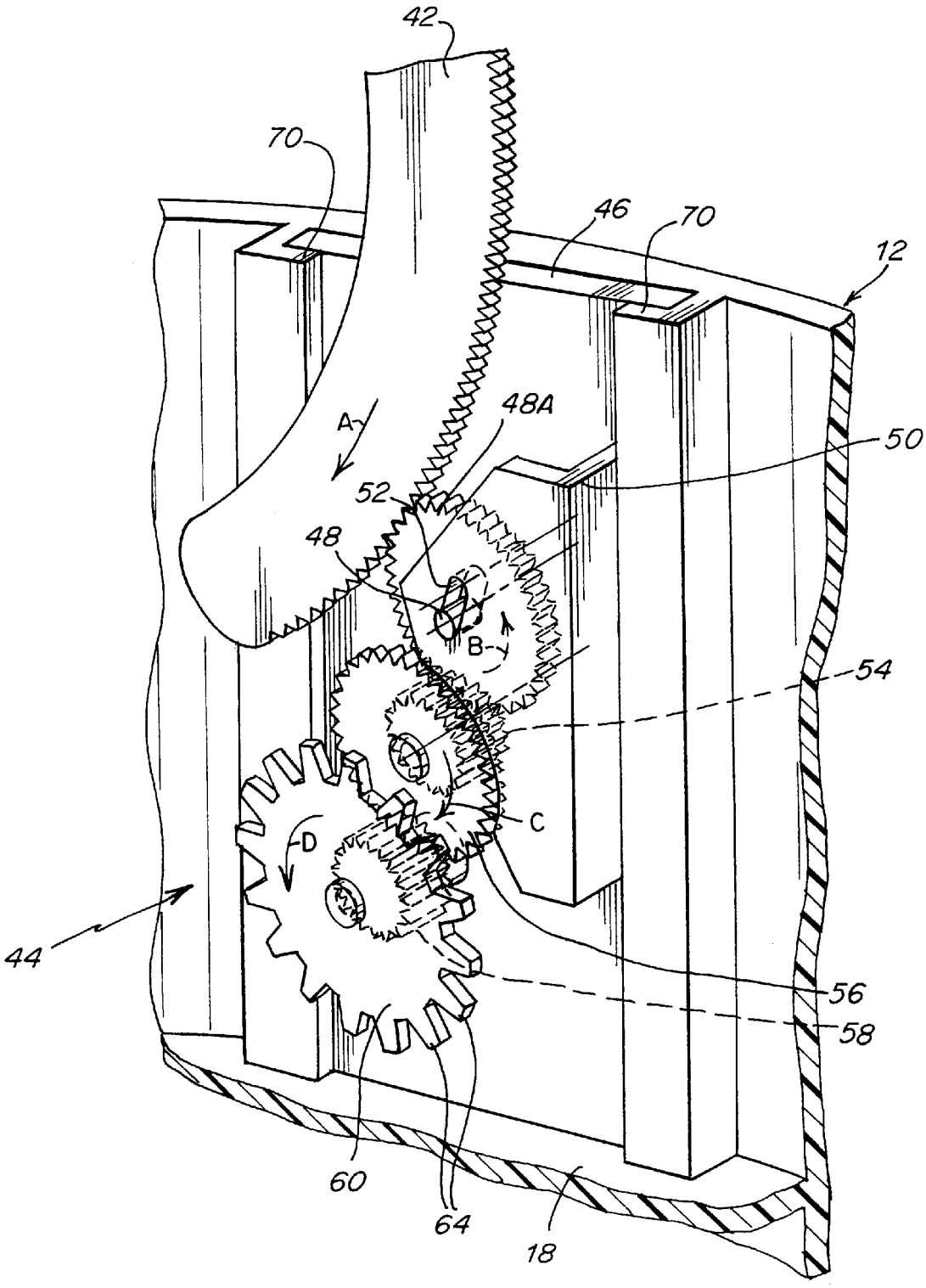
FIG. 3 is a view of the gear assembly interacting with a rack gear in the embodiment shown in FIG. 1 in a position in which movement of the rack gear is transmitted by the gear assembly to the cartridge.
Figure 4:
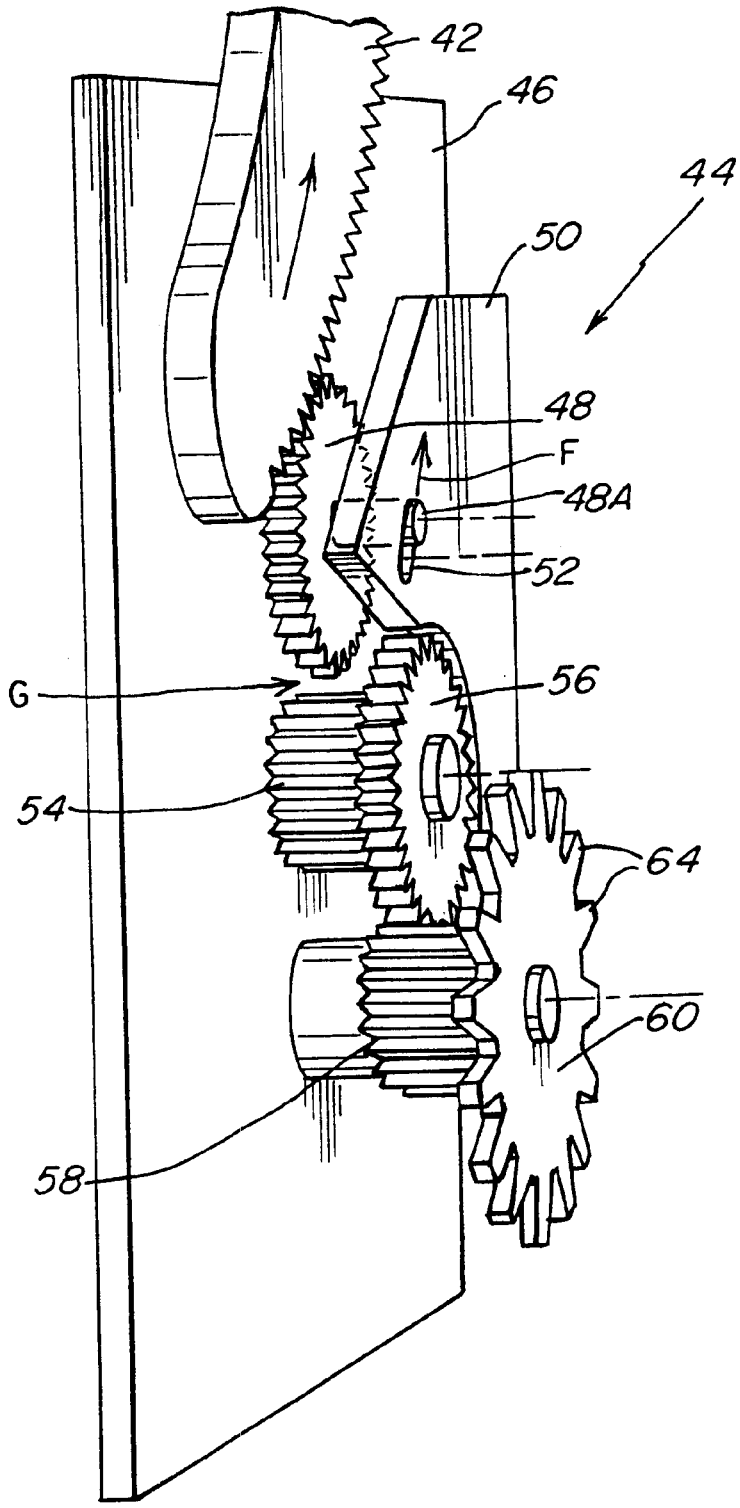
FIG. 4 is a view of the gear assembly shown in FIG. 3 in a position in which movement of the rack gear is not transmitted by the gear assembly to the cartridge.

A non-limiting embodiment of gear assembly 44 is shown in greater detail in FIGS. 3 and 4. Gear assembly 44 includes a first gear 48 adapted to engage the rack gear 42. Gear 48 is mounted between the plate 46 and a mounting bracket 50 attached to or formed in conjunction with the plate 46. An elongate aperture 52 is arranged in the mounting bracket 50 for retaining an end of a shaft of the gear 48 in such a manner that the gear 48 is slightly movable. The purpose of the movement of the gear 48 is explained below.

Gear assembly 44 further includes a coupled set of two gears 54,56 mounted on the plate 46 with gear 54 being in meshed engagement with gear 48. Gear 56 is spaced from the plate 46 and is positioned at the same level as the mounting bracket 50 which is thus shaped with an arcuate form to accommodate gear 56. Gear assembly 44 further includes another gear 58 also mounted on plate 46 in meshed engagement with gear 56. A gear 60 is attached to gear 58 and includes a series of projections 64 extending outward from a peripheral edge. Instead of gears, any type of toothed member can be used.

The engaged pairs of gears 48,54 and 56,58 are constructed in a conventional manner so that rotation of one gear of each pair causes rotation of the other gear in that pair. Specifically, with reference to FIG. 3, when the rack gear 42 is moved in the direction of arrow A, which occurs when the lid 22 is being closed, gear 48 is moved downward until its shaft 48A is against the lower edge of the aperture 52 at which time, the continued movement of the rack gear 42 causes the gear 48 to rotate in the direction of arrow B causing gears 54,56 to rotate in the direction of arrow C, which is opposite to the direction of rotation of gear 48. Rotation of gear 56 in the direction of arrow C causes gears 58,60 to rotate in the direction of arrow D, which is opposite to the direction of rotation of gears 54,56.

Further, gears 54, 56 and 58 are constructed to increase rotation of gear 60 in relation to the rotation of gear 48. That is, gear 54 has a smaller diameter than gear 48 and gear 56 so that gear 56 rotates faster than gear 48 while gear 58 has a smaller diameter than gear 56 and gear 60 so that gear 60 rotates faster than gear 56. One rotation of gear 46 will thus translate into multiple rotations of gear 60. The ratio of the diameters of the gears 46, 54, 56, 58, i.e., the gear ratio, can be designed to provide whatever appropriate rotation of gear 60 is needed to facilitate operation of the waste disposal device in the manner described below.

Figure 2:
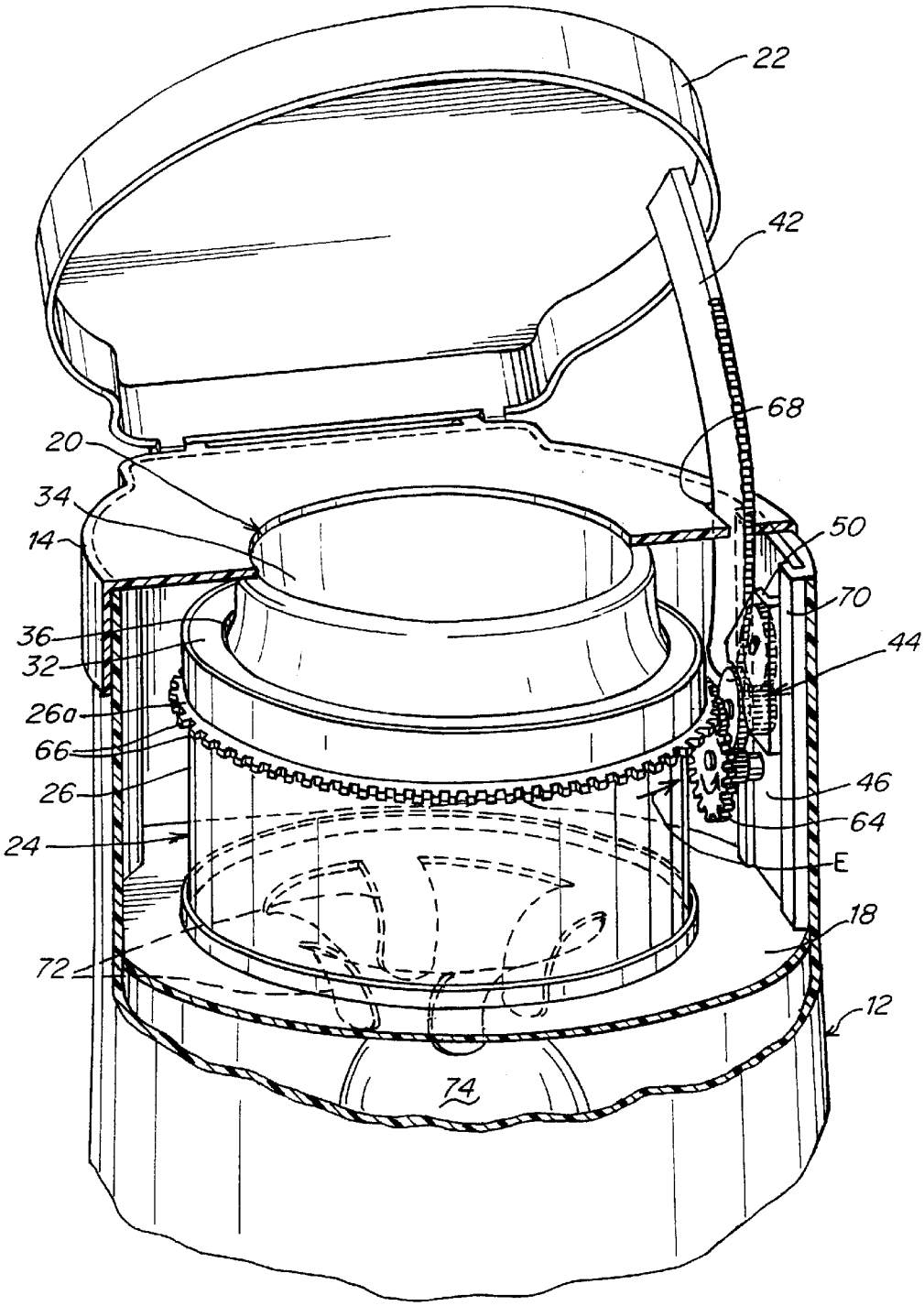
FIG. 2 is a partially cut-away view of the upper region of the waste disposal device shown in FIG. 1 with the lid in an open position.

Referring to FIG. 2, cartridge 24 has a series of projections 66 extending outward from a rim 26*a* of outer wall 26. Although not shown, projections 66 are uniformly spaced around the entire circumference of the outer wall 26. Projections 64 on the gear 60 are designed to mesh with the projections 66 on the cartridge 24 to enable rotation force to be transferred from the gear assembly 44 to the cartridge 24. As such, rotation of the gear 60 in the direction of arrow D in FIG. 3 will result in rotation of the cartridge 24 in the direction of arrow E in FIG. 2. Rotation of the cartridge 24 causes twisting of the tubing 34 above a waste package when the waste package is held stationary.

The projections 66 can be formed integral with the outer wall 26 in which case, the cartridge 34 would be different than conventional cartridges which do not have any such projections. In the alternative, since it is desirable to be able to use conventional cartridges, an annular attachment rim could be provided. The conventional cartridge would be placed in the annular attachment rim, which would be sized to provide a snug fit and/or include a cooperating attachment mechanism in order to fix the cartridge to the attachment rim so that rotation of the attachment rim causes rotation of the cartridge. The attachment rim would include a series of projections adapted to mesh with the gear 60. In this manner, either the special cartridge including the integral projections 66 or a cartridge designed for use in conventional waste disposal devices of the same or a similar type could be used in this embodiment of the invention.

As shown in FIG. 2, gear 60 is positioned below the rim 26*a* of the outer wall 26 so that the projections 64 on the gear 60 engage the projections 66 on the cartridge 24 from below. However, it is also contemplated that the projections 64 can engage the projections 66 from above, either by forming the projections 66 on a rim about a lower portion of the cartridge 24, reducing the height of the cartridge 24 while maintaining the same gear assembly 44 or by constructing the gear assembly 44 such that the gears 58, 60 rotate about an axis above the projections 66.

The rotation mechanism as shown is designed to cause rotation of the cartridge 24 only upon closing movement of the lid 22. The gear train is thus arranged to prevent transmission of a rotational force by the rack gear 42 during movement of the lid 22 to its open position and allow transmission of a rotational force by the rack gear 42 during movement of the lid 22 to its closed position. Any known design and construction of gears to provide for a one-way transmission of rotational force could be applied in the invention. In the illustrated embodiment, a one-way transmission of rotational force is provided by the mounting of the shaft of the gear 48 in the aperture 52. As such, when the lid 22 is moved to its closed position, the shaft 48A of the gear 48 is pressed downward against a lower edge of the aperture 52 by the rack gear 42 so that the rack gear 42 frictionally engages gear 48 and causes rotation of gear 48 (see FIG. 3). On the other hand, when the rack gear 42 is moved upward upon movement of the lid 22 to its open position, gear 48 moves upward (in the direction of arrow A in FIG. 4) out of engagement with the gear 54 such that a space G is formed between the gear 48 and the gear 54. The upward movement of gear 48 is facilitated by the placement of the shaft 48A of the gear in the aperture 52. Although the rack gear 42 will continue to engage and rotate gear 48 during its upward movement, the rotation of gear 48 is not transmitted to the gear 54 so that the cartridge 24 does not rotate and unwind the twist. The size and orientation of the aperture 52 are designed to allow for movement of the shaft 48A in the desired manner.

It is also conceivable that a rotation mechanism could also be designed to cause rotation of the cartridge either only upon opening of the lid or upon both closing and opening of the lid.

The apparatus is designed to hold an encapsulated waste package stationary while the flexible tubing 34 is twisted. To this end, tongues or springs 72 are attached to the flange 18. The springs 72 hold a waste package 74 within the flexible tubing 34 stationary while the cartridge 24 is rotated to twist the flexible tubing 34 and seal the end of the waste package 74. Alternate arrangements for preventing rotation of the waste package 74 during rotation of the cartridge 34 include springs attached to the container 12 and projecting radially inward in order to engage the waste package 74, or springs attached to or formed integral with a retention member which in turn is attached to the container. Additional arrangements for preventing rotation of the waste package which may be incorporated into this embodiments are described below.

Moreover, other arrangements for holding a waste package stationary during twisting of the tubing which may be used in conjunction with the invention are disclosed in U.S. Pat. Nos. 4,869,049, 5,590,512, 5,813,200, 6,128,890 and 6,170,240, all of which are incorporated by reference herein. These patents also disclose several variations of a cutting device that may be incorporated into the waste disposal device in accordance with the invention for the purpose of severing the flexible tubing 34 when the container 12 is full of waste packages 74.

To prepare the waste disposal device 10 for use, the cover 14 is opened and a cartridge 24 is placed onto the flange 18. An end of the flexible tubing 34 is taken from the cartridge 24 to cause a length of the tubing 34 to be pulled through opening 36 and this end is then knotted. This knot of flexible tubing 34 is then placed over the lip 38 into the waste insertion chamber 40 to thereby form a first bag for storing a waste package 74. The cover 14 is then reattached to the container 12 and the device is ready for use.

In use, the lid 22 is opened to expose the waste insertion opening 20 of cover 14 and the aligned waste insertion chamber 40 of the container 12. A waste package 74 such as a soiled diaper is placed into the bag formed by flexible tubing 34 preferably so that the bag is held against the springs 72.

The lid 22 is then closed causing the rack gear 42 to rotate the gears 48, 54, 56, 58 and 60. Rotation of the gear 60, which is in meshed engagement with the projections 66 on the cartridge 24, will automatically cause rotation of the cartridge 24. Rotation of the cartridge 24 will cause the flexible tubing 34 not held stationary by the weight of the waste package 74 in engagement with the springs 72 to be twisted while the waste package 74 is held stationary. Thus, the flexible tubing 32 located above the waste package 74 twists and encloses and encapsulates the waste package 74.

Once a waste package 74 is sealed, the waste package 74 can be pushed downwardly past the retention springs 72 into the container 12 upon the following insertion of a waste package into the waste insertion chamber 40. Successive waste packages 74 can be sanitarily stored in the container 12 because each waste package 74 is individually sealed. Once the container 12 is filled, a cutting device can be used to sever the end of the most recently disposed waste package 74 from the roll of flexible tubing 34, and the series of waste packages 74 can be removed from the container 12 through the bottom access door 16.

Modifications to the above embodiment are contemplated, including but not limited to, variations in the rotation mechanism which converts the movement of the lid to rotation of the cartridge.

Figure 5:
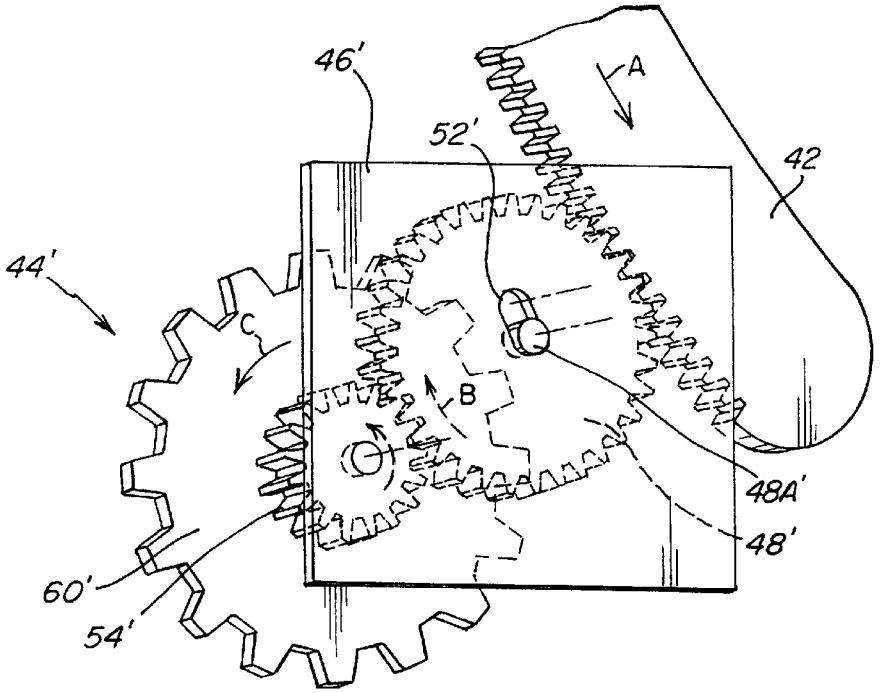
FIG. 5 is a view of another gear assembly interacting with a rack gear for use in the embodiment shown in FIG. 1 in a position in which movement of the rack gear is transmitted by the gear assembly to the cartridge.
Figure 6:
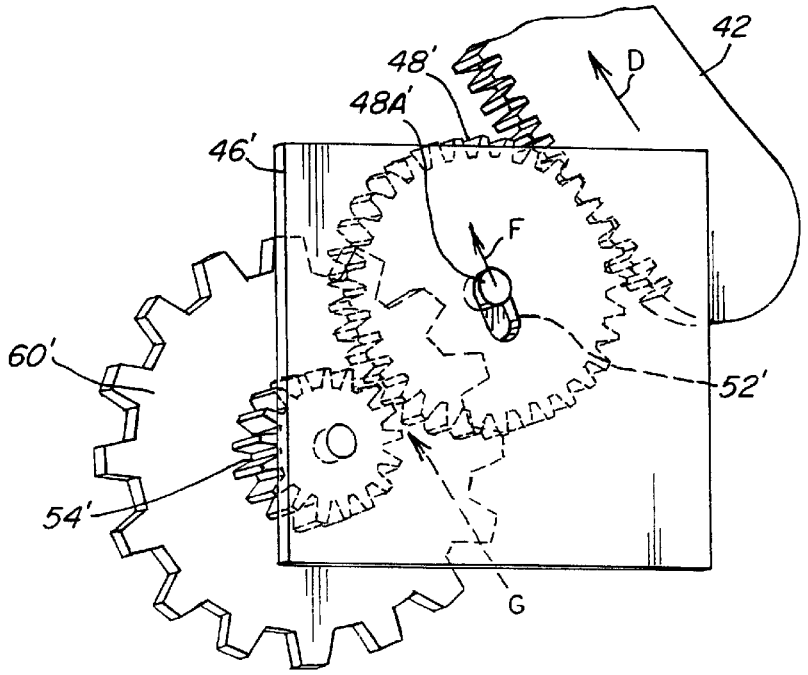
FIG. 6 is a view of the gear assembly shown in FIG. 5 in a position in which movement of the rack gear is not transmitted by the gear assembly to the cartridge.

For example, another gear assembly for converting the downward movement of the lid 14 and associated rack gear 42 into rotational movement of the cartridge 24, while preventing rotational movement of the cartridge 24 during upward movement of the lid 14 is shown in FIGS. 5 and 6. This gear assembly 44' includes a gear 48' meshing with the rack gear 42 and mounted with its rotation shaft in an aperture 52' formed in a plate 46' attached to or formed integral with the inner wall of the container 12. Gear assembly 44' further includes a second gear 54' in meshing engagement with the gear 48' and which is also mounted on the plate 46'. A gear 60' is attached to the gear 54' and is arranged to mesh with the projections 64 on the cartridge 24.

For this gear assembly 44', a one-way transmission of rotational force is provided by the mounting of the shaft of the gear 48' in aperture 52'. When the rack gear 42 is moved in the direction of arrow A, which occurs when the lid 22 is being closed, it frictionally engages gear 48' and pushes gear 48' downward until its shaft 48A' is against the lower edge of the aperture 52' at which time, the continued movement of the rack gear 42 causes the gear 48' to rotate in the direction of arrow B causing gears 54',60' to rotate in the direction of arrow C, which is opposite to the direction of rotation of gear 48'. Rotation of the gear 60' causes rotation of the cartridge 34 through the meshing engagement of the projections 64 on the cartridge with gear 60'.

On the other hand, when the rack gear 42 is moved upward upon movement of the lid 22 to its open position (in the direction of arrow A in FIG. 6), gear 48' is moved upward against an upper edge of the aperture 52' out of engagement with the gear 54' (in the direction of arrow B) with a space G being formed between the gear 48' and the gear 54'. The upward movement of gear 48' is facilitated by the placement of the shaft 48A' of the gear in the aperture 52'. Although the rack gear 42 will continue to engage and rotate gear 48' during the upward movement of the rack gear 42, the rotation of gear 48' is not transmitted to the gear 54' because of the separation between gear 48' and gear 54' so that the cartridge 24 does not rotate and unwind the twist.

Instead of providing projections on the outer wall of the cartridge 24, sponge rollers can be used to transfer the rotational force provided by the gear assembly to the cartridge.

Although several embodiments of a waste disposal device incorporating cartridge rotation mechanisms in accordance with the invention are shown in FIGS. 1–6, the cartridge rotation mechanisms disclosed above can be incorporated into numerous waste disposal devices that differ from the embodiments shown in FIGS. 1–6.

The embodiments in FIGS. 1–6 involve the rotation of the cartridge relative to the waste package which is held stationary. The following embodiments of waste disposal devices provide rotation of the waste package relative to the cartridge which is stationary.

Figure 7:
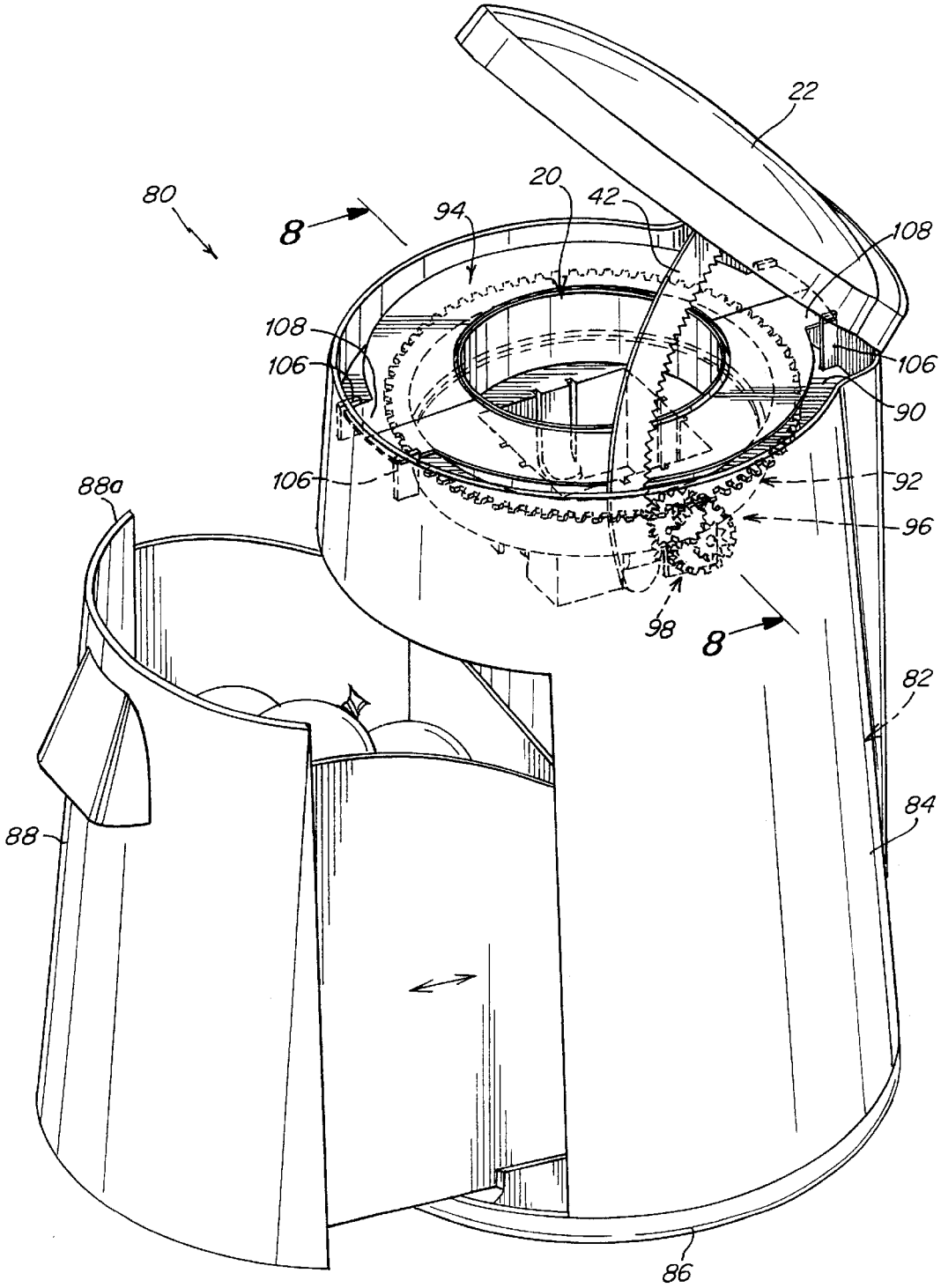
FIG. 7 is a perspective view of a first embodiment of the invention wherein waste packages are rotated relative to the cartridge.
Figure 8:
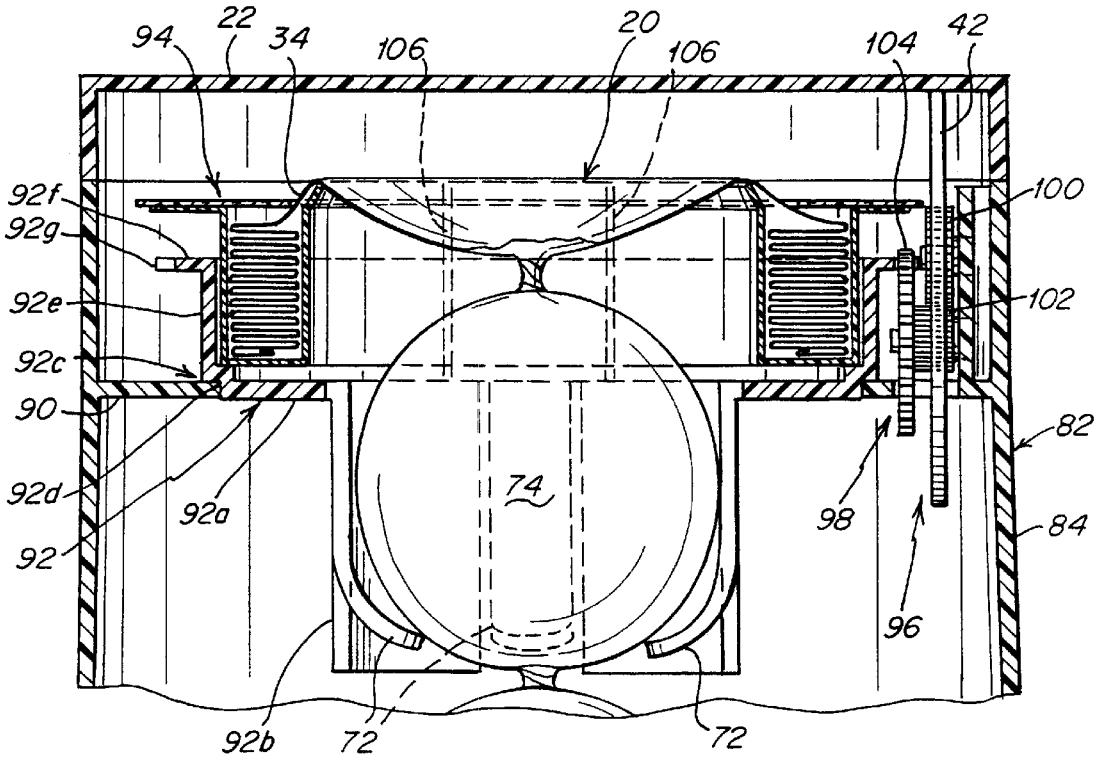
FIG. 8 is a sectional view taken along the line 8—8 of FIG. 7 with the lid in a closed position.
Figure 9:
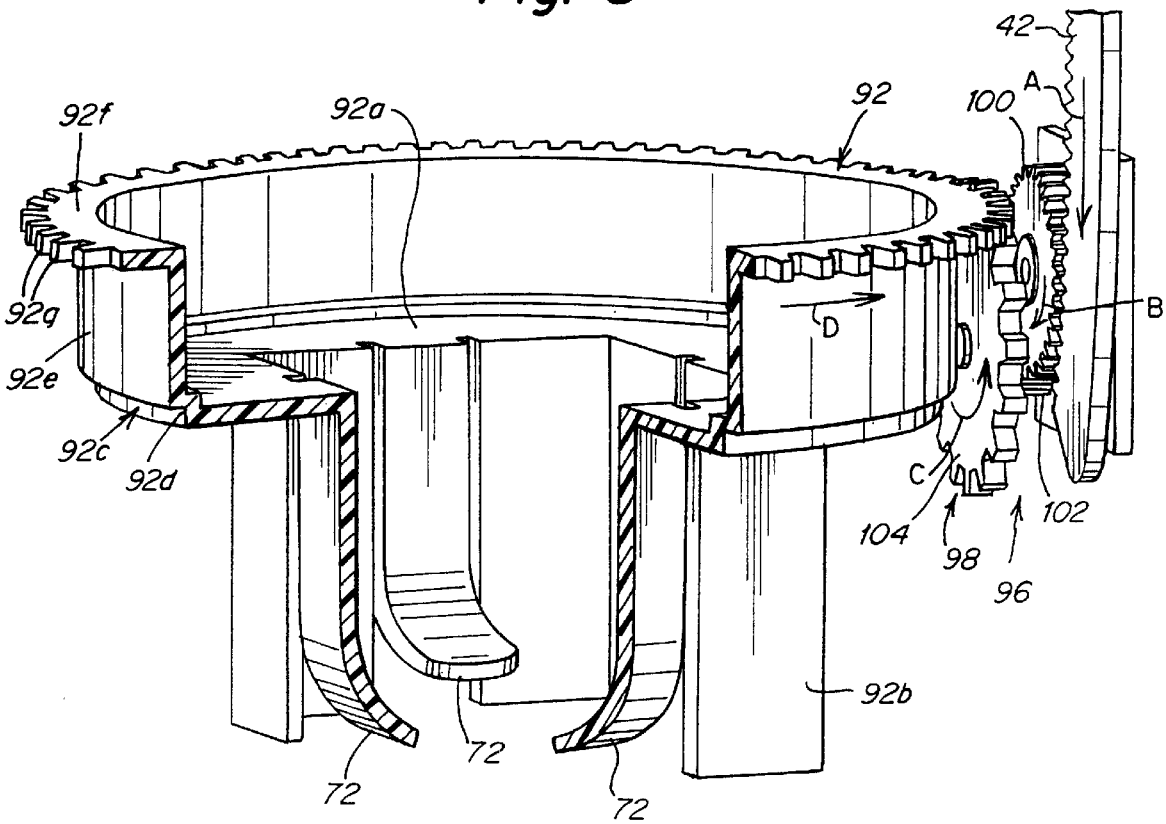
FIG. 9 is a perspective view partially cut-away showing the manner in which the retention member is rotated.

A first embodiment of such a waste disposal device is shown in FIGS. 7–9 and it incorporates a rotation mechanism for rotating the waste package relative to the cartridge. The waste disposal device 80 includes a substantially cylindrical container 82 having an outer wall 84, and a base 86 arranged at a lower end of the outer wall 84. A removable hamper 88 is provided and has a wall 88*a* which also constitutes a part of the outer wall 84 of the container 82. The waste packages accumulate in the hamper 88 and the hamper 88 is removed from the container 82 and emptied when full. Since the hamper 88 comes into direct contact with the waste packages and is liable to become dirty, it is advantageous that it is detachable from the container 82 so that it can be easily cleaned, possibly by placing it in a dishwasher.

A lid 22 is pivotally connected to the outer wall 84 so as to be movable between an open position in which a waste insertion opening 20 is exposed to enable insertion of a waste package such as soiled diaper into the container 82 and a closed position in which the lid 22 overlies and closes the waste insertion opening 20.

A flange 90 is located inside the container 82 along the inner surface of the container 82, and may be integrally formed with the container 82. Flange 90 can conform to the cross-sectional shape of the container 82.

A retention member 92 is seated on the flange 90 and includes tongues or springs 72 adapted to grasp a waste package 74 (FIG. 8). Retention member 92 has a frame including lower planar section 92*a* from which the springs 72 and vertical walls 92*b* descend, the vertical walls 92*b* defining an enclosure in which the springs 72 retain the waste package 74. A stepped section 92*c* is adjacent the outer edge of the planar section 92*a* and forms an indentation 92*d* enabling the retention member 92 to be movably seated on the flange 90. A cylindrical wall section 92*e* is adjacent the stepped section 92*c* and a circular gear rim 92*f* adjoins the cylindrical wall section 92*e*. Projections 92*g* are formed on the gear rim 92*f*.

A removable cartridge 94 rests on the stepped section 92*c* and contains a circumferentially pleated length of flexible tubing 34. Additional details of the cartridge 94 are set forth below with reference to FIGS. 10–12.

A rotation mechanism 96 is provided to rotate the retention member 92. The rotation mechanism 96 includes a rack gear 42 attached to the lid 22 and having a series of teeth on at least a portion of an inner arcuate surface, and a gear assembly 98 arranged on the container 82. Gear assembly 98 includes a first gear 100 in meshing engagement with the rack gear 98 and a second gear 102 in meshing engagement with the first gear 100. Gear 102 is connected to a drive gear 104 which is in meshing engagement with the projections 92*g* on the rim 92*f* of the retention member 92 (FIG. 9). Gear assembly 98 also includes an appropriate mechanism for enabling one-way transmission of rotational force from the rack gear 42 to the gear 104, for example, the formation of an aperture in which the rotation shaft of the gear 100 is arranged to enable movement of the gear 100 into and out of engagement with the gear 102 (see FIGS. 3–6 and the relevant discussion above about the transmission of rotational force in only a single direction by mounting a rotation shaft of a gear in an aperture).

Thus, when the lid 22 is closed, the rack gear 42 is moved in the direction of arrow A in FIG. 9 causing the gear 100 to rotate in the direction of arrow B. Gears 102 and 104 are caused to rotate in the direction of arrow C and the retention member 92 is caused to rotate in the direction of arrow D. As such, the closing movement of the lid 22 is converted into rotational movement of the retention member 92. Other mechanisms for converting the movement of the lid into rotational movement of the retention member 92 are also contemplated within the scope of the invention and include those rotation mechanisms described in other embodiments herein.

In order to provide for relative rotation between the retention member 92 and the cartridge 94 and thus the formation of a twist in the tubing 34 above a waste package being retained by the springs 72 of the retention member 92, a mechanism for preventing rotation of the cartridge 94 is provided. Specifically, two pair of anti-rotation tabs 106 are arranged on the inner wall of the container 82 with the anti-rotation tabs 106 in each pair being spaced apart a distance substantially equal to the size of flanges 108 formed on the cartridge 94 (see FIG. 7). When the cartridge 94 is placed so that the flanges 108 are between the anti-rotation tabs 106, the cartridge 94 is prevented from rotating along with the retention member 92.

In use, the lid 22 is opened to expose the waste insertion opening 20. A waste package is placed into a bag formed by flexible tubing 34 preferably so that the bag is held against the springs 72.

The lid 22 is then closed causing the rack gear 42 to rotate the gears 100, 102 and 104. Rotation of the gear 104, which is in meshed engagement with the projections 92*g* on the rim 92*f* of the retention member 92, will cause rotation of the retention member 92. Rotation of the retention member while the cartridge 94 is held stationary will cause the flexible tubing 34 to be twisted above the waste package 74 and thereby encloses and encapsulates the waste package 74.

Once a waste package 74 is sealed, the waste package 74 can be pushed downwardly past the retention springs 72 into the container 82 upon the following insertion of a waste package into the waste insertion chamber 20. Successive waste packages 74 can be sanitarily stored in the container 82 because each waste package 74 is individually sealed.

Other constructions of retention members can be used in this embodiment. For example, the retention member 92 can be formed with a planar section from which springs 72 and the vertical walls 92*b* descend, and have a ring gear formed on an outer peripheral edge or on a lower surface. The ring gear would include teeth in meshing engagement with the drive gear 104 so that rotation of the drive gear 104 causes rotation of the ring gear and thus the retention member. The cartridge would rest on the planar section and be held against rotation by the anti-rotation tabs. As such, the stepped section, cylindrical wall section and rim are not present on the retention member.

The cartridge 94 shown in FIGS. 7 and 8 is a unique cartridge provided with flanges. Generally, cartridges used in existing diaper pails and waste disposal devices of a similar type do not include any flanges. Nevertheless, it is contemplated that such conventional cartridges could be used in this embodiment by providing an adapter to mate with the conventional cartridge and provide the necessary flanges to mate with the anti-rotation tabs 106. For example, the adapter could be a circular ring with opposed flanges whereby the cartridge is inserted into the adapter and fits snugly together.

Figure 10:
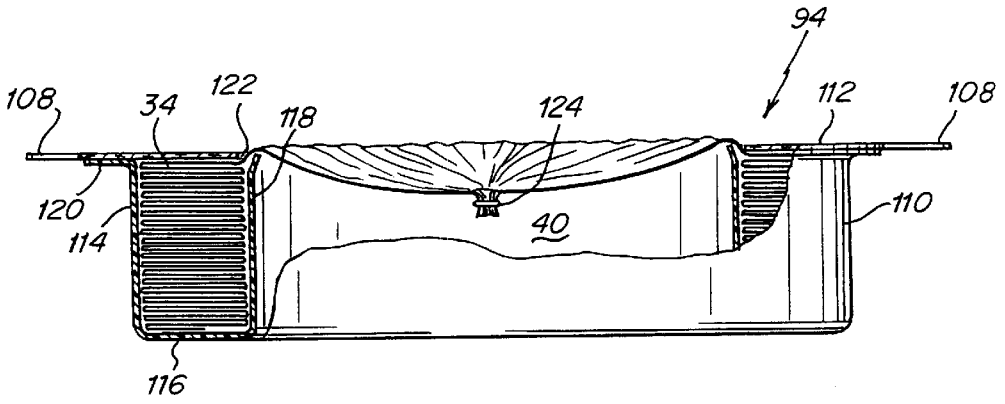
FIG. 10 is a side elevation, partly in section, of a cartridge of flexible tubing for use in the invention.
Figure 11:
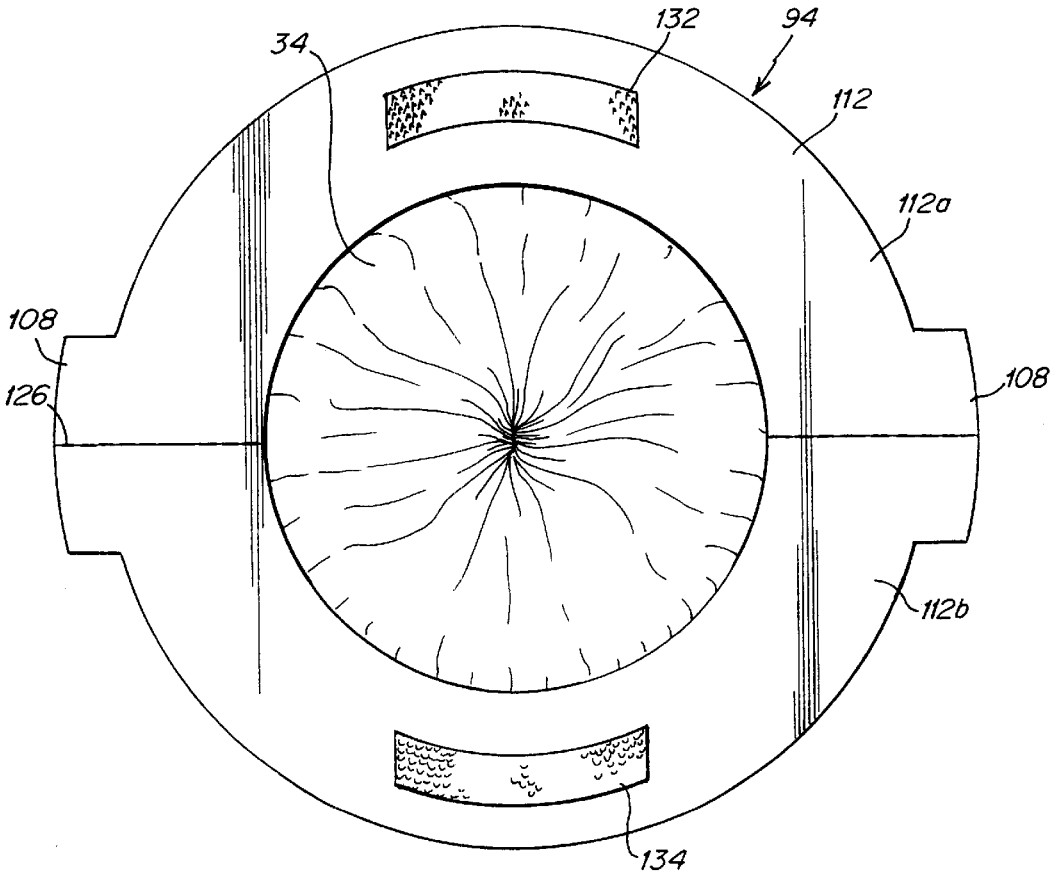
FIG. 11 is a top view of the cartridge shown in FIG. 10.
Figure 12:
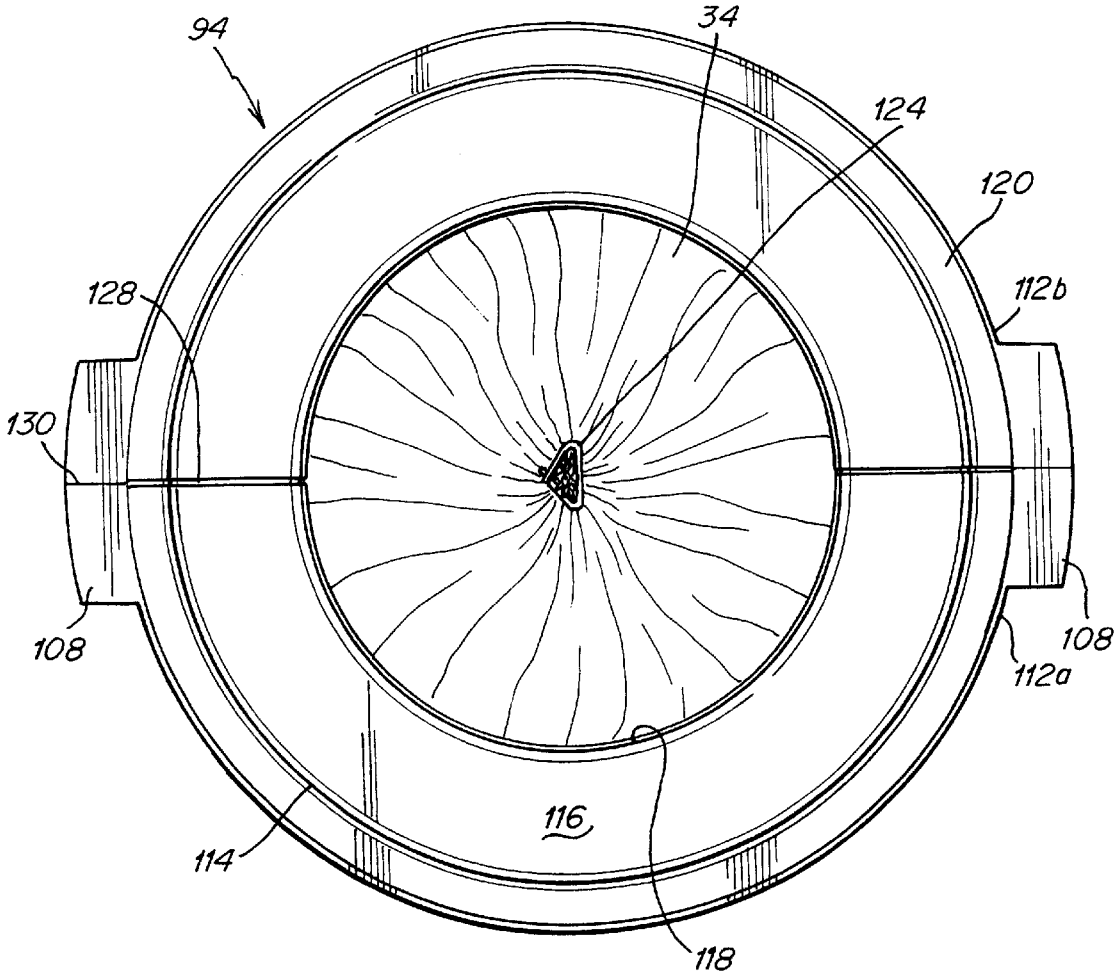
FIG. 12 is a bottom view of the cartridge shown in FIG. 10.

Details of the cartridge 94 designed for use in the embodiment of FIGS. 7–9, as well as other embodiments described herein, are shown in greater detail in FIGS. 10–12. The cartridge 94 includes a casing 110 defining a cavity in which the tubing 34 is placed and an annular cover 112 connected to the casing 110 and enclosing the tubing 34 in the cavity. Casing 110 includes a cylindrical outer wall 114, an annular lower wall 116, a cylindrical inner wall 118 and a flange 120 extending outward from the upper edge of the outer wall 114. The flange 120 serves to enable attachment of the casing 110 and cover 112 to one another, e.g., by adhesive. A ring-shaped opening 122 is defined between an inner edge of the cover 112 and inner wall 118 for passage of the tubing 34. Inner wall 118 includes, or may be provided with, an annular flange or lip over which the tubing 34 passes into a waste insertion chamber 40 defined in part by the inner wall 118.

Cover 112 includes two tabs 108 on opposite sides. Tabs 108 are designed to fit between the anti-rotation tabs 106 formed in connection with the container 82 (see FIG. 7). By positioning the tabs 108 on the cartridge 94 between the anti-rotation tabs 106 of the container 82, rotation of the cartridge 94 upon rotation of the retention member 92 is prevented even though the cartridge 94 rests on the retention member 92. Instead of the placement of tabs on both the cartridge 94 and the container 82, other mechanisms for preventing rotation of the cartridge 94 relative to the retention member 92 can be applied in the invention.

The cartridge 94 can be designed for multiple uses, i.e., to enable insertion of a new pack of tubing 34 when the tubing 34 in the cartridge 94 is exhausted (instead of folding the cartridge 94 over on itself and pushing the cartridge 94 into the waste-receiving chamber 12*a*). In this case, the cover 112 is removably attached to the casing 110, using Velcro™ for example, and additional packs of tubing 34 provided. The additional packs of tubing 34 can be held together by appropriate means known in the art. When the tubing in the cartridge 94 is exhausted, the end of the tubing 34 is tied together and pushed into the waste-receiving chamber of the container 12. The cover 112 is separated from the casing 110 and a new pack of tubing 34 is inserted into the casing 110. The cover 112 is re-attached to the casing 110 and the cartridge 94 is prepared for use.

Casing 110 is typically made of a plastic material and cover 112 is typically made of a fibrous material such as cardboard. The use of these materials is not intended to limit the invention.

The cartridge 94 may also be designed to eliminate the need to tie the tubing 34, both at the beginning of use of the cartridge 94 and when the tubing 34 is used up and/or the hamper 88 is full. The rear end of the tubing 34 is usually fixed to the cartridge 94 to maintain the tubing 34 in connection with the cartridge 94.

With respect to eliminating the need to tie the tubing at the beginning of use of the cartridge 94, the cartridge 94 is constructed with the front end of tubing 34 closed, for example, by using a metal clip or clasp 124 as shown in FIGS. 10 and 12. The clasp 124 is secured to the front end of the tubing 34 during manufacture of the cartridge 94 so that the cartridge 94 is ready for use immediately upon purchase without requiring removal of a length of tubing and tying of the end of the removed length of tubing (as in conventional diaper pails of the "Diaper Genie"™ type described above).

Other mechanisms for closing the front end of the tubing 34 during manufacture of the cartridge 94 can be used in the invention instead of the metal clasp 124. For example, the end of the tubing 34 could be closed by heat-sealing (as shown in FIG. 13D), formed with a closed end, or sewn closed.

With respect to eliminating the need to tie the tubing when the length of available tubing is exhausted and/or the pail is full, the cartridge 94 is provided with a closure mechanism which is effective to close and seal the rear end of tubing 34 without requiring tying of the tubing 34. In the illustrated embodiment, the closure mechanism involves a particular construction of the cartridge 94 with weakened regions, both on the casing 110 and the cover 112, to allow for folding of a part of the cartridge 94 onto itself.

More specifically, the cover 112 is provided with score lines 126, which separate approximately equal parts 112*a*, 112*b* of the cover 112 and enable the cover 112 to be folded about the score lines 126, and with a mechanism to attach the folded parts 112*a*,112*b* of the cover 112 together (FIG. 11). Instead of score lines 126 on the cover 112, other types of constructions creating a weakened portion on the cover 112 can also be provided, for example, providing a reduced thickness along a fold line. The casing 110 is provided with slits 128 extending through the outer wall 114, lower wall 116 and inner wall 118 and with aligning weakened sections 130 in the flange 120 (FIG. 12). Slits 128 and weakened sections 130 are substantially in alignment with the score lines 126 in the cover 112. As the cover 112 is folded about the score lines 126, the casing 110 is folded about the weakened sections 130, with the slits 128 serving to allow for such folding. Depending on the thickness and composition of the weakened sections 130, the casing 110 may be actually be broken as the cartridge 94 is folded. Further, instead of slits 128, the casing 110 can be made of a material which is easily broken and score lines or slots provided to enable breaking of the casing along the score lines or slots upon folding of the cartridge 94.

The mechanism on the cover 112 which will attach the parts 112*a*, 112*b* of the cover 112 together may be of the Velcro® type whereby part 112*a* includes a section of hook fasteners 132 and part 112*b* includes a section of loop fasteners 134 positioned to mate with the hook fastener section 132 when the cover 112 is folded about the score lines 126. The size and shape of the hook and loop fastener sections 132,134 can be varied and adjusted with a view toward obtaining a sufficiently secure bond between the parts 112*a*,112*b* of the cover 112 when the cover 112 is folded about the score lines 126.

An alternative mechanism would be to arrange a strip of adhesive on one part 112*a* with a covering pad so that removal of the covering pad would expose the adhesive which would then be folded to engage the opposite part 112*b*.

Figure 13B:
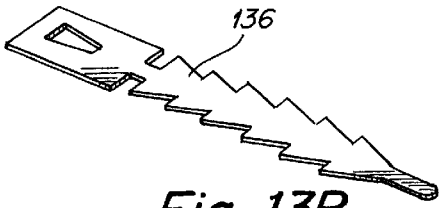
FIG. 13B is a perspective view of a tie upon removal from the cover of the cartridge shown in FIG. 13A.
Figure 13A:
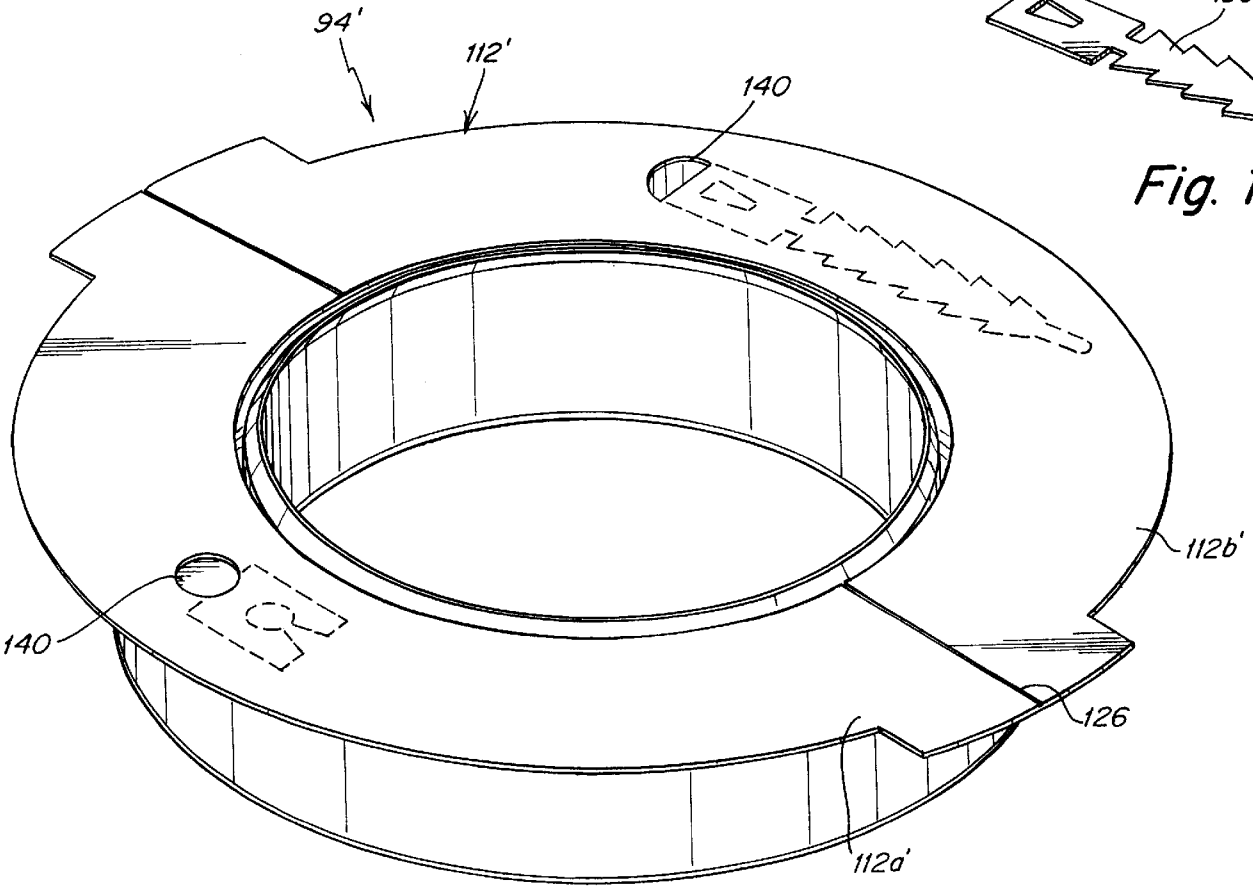
FIG. 13A is a perspective view of another embodiment of a cartridge of flexible tubing for use in the invention.
Figure 13C:
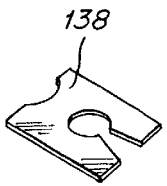
FIG. 13C is a perspective view of a clasp upon removal from the cover of the cartridge shown in FIG. 13A.
Figure 13D:
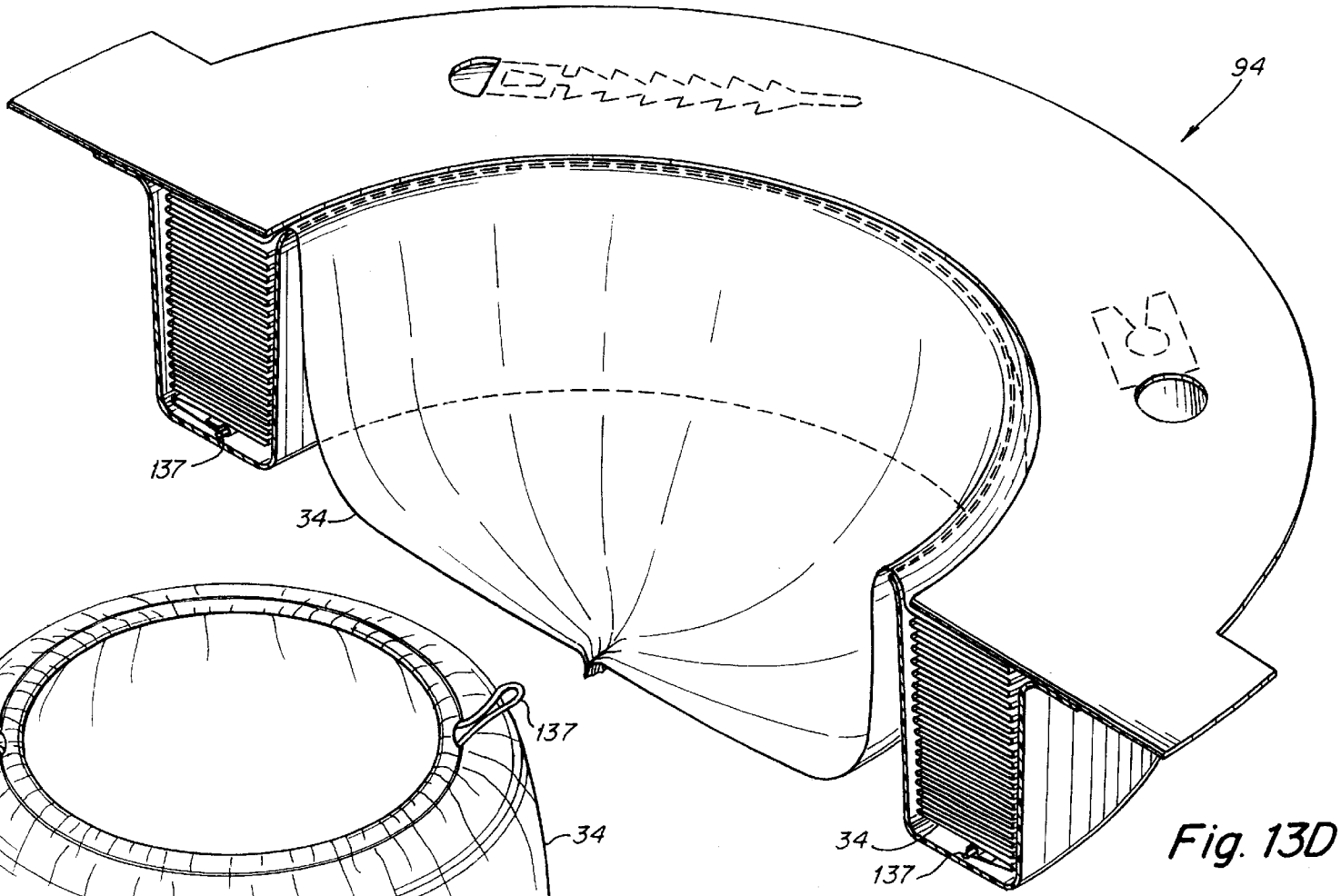
FIG. 13D is a perspective, cross-sectional view of another embodiment of a cartridge of flexible tubing for use in the invention.

Another alternative mechanism is shown in FIGS. 13A–13C and comprises a tie 136 and a clasp 138 stamped or otherwise integrated into the cover 112'. Cover 112' also includes an aperture 140 on each part 112*a*',112*b*' which align when the cover 112' is folded. When the tubing in the cartridge 94' is exhausted, the tie 136 and clasp 138 are removed from the cover 112', the cover 112' is folded about the score lines 126 and the tie 136 is inserted through the aligning apertures 140 and the clasp 138 is then attached to the tie 136 to thereby securely keep the cover 112' in a folded state.

Figure 13E:
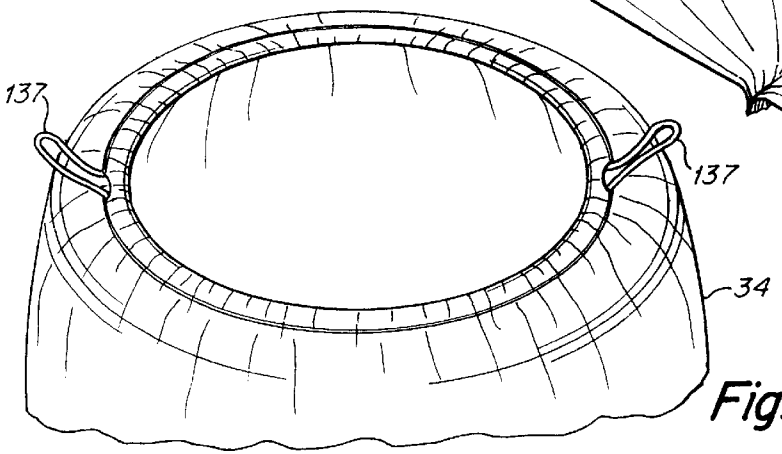
FIG. 13E is a perspective view of the end of the tubing of the cartridge shown in FIG. 13D after removal from the cartridge.

FIGS. 13D and 13E show a mechanism which eliminates the need to attach the parts of the cover 112 to one another in order to seal and close the tubing 34. In this embodiment, a drawstring 137 is inserted into a channel formed at the rear edge of the tubing 34. When the tubing 34 is used up, the drawstring 137 is pulled from the cartridge 94 and the exposed loops can be pulled to close the end of the tubing 34.

Once the cartridge 94,94' is folded to close and seal the rear end of the tubing 34, it can be pushed into the hamper 88 through the retention member 92 and the lid 22 may then be raised to enable placement of a new cartridge 94,94' into the container 82. The hamper 88 is emptied when full. The length of tubing 34 in the cartridge 94,94' can be selected so that the hamper 88 is full when the tubing 34 is exhausted. In this case, emptying of the hamper 88 and replacement of the cartridge 94,94' would occur simultaneously.

The cartridges 94,94' described above can be used as a substitute for the cartridges in any diaper or waste pail using a continuous length of flexible tubing, including those of the Diaper Genie® type and those described herein.

The immediately foregoing embodiment provided for the rotation of the retention member upon closing of the lid via a movement conversion mechanism. In other embodiments, the retention member can be rotated by depressing a pushbutton or a foot pedal.

Figure 14:
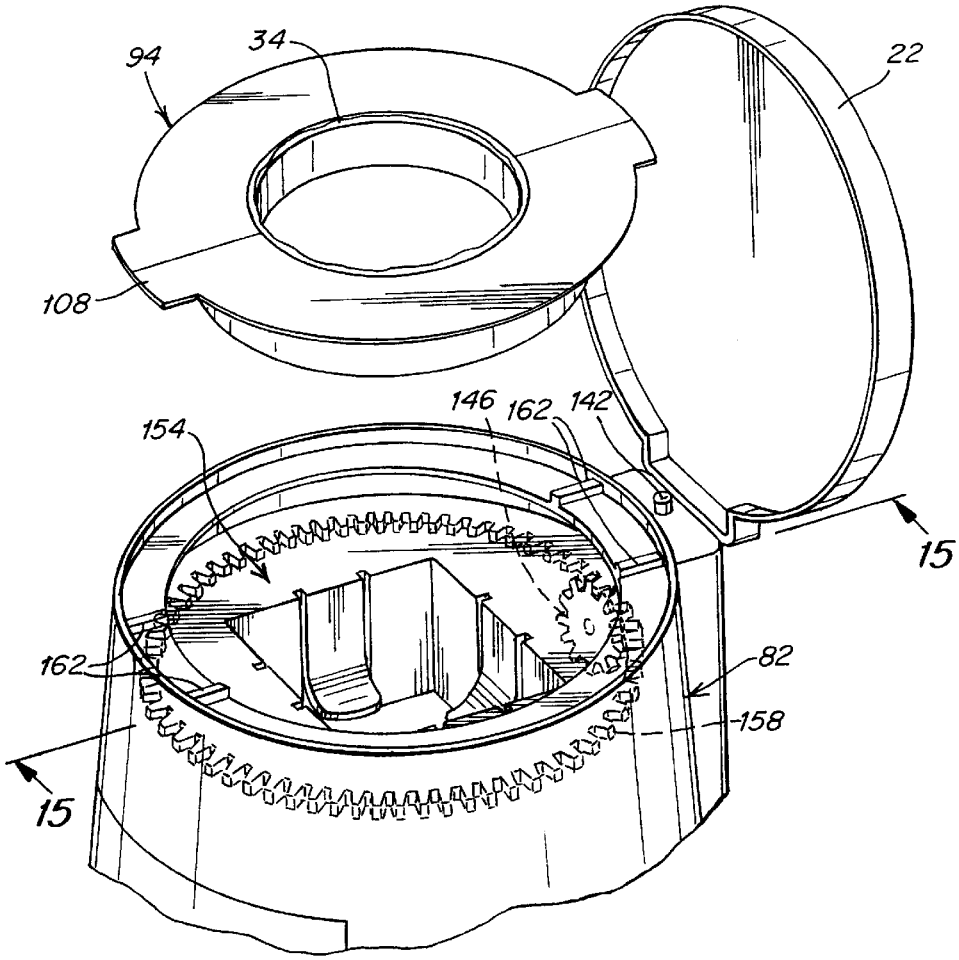
FIG. 14 is an exploded, partial view of another embodiment of a waste disposal device in accordance with the invention wherein waste packages are rotated relative to the cartridge.
Figure 15:
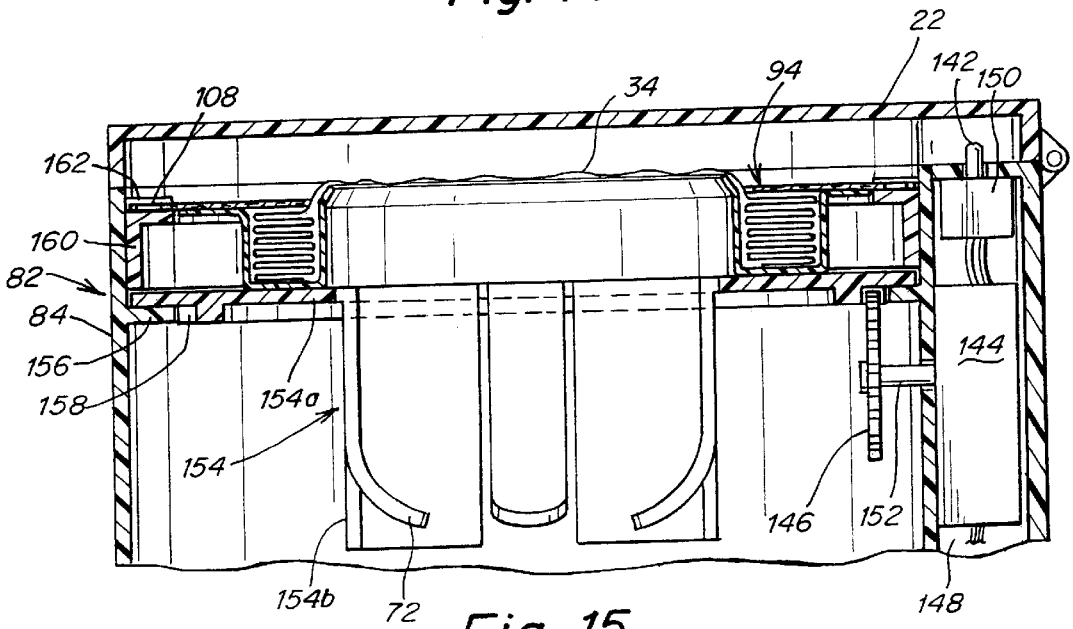
FIG. 15 is a sectional view taken along the line 15—15 of FIG. 14.
Figure 16:
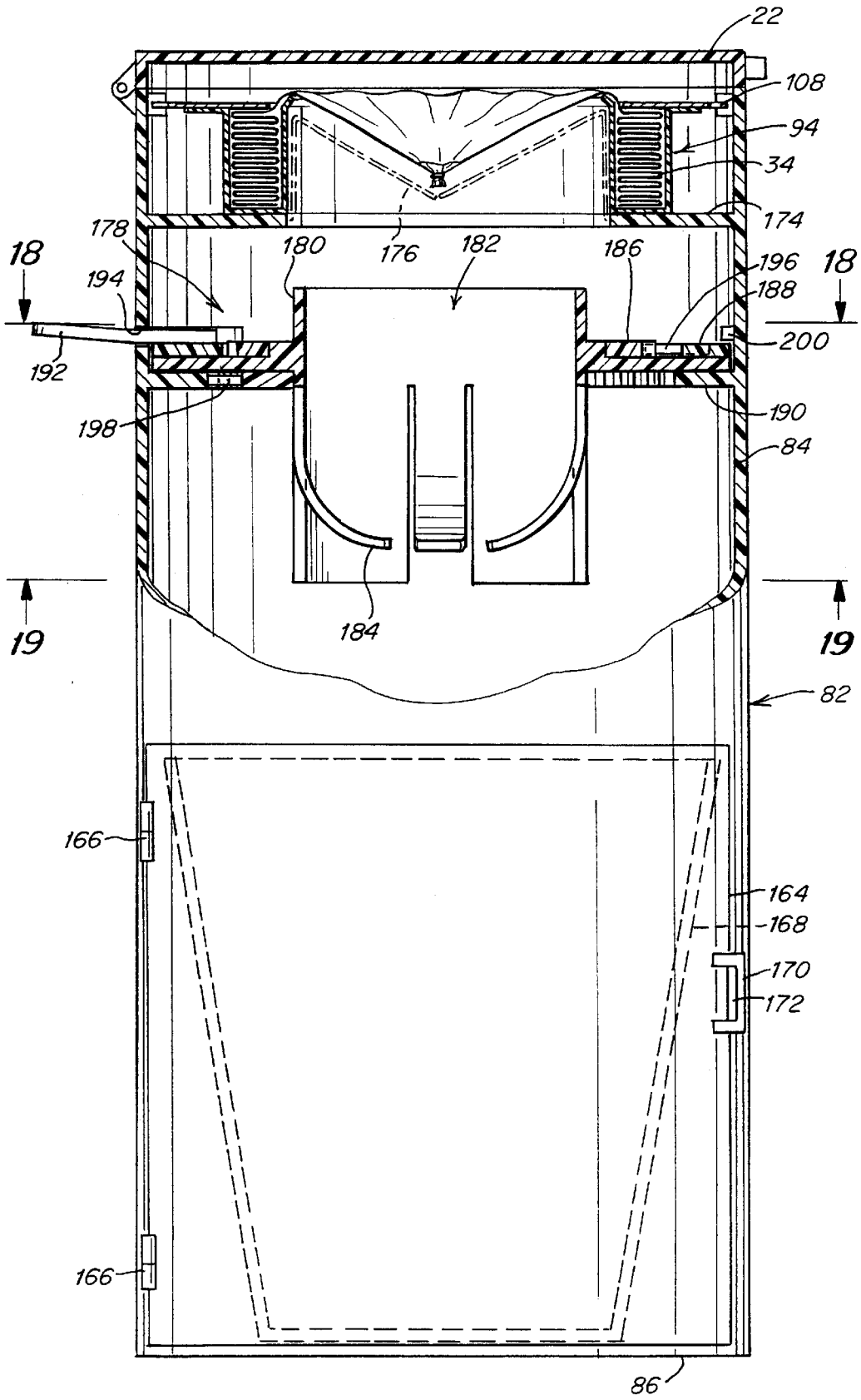
FIG. 16 is a side elevation, partly in section, of another embodiment of the invention wherein waste packages are rotated relative to the cartridge.

For example, in the embodiment shown in FIGS. 14 and 15, the rotation mechanism 96 comprises a pushbutton 142, a motor 144 coupled to the pushbutton 142 and actuated by depression of the pushbutton 142 and a drive gear 146 actuated by the motor 144. A part of the pushbutton 142 and the motor 144 are housed in a compartment 148 formed in a rear of the container 82 with the pushbutton 142 extending through an aperture formed in the upper wall of the rear compartment 148. A shaft of the motor 144 extends through an aperture in the rear wall of the waste receiving chamber in the container 82. The location of the pushbutton 142, and motor 144, are not limited to that shown in the illustrated embodiment and may be placed at other locations in the container 82. For example, the pushbutton 142 can be placed along the side of the container 82 or in the lid 22 while the motor 144 can be placed at the bottom of the container 82 and an appropriate gear transmission mechanism provided to transfer the rotation force from the shaft of the motor 144 to the drive gear 146. Also, it is contemplated that the pushbutton can be replaced by a foot pedal.

A timer 150 is optionally coupled to the pushbutton 142 to enable a delay between the depression of the pushbutton 142 and the actuation of the motor 144.

When actuated, the motor 144 rotates a shaft 152 attached to the drive gear 146 so that the drive gear 146 is rotated. A power mechanism (not shown) is provided to supply power to the motor 144, for example, either a battery housing in an accessible compartment in the container 82 or a cord extending from the motor through the rear compartment 148 to the exterior of the container 82 for insertion into a power outlet.

The retention member 154 is seated on a flange 156 formed integral with the container 82. Retention member 154 has a planar section 154*a* from which springs 72 and vertical walls 154*b* descend, the vertical walls 154*b* defining an enclosure in which the springs 72 retain the waste package. A ring gear 158 is formed on a lower surface of the planar section 154*a* and includes teeth in meshing engagement with the drive gear 146. An alternative retention member can be formed with teeth on an outer peripheral edge, in the form of a ring gear surrounding the planar portion 154*a*. This ring gear would be supported on the flange 156 which would include an opening to enable the ring gear to engage with the drive gear 146.

An insert 160 is arranged above the retention member 154 to hold the retention member 154 in position and provide a support for the flanges 108 of the cartridge 94. Cartridge 94 also rests on the planar portion 154*a* of the retention member 154. The insert 160 includes anti-rotation tabs or ears 162 to prevent rotation of the cartridge 94 upon rotation of the retention member 154. The insert 160 may be snap fit to the inner wall of the container 82.

In use, a waste package is inserted until it is held by the springs 72 of the retention member 154, and then depression of the pushbutton 142 causes the motor 144 to rotate the shaft and drive gear 146 which in turn causes rotation of the ring gear 158 and thus the entire retention member 154. Rotation of the cartridge 94 is prevented by the anti-rotation tabs 162 so that it is held stationary. Rotation of the retention member 154 holding the waste package relative to the cartridge 94 causes the formation of a twist of the tubing 34 above the waste package and thus encapsulation of the waste package. An advantage of this embodiment is that the waste package can be encapsulated independent of the movement of the lid 22.

Another embodiment of a waste disposal device wherein the waste packages are rotated relative to the cartridge is shown in FIGS. 16–19. In this embodiment, the retention member is manually rotated.

Initially, instead of a hamper 88, a removable pail is used in this embodiment. The removable pail and the necessary structure to enable its use can be incorporated into any of the other embodiments described herein. Specifically, to enable use of the pail, an access door 164 is formed in the outer wall 84 and pivots about hinges 166 to enable selective access to a pail 168 resting on the base 86 in the interior of the container 82. The size of the pail 168 is such so as to enable its removal from and re-insertion into the container 82 through the access door 164. A closure mechanism is provided to secure the access door 164 in a closed position. The closure mechanism includes a U-shaped latch 170 arranged on the access door 164 and a projection 172 arranged on the outer surface of the outer wall 84 whereby the latch 170 is designed to overlie the projection 172 and thereby secure the access door 164 in its closed position. Other closure mechanisms can be used in the invention.

An annular flange 174 is located inside the container 82 along the inner surface of the outer wall 84. Flange 174 can conform to the cross-sectional shape of the outer wall 84, which may be cylindrical or otherwise. A removable cartridge 94 is supported by or rests on the flange 174 and contains a circumferentially pleated length of flexible tubing 34. The cartridge 94 is maintained in a stationary position relative to the flange 174, for example, by providing anti-rotation tabs on the container (not shown) to accommodate the flanges 108 of the cartridge 94.

Optionally, a funnel in the form of a flexible, resilient membrane 176 is connected to or constructed together with the flange 174 to support the tubing 34. Membrane 176 also prevents odors from escaping from the container 82. Such a membrane can also be incorporated into the other embodiments disclosed herein, either formed in connection with the cartridge on the structure on which the cartridge is seated.

In this embodiment, the rotation mechanism is integral with the retention mechanism. The rotation and retention mechanism 178 thus grasps waste packages and enables uni-directional rotation of the grasped waste packages relative to the cartridge 94 so as to form a twist in the tubing 34 above a waste package 74 which thereby causes encapsulation of the waste package 74. The cartridge 94 is maintained in a stationary position while the waste package is rotated.

Figure 18:
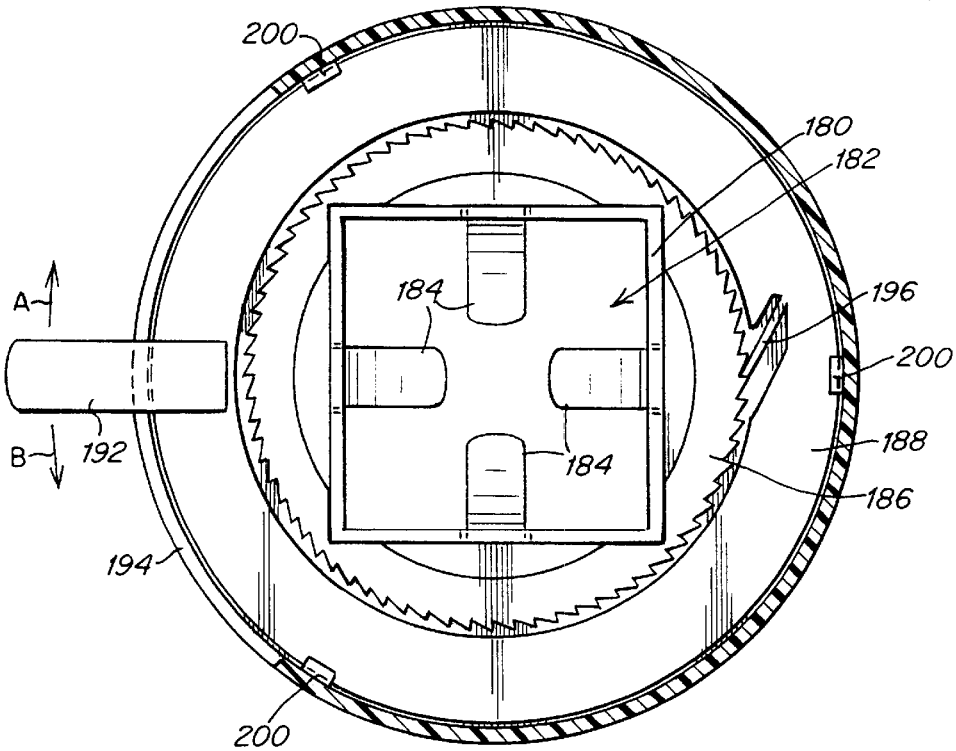
FIG. 18 is a top view of the rotation mechanism in the embodiment shown in FIG. 16.
Figure 19:
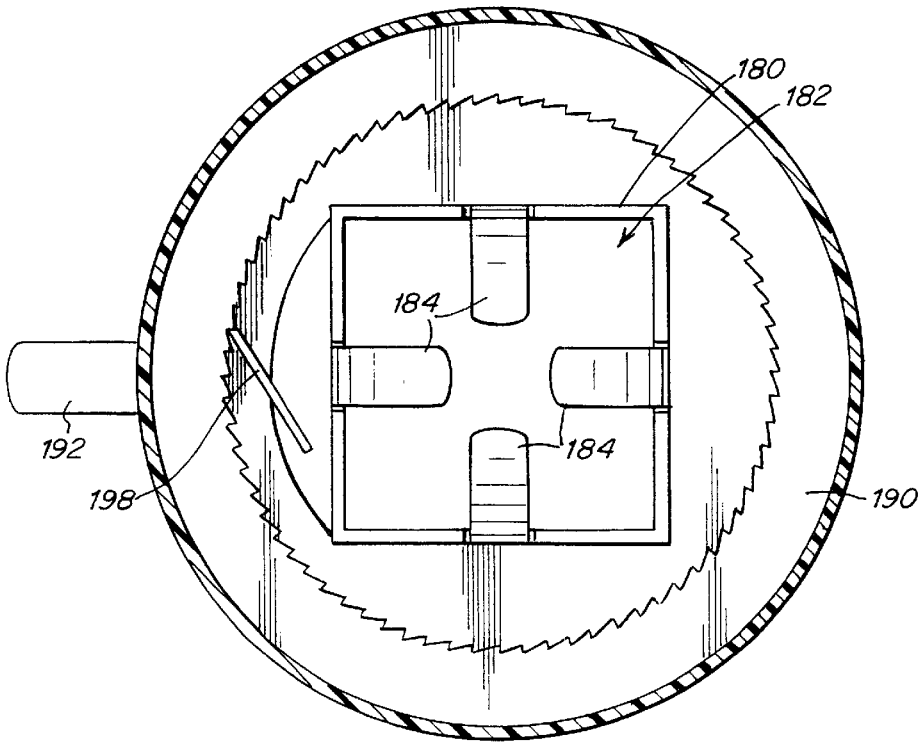
FIG. 19 is a bottom view of the rotation mechanism in the embodiment shown in FIG. 16.

The rotation and retention mechanism 178 comprises a vertically oriented frame 180 including walls defining a waste passage 182, resilient members or tongues 184 connected to the frame 180 and extending inward into the waste passage 182, an inner ring 186 connected to the frame 180, a first, movable outer ring 188 surrounding the inner ring 186, a second, stationary outer ring 190 connected to the outer wall 84 of the container 82 and a handle 192 connected to the first outer ring 188 (see FIGS. 18 and 19). The shape, number and form of the tongues 184 is not limiting and other resilient retaining members can be used in the invention. Handle 192 passes through a slot 194 in the outer wall 84 and waste passage 182 aligns with the waste insertion opening defined by the cartridge 94.

To provide for movement of the inner ring 186 and thus rotation of the frame 180 upon turning of the handle 192, the outer surface of the inner ring 186 includes grooves and a pin 196 is arranged in connection with the first outer ring 188 (FIG. 18). The grooves on the inner ring 186 are formed so that the pin 196 engages and is maintained in engagement with a single groove during turning of the handle 192 in one direction and slides over grooves during turning of the handle 192 in the opposite direction.

When the handle 192 is turned in the direction of arrow A, the first outer ring 142 and connected pin 196 rotate in the same direction causing rotation of the inner ring 186 and thus the frame 180 connected thereto. On the other hand, when the handle is turned in the direction of arrow B, the first outer ring 188 and connected pin 196 rotate in the same direction but the pin 196 slides over the angled surfaces of the grooves and does not frictionally engage therewith. In this case, the frame 180 is further prevented from rotating along with the first outer ring 188 by a pin 198 arranged in connection with the inner ring 186 and engaging with grooves on the second outer ring 190 (FIG. 19). The grooves on the second outer ring 190 are formed so that pin 198 slides over angled surfaces of the grooves during movement of the frame 180 in the direction of arrow A. The frame 180 is thus not moved during turning of the handle 192 in the direction of arrow B.

One or more stops 200 are formed on the inner surface of the outer wall 84 of the container 82 above the rotation and retention mechanism 178 to prevent upward movement of the rotation and retention mechanism 178.

Other arrangements for providing rotation of the frame 180 upon turning of the handle 192 in only a single direction can also be used in the invention.

To prepare the waste disposal device for use, the lid 22 is opened and a cartridge 94 is placed onto the flange 174. In use, the lid 22 is opened to expose the waste insertion opening 20. A waste package 74 such as a soiled diaper is placed into the bag formed by flexible tubing 34 preferably so that the bag is held against the resilient tongues 184.

Figure 17:
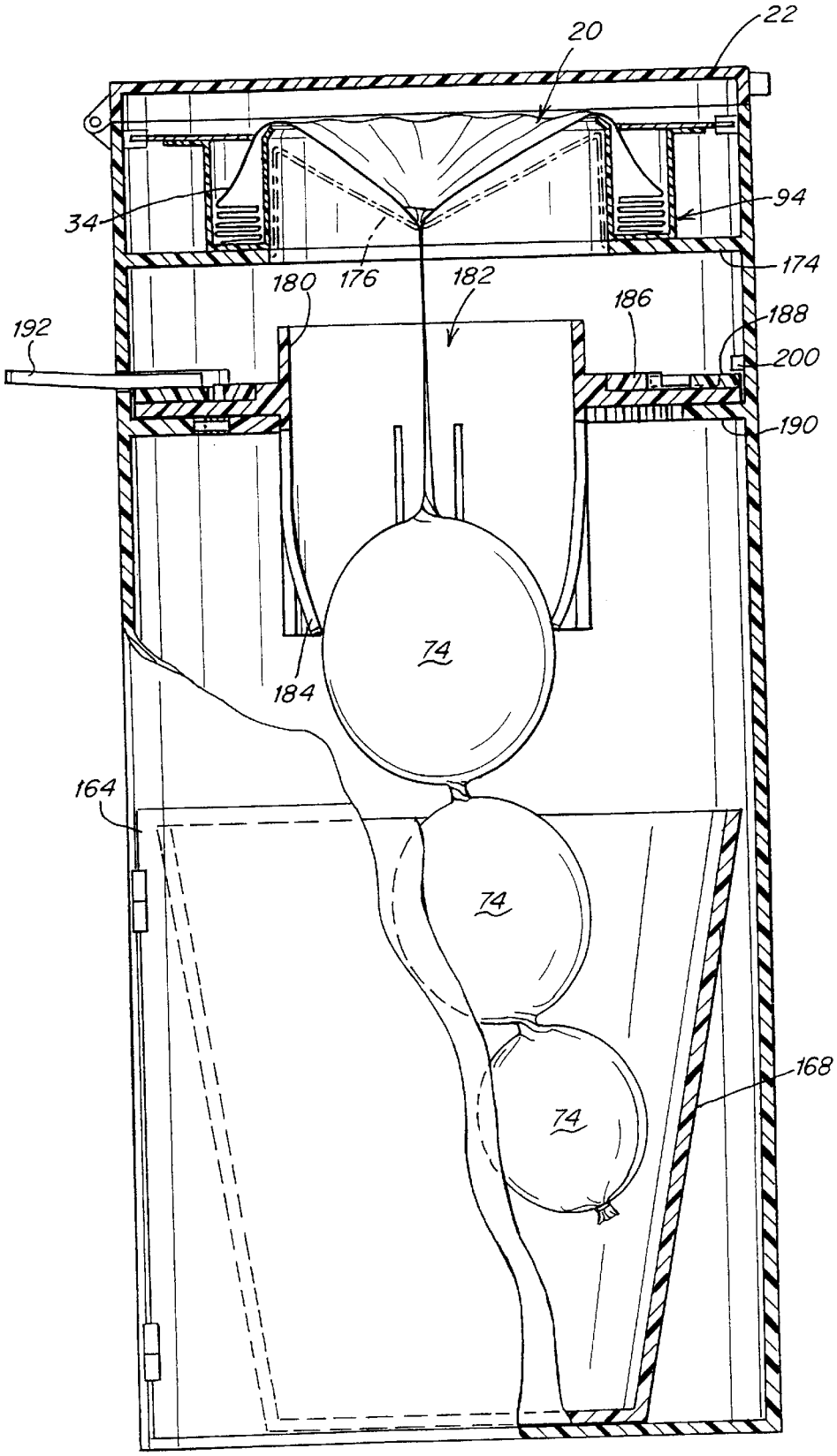
FIG. 17 is a side elevation, party in section, of the embodiment of FIG. 16 shown during use.

The handle 192, which is preferably maintained at one end of the slot 194, is grasped and moved in the slot 194 to cause the frame 180 to turn relative to the cartridge 94, which is held stationary, so that a twist forms above the waste package 74 and encapsulates the waste package 74 (see FIG. 17). Handle 192 can be repeatedly moved back and forth in the slot 194 until an adequate twist is formed above the waste package. As noted above, the frame 180 will move during movement of the handle 192 in only one direction and not in a reverse direction (so as not to undo the twist).

Successive waste packages 74 are inserted into the waste insertion opening 20, and so long as that waste package or a preceding waste package is grasped by the resilient members 184, movement of the handle 192 will cause formation of a twist above that waste package. This procedure continues until the length of available tubing 34 is exhausted or the pail 168 is full. At this time, the lid 22 is opened and the cartridge 94 is closed by folding the cartridge 94 onto itself and connecting the hook and loop fastener sections 132,134. The cartridge 94 may be pushed through the flange 174 and the frame 180 into the pail 168.

Among the advantages provided by the waste disposal device are the use of a cartridge which does not require tying of either the front or rear end of the tubing and the presence of a pail, or other comparable removable receptacle, into which the encapsulated waste packages fall so as to provide for easy removal of the series of encapsulated waste packages.

The rotation mechanism described above can also be used as a substitute for the rotation mechanism in diaper and waste pails in which flexible tubing is twisted, including those of the Diaper Genie® type.

Another embodiment of a waste disposal device wherein the waste packages are rotated relative to the cartridge is shown in FIGS. 20–27. In this embodiment, the waste packages are encapsulated by an encapsulation device 202 and compacted by a compacting mechanism 204.

The encapsulation device 202 grasps waste packages and enables unidirectional rotation of the grasped waste packages relative to the cartridge 94 so as to form a twist in the tubing 34 above a waste package which thereby causes encapsulation of the waste package. The encapsulation device 202 generally comprises a retention unit 206 which engages and temporarily holds a waste package and a rotation mechanism 208 for rotating the retention unit 206.

Figure 25:
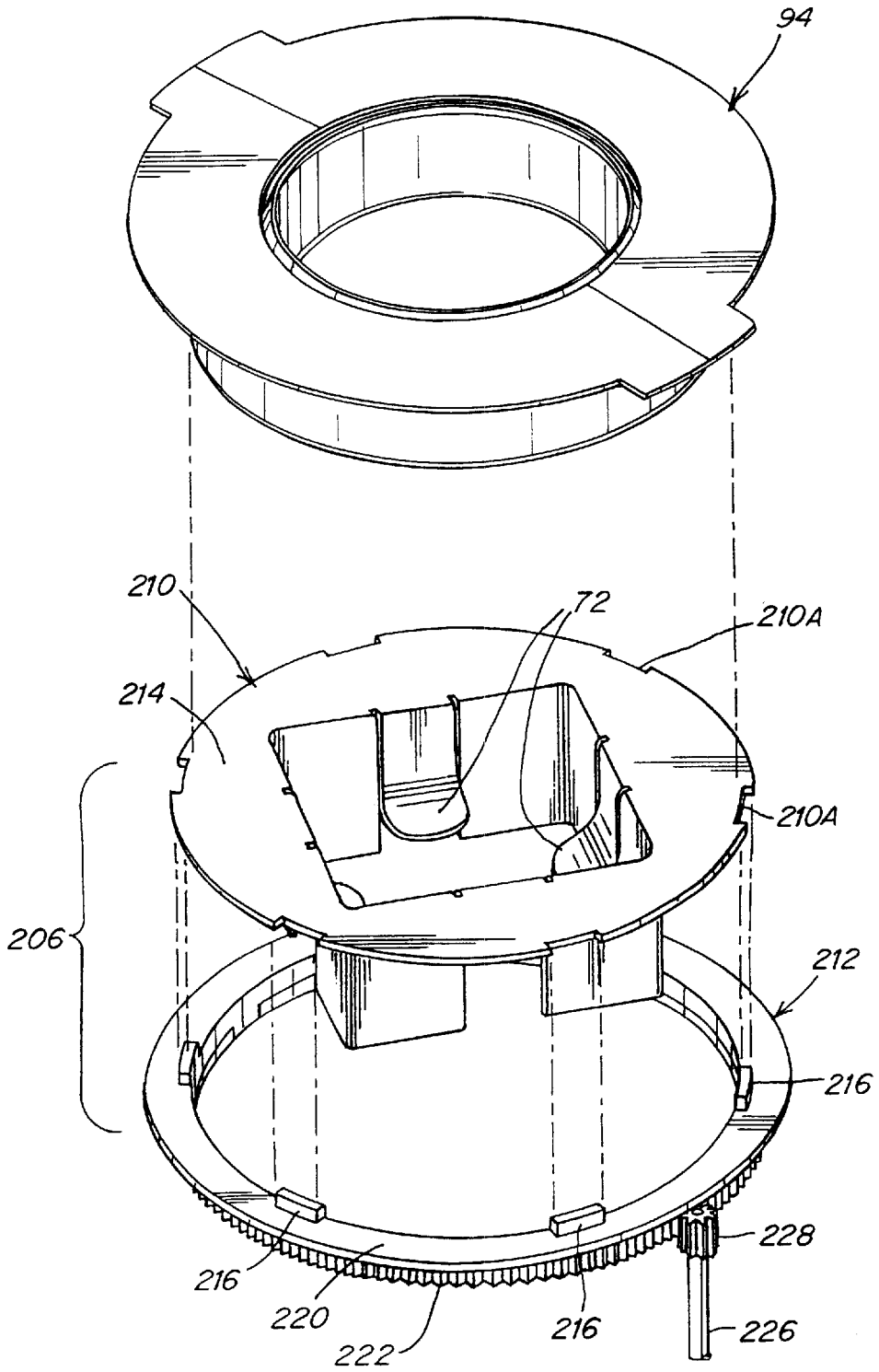
FIG. 25 is an exploded view of the retention mechanism and a cartridge of the waste disposal device shown in FIG. 20.

Retention unit 206 comprises a vertically oriented frame 210 and an annular gear ring 212. The frame 210 includes walls defining a passage through which the waste article surrounded by a section of the tubing 34 passes, resilient members or tongues 72 extending inward into the waste passage, and a support flange 214 on which the cartridge 94 rests (FIG. 25). The waste passage generally aligns with the waste insertion chamber defined by the cartridge 94. The shape, number and form of the tongues 72 is not limiting and other resilient retaining members can be used in the invention. The frame 210, tongues 72 and support flange 214 may be formed from a single piece of molded plastic.

Annular gear ring 212 may be a separate component from the frame 210 and if so, a cooperating attachment mechanism is provided to attach the frame 210 to the gear ring 212. The cooperating attachment mechanism comprises a plurality of projections 216 formed on the upper surface of the gear ring 212 and notches 210A formed on the outer surface of the frame 210. As such, rotation of the gear ring 212 will cause rotation of the frame 210. In the alternative, the frame 210 and gear ring 212 could be formed as an integral component.

Optionally, a funnel in the form of a flexible, resilient membrane (not shown) may be connected to or constructed together with the support flange 214 to support the tubing 34. The membrane would also prevent odors from escaping from the container.

Figure 26:
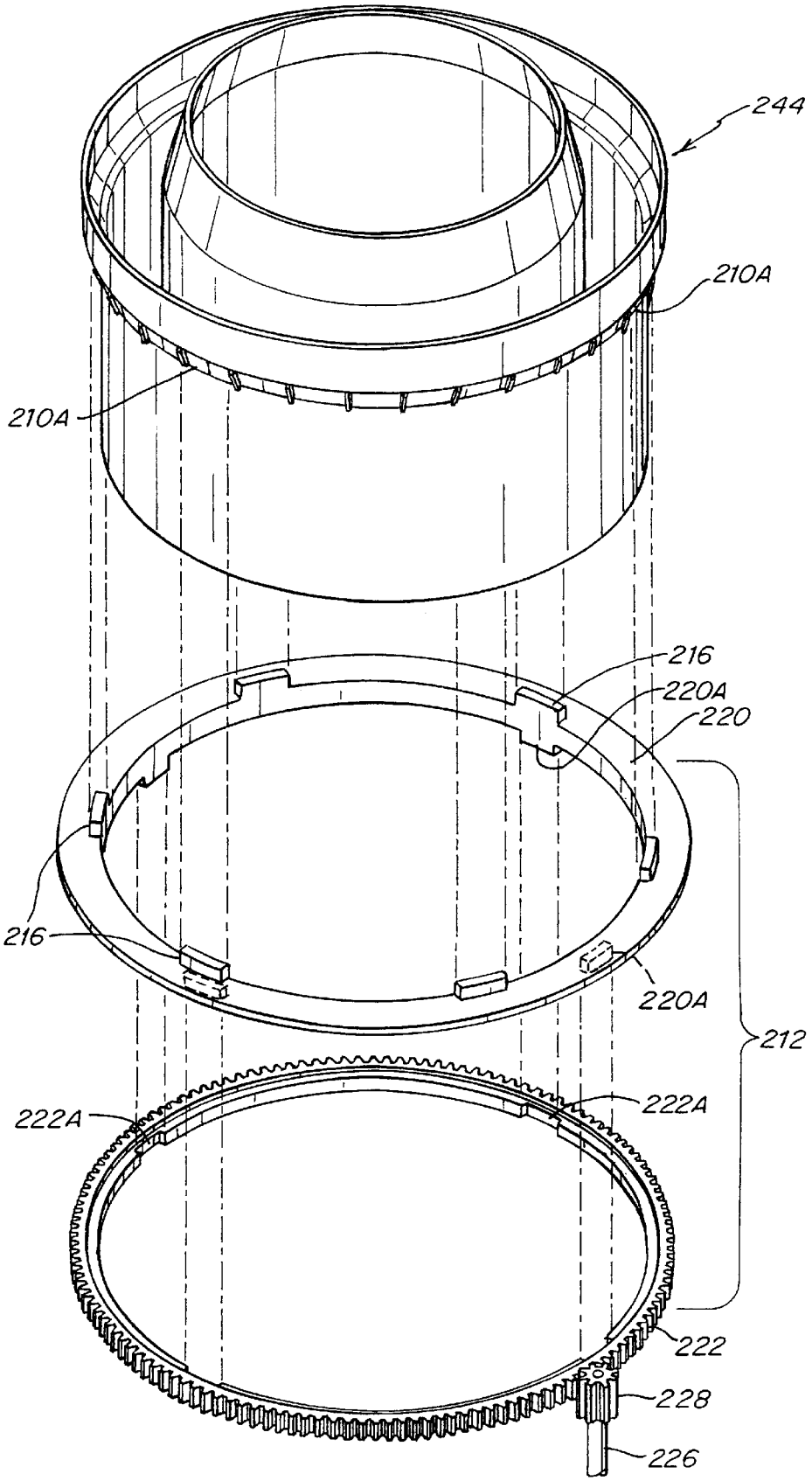
FIG. 26 is an exploded view of another retention mechanism cartridge of the waste disposal device shown in FIG. 20.
Figure 27:
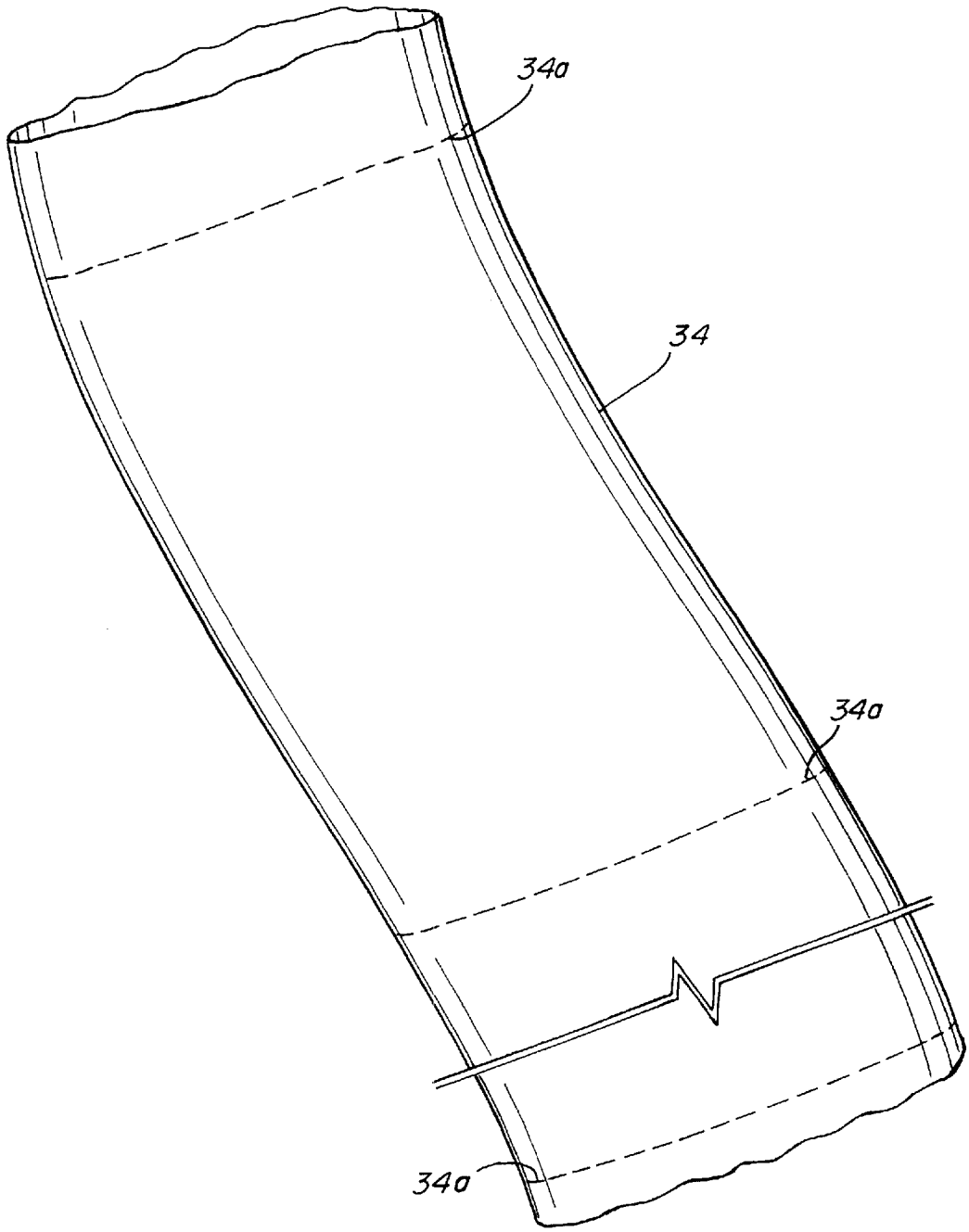
FIG. 27 shows a section of flexible tubing with perforations to facilitate tearing off.

The gear ring 212 includes an annular slot between an upper circular rim 220 and a lower circular gear rim 222 whereby a flange 242 formed on the container is inserted into the slot 218 to retain the gear ring 212 in connection with the container 82 while permitting rotation of the gear ring 212 relative to the container 82. Gear rim 222 includes a series of teeth. As shown in FIG. 26, the upper rim 220 and the gear rim 222 can be formed as separate components and provided with appropriate attachment mechanisms, for example, projections 220A on the lower surface of the upper rim 220 and notches 222A on the inner surface of the gear rim 222. The gear rim 222 can thus be used with different cartridges by providing different upper rims 220, each adapted to mate with a particular cartridge. The only constant is the gear rim 222 which has to engage the gear 228 in order to provide for rotation of the cartridge (as in FIG. 26) or retention mechanism (as in FIG. 25). That is, by using the two-part gear rim 212, different frames 210 can be used with each frame having a mating upper rim 220 with the upper rims 220 all being matable to the common gear rim 222.

The rotation mechanism 208 can take a variety of different forms. The objective of the rotation mechanism 208 is to rotate the gear rim 222 of the gear ring 212 either upon direct manual activity (such as by depressing a foot pedal (FIG. 20), a pushbutton (FIGS. 21 and 22) or the like), upon indirect manual activity (such as by closing the lid 22) or automatically (such as by sensing insertion of a waste package or closure of the lid 22 and thus the need to encapsulate the waste package).

Figure 20:
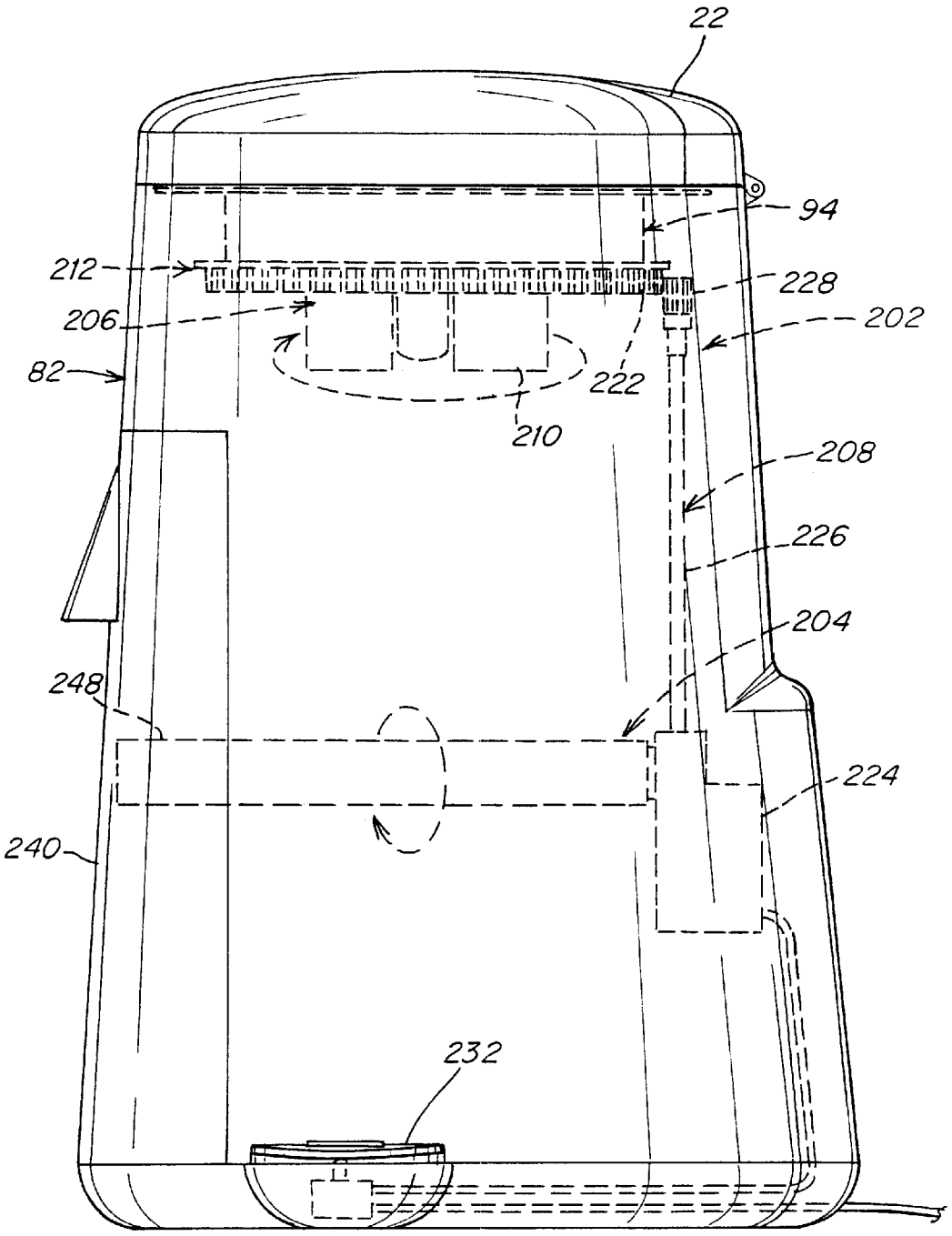
FIG. 20 is a side view of another embodiment of a waste disposal device in accordance with the invention wherein waste packages are rotated relative to the cartridge.

One embodiment of a rotation mechanism which is based on direct manual activity is shown in FIG. 20. The rotation mechanism 208 comprises a motor 224 which rotates a shaft 226 having a gear 228 at an upper end. Gear 228 is in meshed engagement with gear rim 222 so that rotation of the shaft 226 is translated into rotational movement of the retention unit 206. Gear 228 may be formed integral with the shaft 226. The gear rim 222 and gear 228 may be beveled, i.e., have their teeth inclined in relation to upper and/or lower planes. Also, it is possible to use other types of meshing gears and couplings in order to translate the rotational movement of the shaft 226 into rotational movement of the retention unit 206 via the coupling between the shaft 226 and the gear 228.

The motor 224, shaft 226 and gear 228 are arranged in the rear compartment 146 of the container 82. A slot 230 is formed at an upper end of a peripheral wall 146*a* defining the compartment 146 to enable the gear rim 222 to enter into the compartment 146 and engage the gear 228. In the alternative, it is possible to construct the wall 146*a* so that the gear 228 extends through the slot 230 and engagement between the gear rim 222 and gear 228 occurs outside of the compartment 146.

A motor actuation mechanism is arranged on the container to actuate the motor 224. One embodiment of a motor actuation mechanism is shown in FIG. 20 and comprises a foot pedal 232 electrically coupled to the motor 224 (the electrical connections between an external power source, the foot pedal 232 and the motor 224 being represented by dotted lines) so that depression of the foot pedal 232 causes actuation of the motor 224 and attendant rotation of the retention unit 206 and the formation of a twist above a waste package being grasped by the retention unit 206 so as to encapsulate the waste package. Instead of an external power source, an internal power source, e.g., a battery 224A, can be positioned in the compartment 146 to provide power to actuate the motor 224 (see FIG. 22). In this case, compartment 146 is made accessible by providing an access door 82A.

Figure 21:
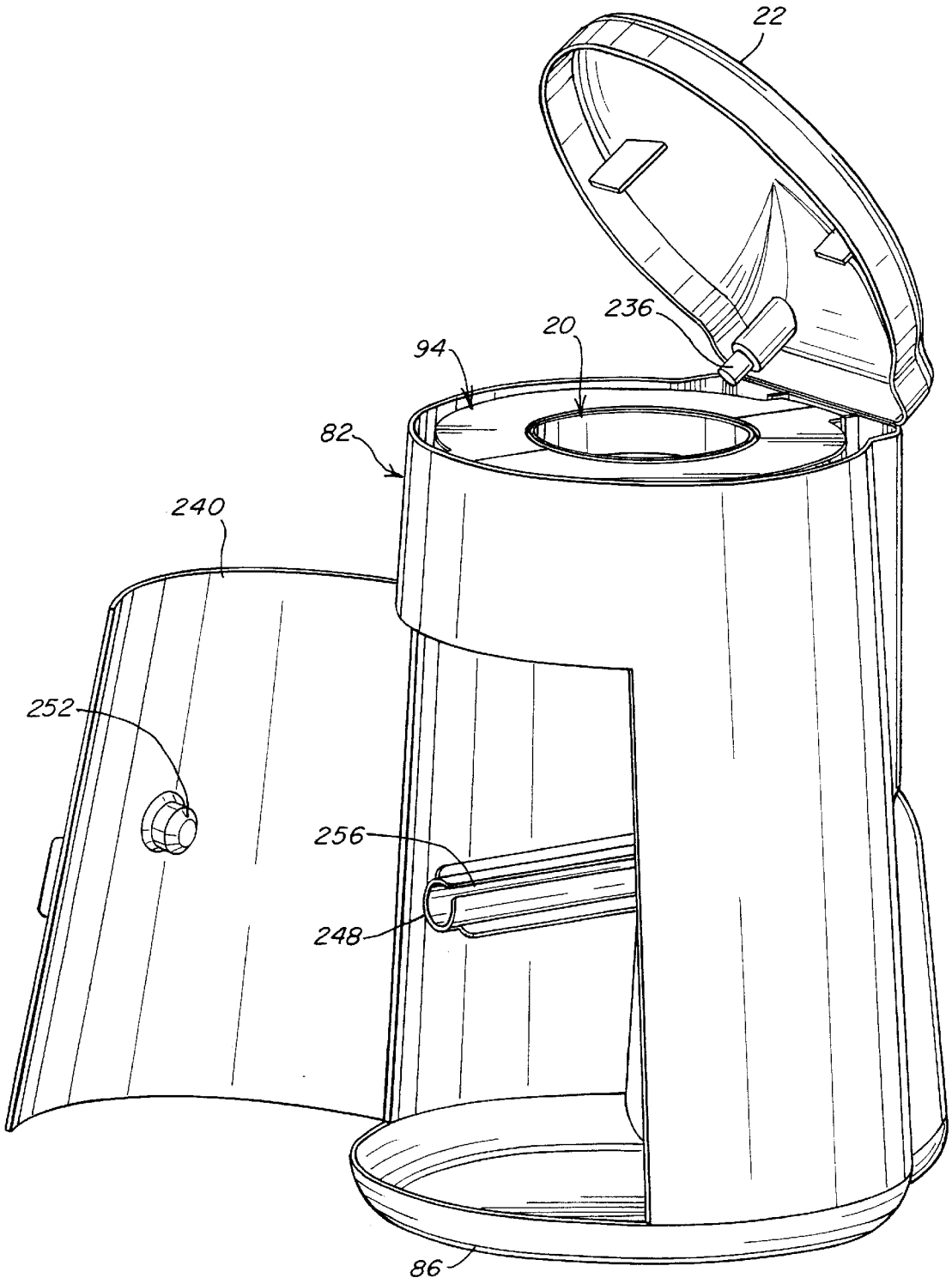
FIG. 21 is a perspective view of the waste disposal device shown in FIG. 20.
Figure 22:
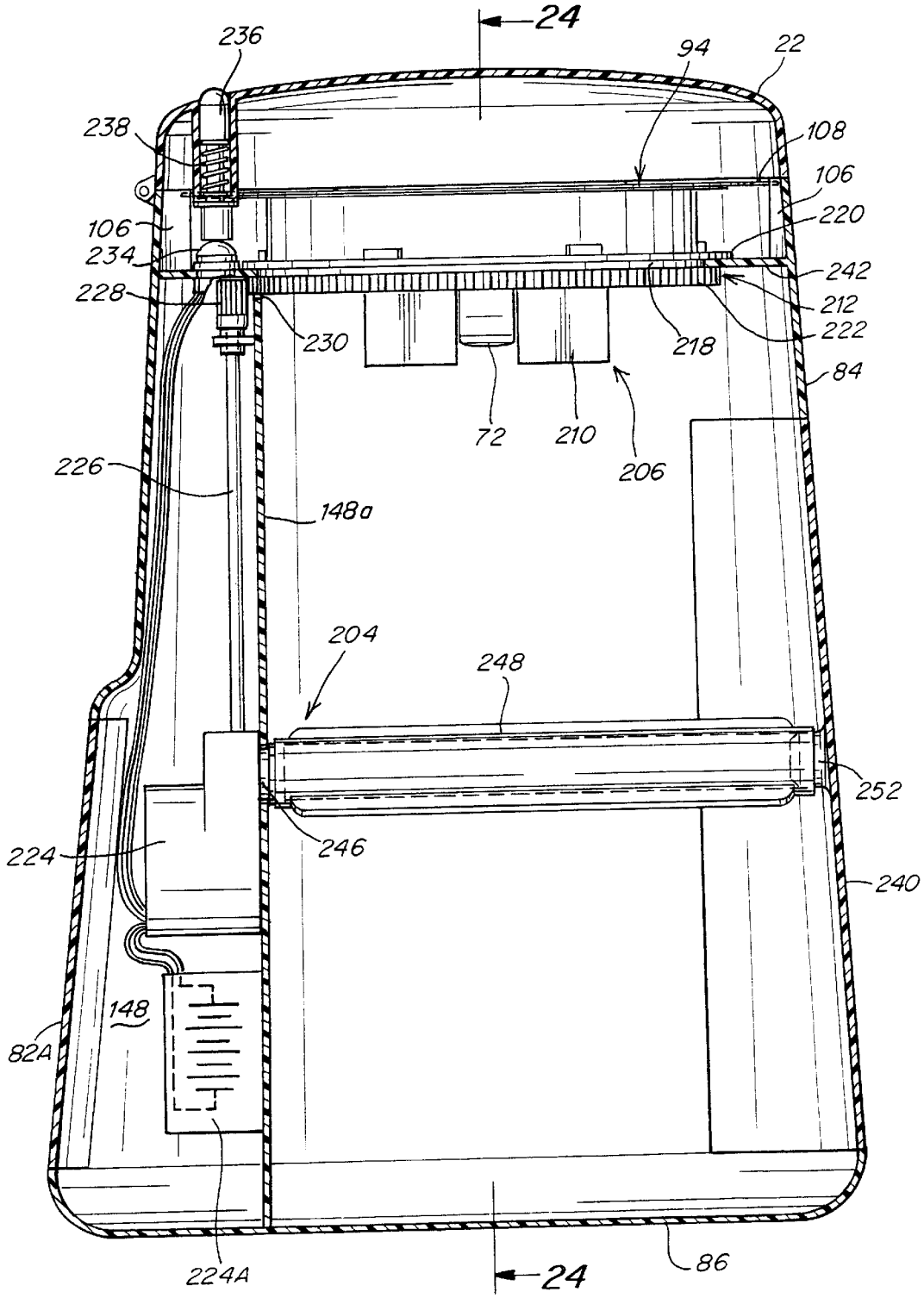
FIG. 22 is a cross-sectional view of the waste disposal device shown in FIG. 20.

Another embodiment of a motor actuation mechanism, which is designed to operate based on opening and/or closing of the lid 22, is shown in FIGS. 21 and 22 and comprises a switch or sensor 234 arranged on the flange 242 and a plunger 236 arranged on the lid 22 so that the plunger 236 contacts the switch 234 when the lid 22 is closed. The switch 234 is electrically coupled to the motor 224 and when pressed downward by the plunger 236, causes actuation of the motor 224. The plunger 236 is biased upward by a spring 238 to return it to its original position after being depressed. It is also possible to construct the switch 234 to automatically actuate the motor 224 upon contact with the plunger 236 in which case, the plunger 236 would be fixed in the lid 22 and immediately upon closure of the lid 22 when the switch 234 is contacted by the plunger 236, the switch 234 would actuate the motor 224.

An optional timer could be coupled to the switch 234 or motor 224 to delay the actuation of the motor 224 for a set period of time after depression of the plunger 236 or closure of the lid 22. In this case, the switch or sensor 234 would detect when the lid 22 is closed and send a signal to the timer. The timer then sends a signal to the motor 224 after the set period of time to actuate the motor 224. An appropriate sensor can be provided to detect whether a waste package has been inserted into the waste passage defined by the retention unit 206 so as to prevent unnecessary rotation of the retention unit 206 and waste of the tubing 34.

In this embodiment, it is advantageous that actuation of the motor 224 and the consequent rotation of the retention unit 206 and encapsulation of a waste package being grasped by the retention unit 206 is automatic upon closure of the lid 22 and does not require any additional manual activity, thereby eliminating the problem of the user forgetting to actuate the motor 224 and causing the release of odors from an unencapsulated waste package.

The location of the switch 234 and plunger 236 are not limiting and they may be arranged at other locations. Further, a manually-actuatable switch can be provided along the outer wall of the container and electrically coupled to the motor so that depression of the switch causes actuation of the motor. As such, actuation of the motor can occur without dependency on the closure of the cover. This might be useful when the encapsulation of a waste package is not entirely effective and an additional twisting of the tubing is desired.

Another embodiment of a rotation mechanism includes a manually actuated lever which in is coupled to the retention unit 206 and enables rotation of the retention unit 206 upon movement of the lever, in either a unidirectional movement or in both a back and forth movement. It is also possible to provide a crank coupled to the retention unit 206 in such a manner that when the crank is pushed downward and released, the retention unit rotates. The retention unit 206 may be arranged to rotate upon either the downward movement of the crank, the return upward movement or both. Such a crank is known, for example, in the toy art.

As described above, the cartridge 94 is a unique cartridge. However, it is envisioned that the waste disposal device shown in FIGS. 20–22 can be used for other cartridges containing flexible tubing and designed for use in a waste-encapsulation type of disposal device. Such cartridges would be placed on the support flange 214. The support flange 214 and lid 22 would be appropriately spaced from one another to provide sufficient space to accommodate a multitude of different cartridges.

Since the cartridges would be supported on the support flange 214, they could rotate along with the support flange 214. It is preferable though to provide a mechanism for fixing the cartridge in a stationary position relative to the retention unit 206 to provide for a better twisting of the tubing 34 upon rotation of the retention unit 206.

To this end, as shown in FIG. 26, the gear ring 212 could serve as an adapter to secure a conventional cartridge 244 through engagement between the projections 216 formed on the upper circular rim 220 of the gear ring 212 and notches 210A formed on the outer surface of the cartridge 244. Some conventional cartridges include notches which arise during the manufacturing process of the cartridge. The presence of these notches is therefore exploited in the invention to enabling attachment of the conventional cartridge to the gear ring 212. The gear ring 212 is therefore provided with the projections in locations which correspond to the locations of the notches on the conventional cartridges 244. By connecting the cartridge 244 to the gear ring 212, rotation of the gear rim 222 of the gear ring 212 causes rotation of the cartridge 244.

Another form of an adapter to enable use of the rotation mechanism 208 with conventional cartridges would be to form the adapter as an annular ring with a size to provide a snug fit for the conventional cartridge.

The compacting mechanism 204 comprises a shaft 246 rotated by the motor 224 and connected to or formed integral with a tube 248 positioned in the waste package-receiving portion of the container 82. The optimum location of the tube 248 relative to the base 86 of the container 82 and retention unit 206 may be determined by experimenting with the particular waste product to be encapsulated but would usually be about halfway between the base 86 and the retention unit 206.

Access door 240 includes a projection 252 which frictionally engages an inner surface of the tube 248 when the door is closed so that the tube 248 is supported at both ends.

The tubing 34 is removably connected to the tube 248 so that rotation of the tube 248 causes the tubing 34 to be pulled downward and wound around the tube 248. Connection of the tubing 34 to the tube 248 can be accomplished in a variety of ways, for example, by forming the tubing 34 with an enlarged heat-sealed end 34A (having a shape smaller than the size of a slot 256 formed in the tube 248) and inserting the end into the interior of the tube 248 when the access door is open or by arranging a clip at the end of the tubing 34 and inserting the clip into the interior of the tube 248 when the access door is open. The tubing 34 can also be tied to the tube 248. Since the tubing 34 is entrained in connection with the tube 248, the encapsulated waste packages are compacted into a roll as the tube 248 is rotated upon each subsequent insertion of a waste package into the device (see FIG. 24). The encapsulated waste packages are prevented from upward movement by the formation of the twist above each encapsulated waste package. Removal of the tubing from engagement with the tube 248 would entail pulling the forward end of the tubing 34 out of the slot 256. The slot 256 would typically extend only over a longitudinal portion of the tube and not the entire tube.

The tube 248 includes, in addition to the slot 256, ridges 258 which may be diametrically opposed or evenly spaced around the circumference of the tube 248. This enables the construction and use of disposable sleeves 262 having ridges 264 defining inner grooves in which the ridges 258 of the tube 248 are received (see FIG. 23A). A sleeve 262 is placed on the tube 248 and the tubing 34 is connected to the sleeve 262, for example, during manufacture or thereafter by tying, adhesive or the like. Removal of the roll of waste packages would entail sliding the sleeve 262 off of the tube 248. The cartridges 94 could thus be sold together with a sleeve 262, a forward end of the tubing 34 being attached to the sleeve 262 while a rearward end of the tubing 34 is attached to the cartridge 94.

In this embodiment, when the motor 224 is actuated, two different operations are performed. First, the shaft 226 from the motor 224 is rotated in the direction of arrow A to cause the retention unit 206 to rotate in the direction of arrow B (via the engagement of gear 228 with the gear rim 222) while the retention unit 206 is grasping a waste package relative to the cartridge 94 to form a twist above the waste package (see FIG. 23A). Second, the tube 248 is rotated in the direction of arrow C with the tubing 34 connected thereto to cause the tubing 34, with one or more encapsulated waste packages being situated between the tube 248 and the retention unit 206 and not yet in the roll of waste packages, to be pulled downward and around the tube 248 to compact the waste packages into a roll. Actuation of the motor 224 can be effected in the ways noted above. Separate motors can be provided for the rotation mechanism for the retention unit 206 the rotation mechanism for the tube 248.

When the container is full, the access door 240 can be opened, the tubing 34 cut at a point above the uppermost encapsulated waste package, the tubing tied and then the roll of compacted waste packages slid off of the tube 248.

Figure 23A:
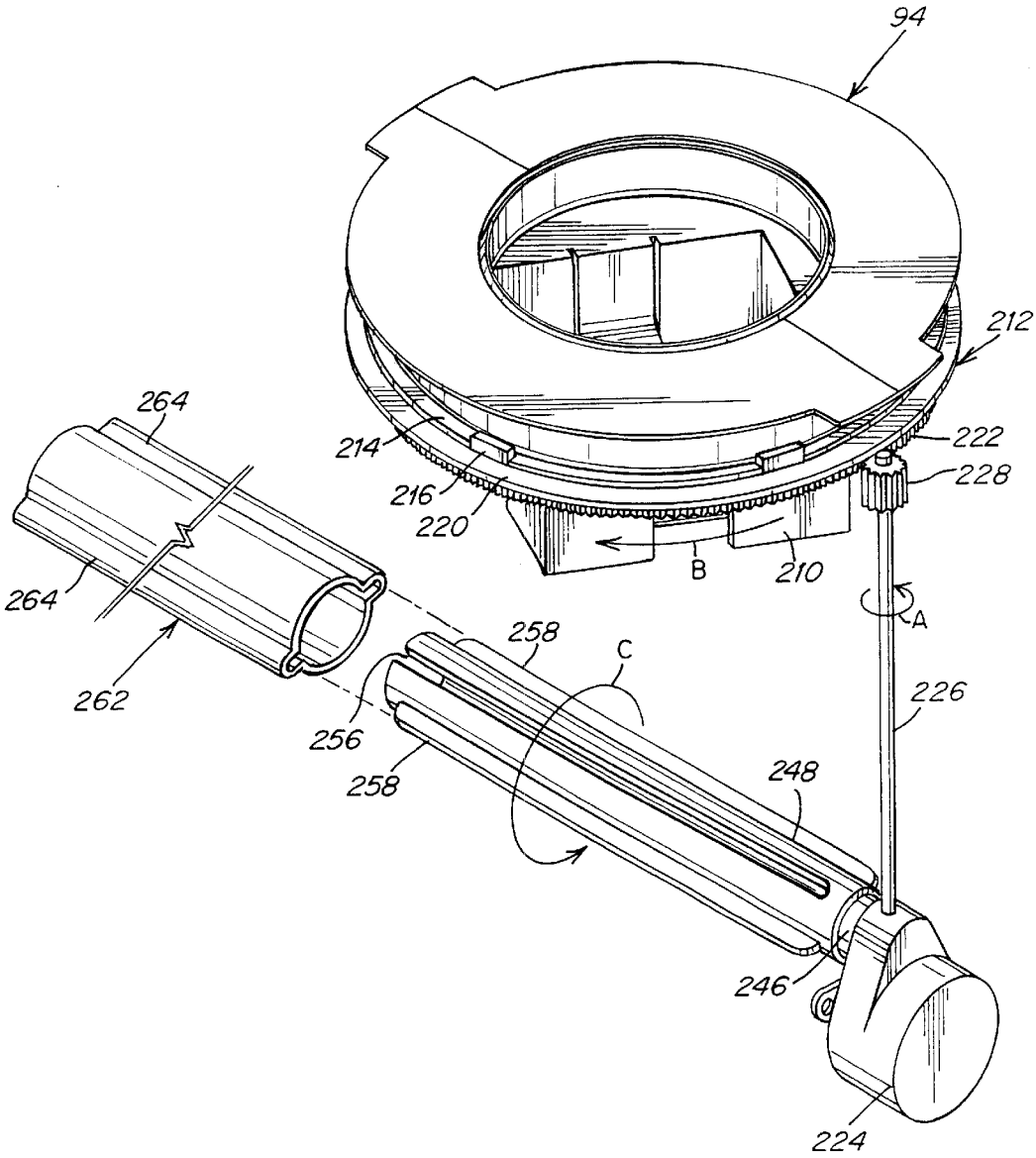
FIG. 23A is a perspective view of the encapsulation device and compacting mechanism of the waste disposal device shown in FIG. 20.
Figure 23B:
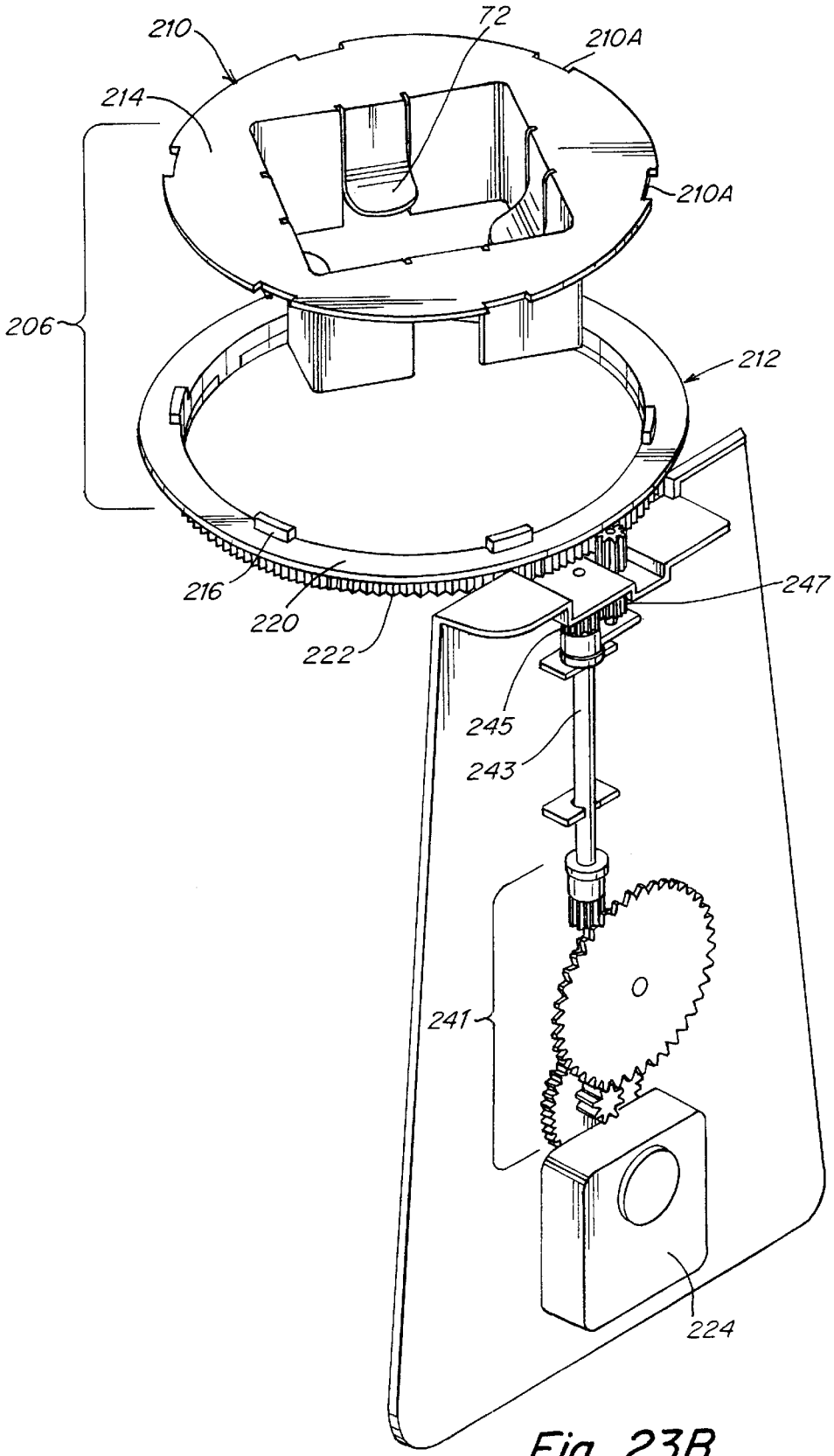
FIG. 23B is a perspective view of another embodiment of an encapsulation device for use in the waste disposal device shown in FIG. 20.
Figure 24:
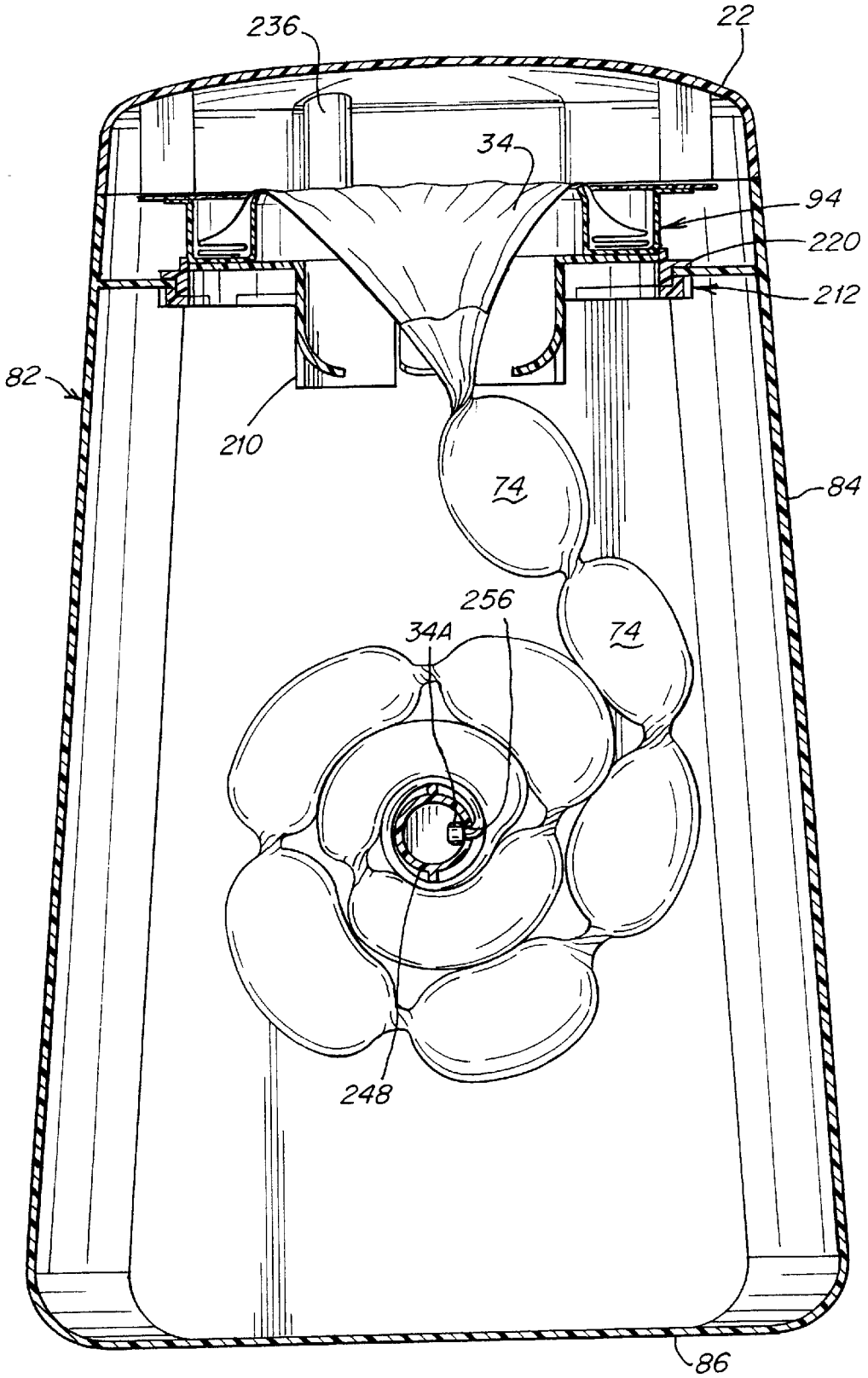
FIG. 24 is a cross-sectional view of the waste disposal device of FIG. 20 showing waste packages encapsulated and compacted.

Instead of having a shaft 226 extending directly from the motor 224, it is possible to provide a gear transmission assembly between the motor 224 and the gear rim 222 as shown in FIG. 23B. The gear transmission assembly 241 comprises several gears in meshed engagement with one gear being in meshed engagement with a gear rotated directly by the motor 224, a shaft 243 is connected to another gear 245 and a drive gear 247 in meshed engagement with the drive gear 245 and the gear rim 222. The gear transmission assembly can be designed to increase the rotational force provided by the motor 224.

These embodiments would be particularly advantageous for medical waste requiring special disposal, e.g., infectious or bodily waste from doctor's offices, which is generally not compacted even though it is very suitable for compacting. The cost of disposing of medical waste from doctor's offices is typically based on the number of pick-ups regardless of the amount of material, and if the medical waste could be compacted, it would result in fewer, less frequent pick-ups.

It is envisioned that an attachment for a pail can also be fabricated from the components above. That is, the lid 22 and encapsulation device 202, i.e., the retention unit 206 and rotation mechanism 208, and the compacting mechanism 204 can be fabricated as a unit for enabling attachment to a particular size or sizes of pails (with an adapter, as needed). Once attached to the pail, upon insertion of a cartridge, a waste disposal device is obtained. In this case, an internal power source (i.e., the motor) for the rotation mechanism 208 would be used.

To prepare the waste disposal device shown in FIG. 20, the lid 22 is opened and a cartridge 94 is placed onto the support flange 214. For use, the lid 22 is opened to expose the waste insertion opening. A waste package 74 is placed into the bag formed by flexible tubing 34 preferably so that the bag is held against the resilient springs 72. The lid 22 is closed and the foot pedal 232 is depressed to cause actuation of the motor 224, either immediately or after a set period of time if a timer is present. The shafts 226, 246 rotate causing rotation of the gear 228 which in turn causes rotation of retention unit 206 relative to the cartridge 94, which is held stationary by the positioning of flanges 108 on the cartridge 94 between anti-rotation tabs 106 on the container, so that a twist forms above the waste package 74 and encapsulates the waste package 74.

Successive waste packages 74 are inserted into the waste insertion opening, and so long as that waste package or a preceding waste package is grasped by the resilient springs 72, rotation of the retention unit 204 will cause formation of a twist above that waste package. This procedure continues until the length of available tubing 34 is exhausted or the container 82 is full.

A region proximate and optionally including the end of the tubing 34 may be colored differently than a remainder of the tubing 34 to provide an indication when the end of the tubing 34 is approaching.

The tubing 34 can be provided with lines of depressions 34*a* (see FIG. 27) at spaced intervals to enable the tubing 34 to be easily cut by tearing along the lines of depressions 34*a*. This would be beneficial for the instances where the waste chamber is full while an amount of tubing 34 remains in the cartridge. The tubing 34 is torn off at a depression line and the free end of the tubing may then be tied to form a closed, forward end or the free end can be inserted into the slot 256 in the tube 248.

In order to prevent release of odors from encapsulated waste packages, the depressions 34*a* extend only partially through the thickness of the tubing 34. In this manner, even if a waste package was placed along a line of depressions, odors from the waste package would not be released through the depressions 34*a*.

In the event that the tubing is exhausted, the lid 22 is opened and the cartridge 94 is closed by folding the cartridge 94 onto itself and connecting the cover attachment mechanism, e.g., the hook and loop fastener sections 132, 134. The cartridge 94 may be pushed through the support flange 214 and the frame 210 into the container 82.

Although the embodiment in FIGS. 20–22 provide for the formation of a twist by the rotation of the retention unit relative to the cartridge 94 in order to encapsulate the waste packages 74 and the compacting of the series of waste packages 74 thus-formed, it is possible to provide only the compacting mechanism 204 without any rotation of the cartridge 94 or retention unit.

For example, the cartridge 94 and gear ring 212 assembly shown in FIG. 26 can be used with a compacting mechanism 204 without any retention structure. The retention of the waste packages is provided by the compacting mechanism 204, i.e., by the construction of the tube 248 to fixedly retain the forward end of the tubing 34. In use, the waste package is pushed into the tubing 34 and then the motor 224 is actuated, in any of the ways discussed herein. The motor 224 causes the shaft 226 to rotate and the gear 228 to rotate so that the gear rim 222 of the gear ring 212 is rotated. The rotation of the gear ring 212 causes rotation of the cartridge 244 attached thereto. A twist forms above the waste package upon the rotation of the cartridge 244 since the end of the tubing 34 in front of the waste package is held by the tube 248 and cannot rotate. Thus, in this embodiment, for each waste package, there is relative rotation between a portion of the tubing 34 above the waste package and a portion of the tubing 34 below the waste package, with this relative rotation enabling the formation of a twist and thus encapsulation of the waste package.

Figure 28:
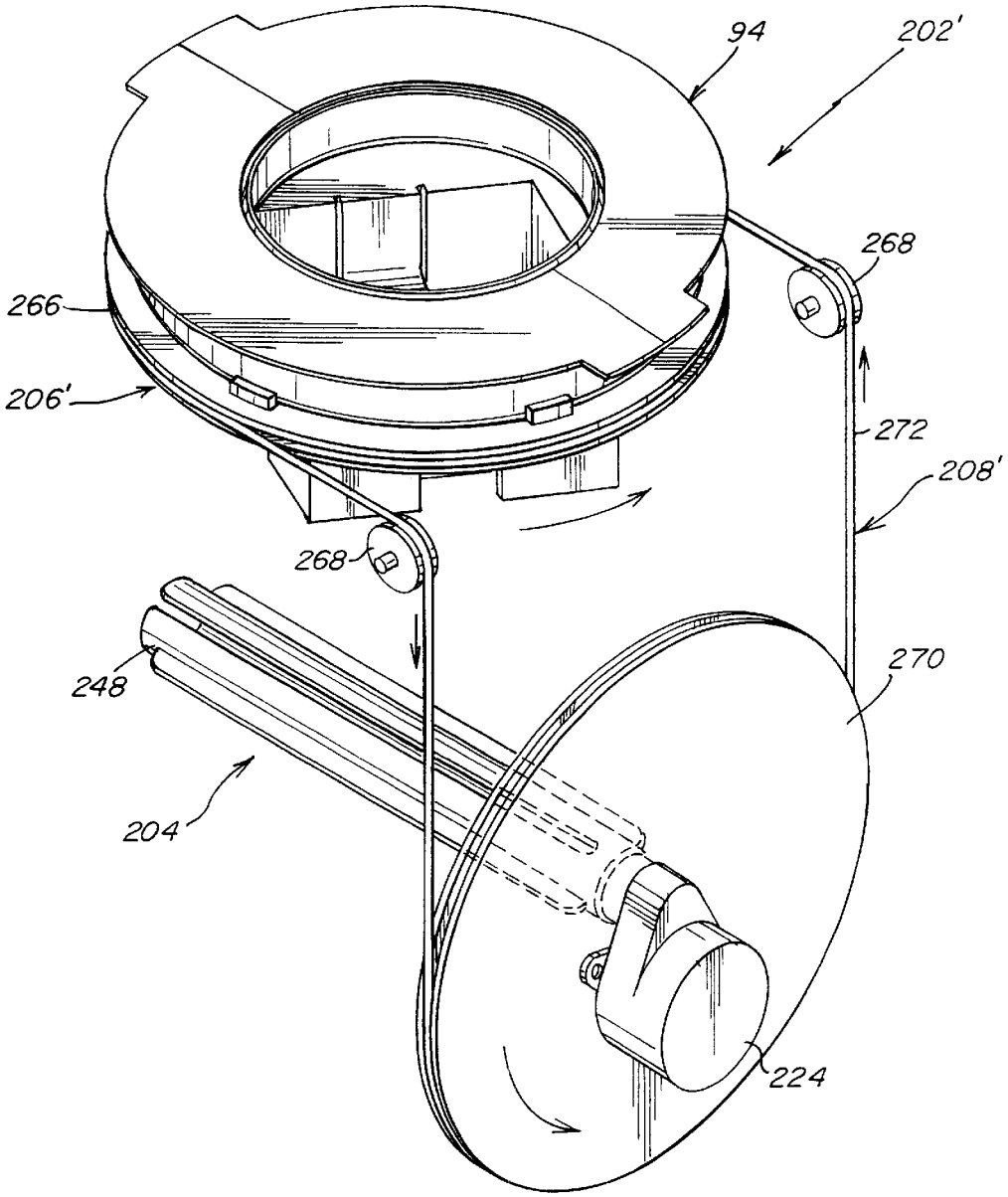
FIG. 28 is a schematic view of another encapsulation device for the waste disposal device shown in FIGS. 20–22.
Figure 29:
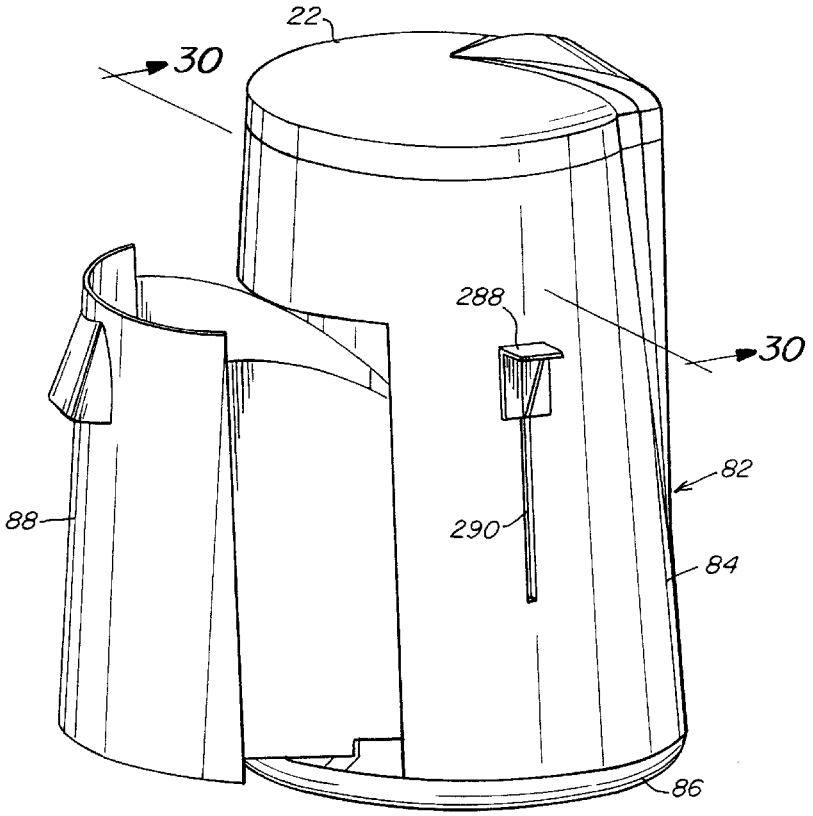
FIG. 29 is a perspective view of another embodiment of the invention wherein the waste package is rotated while the cartridge is stationary.
Figure 30:
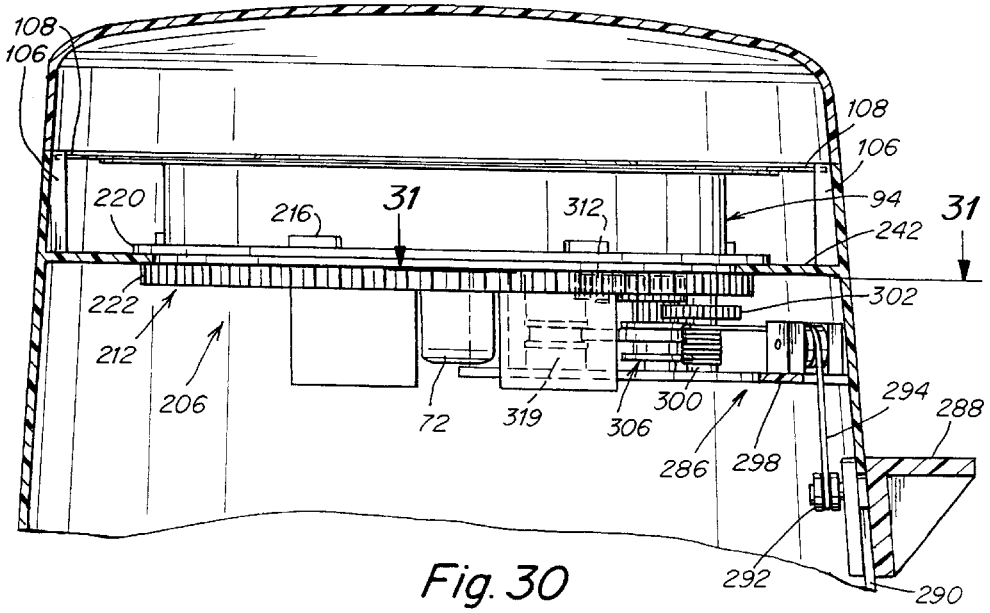
FIG. 30 is a cross-sectional, partial view taken along the line 30—30 of FIG. 29.
Figure 31:
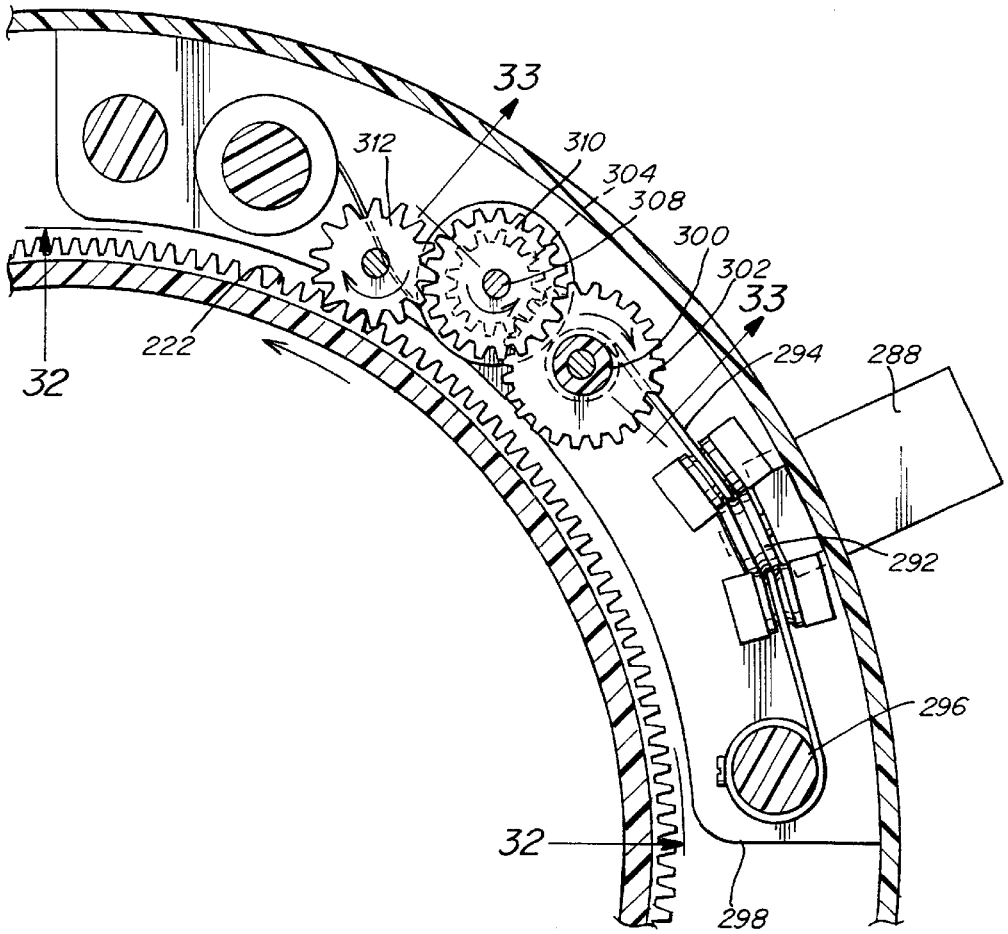
FIG. 31 is a cross-sectional view taken along the line 31—31 of FIG. 30.
Figure 32:
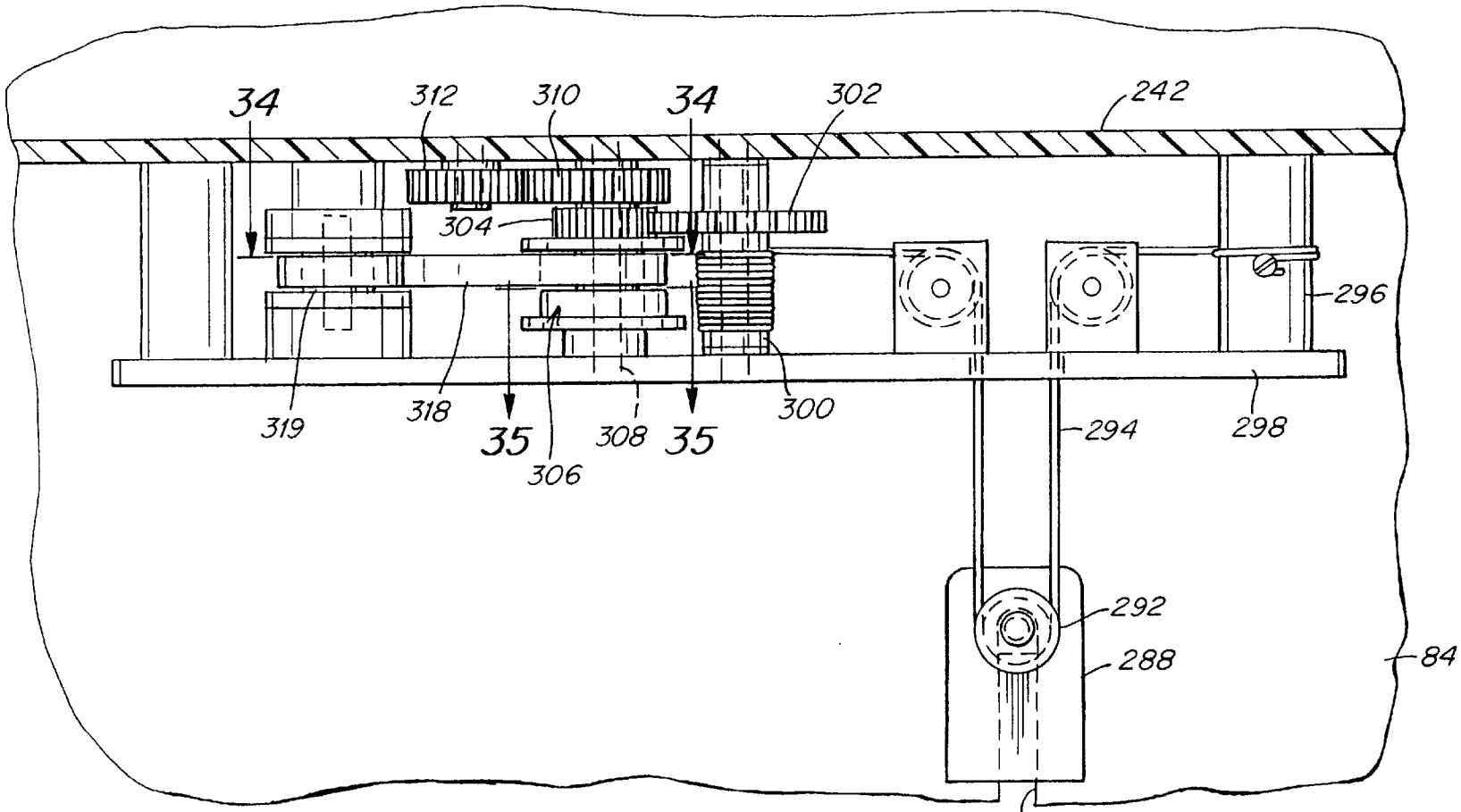
FIG. 32 is a cross-sectional view taken along the line 32—32 of FIG. 31.
Figure 33:
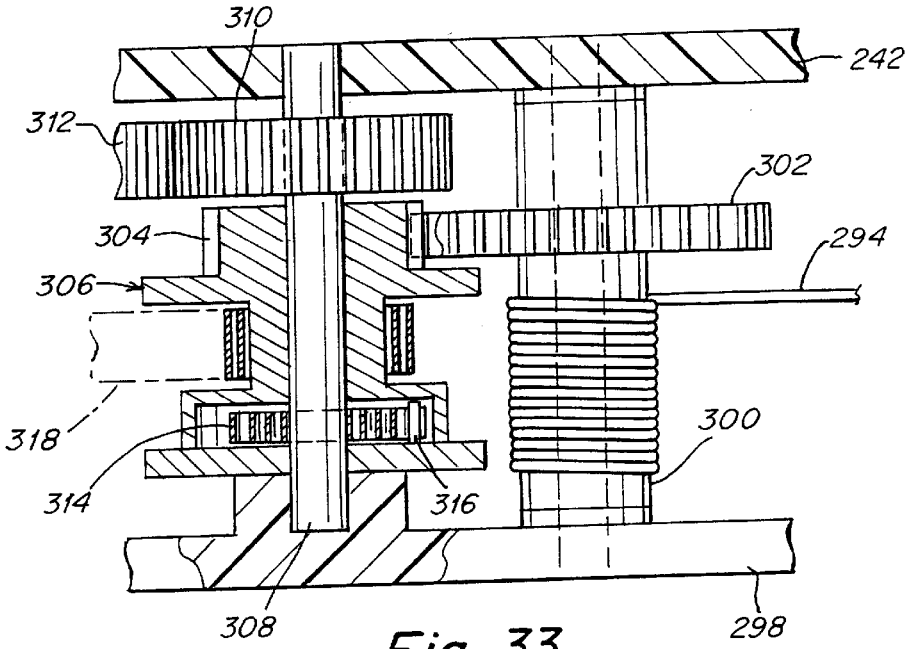
FIG. 33 is a cross-sectional view taken along the line 33—33 of FIG. 31.
Figure 34:
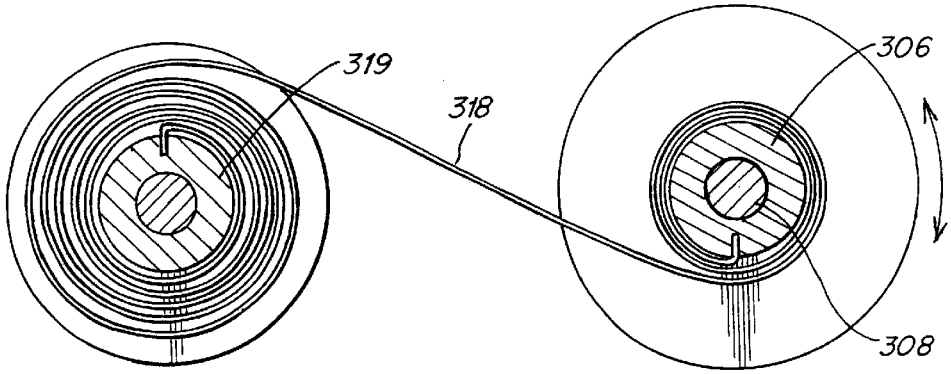
FIG. 34 is a cross-sectional view taken along the line 34—34 of FIG. 32.
Figure 35:
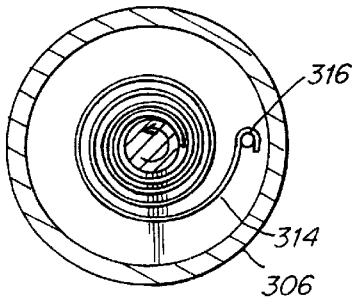
FIG. 35 is a cross-sectional view taken along the line 35—35 of FIG. 32.
Figure 36:
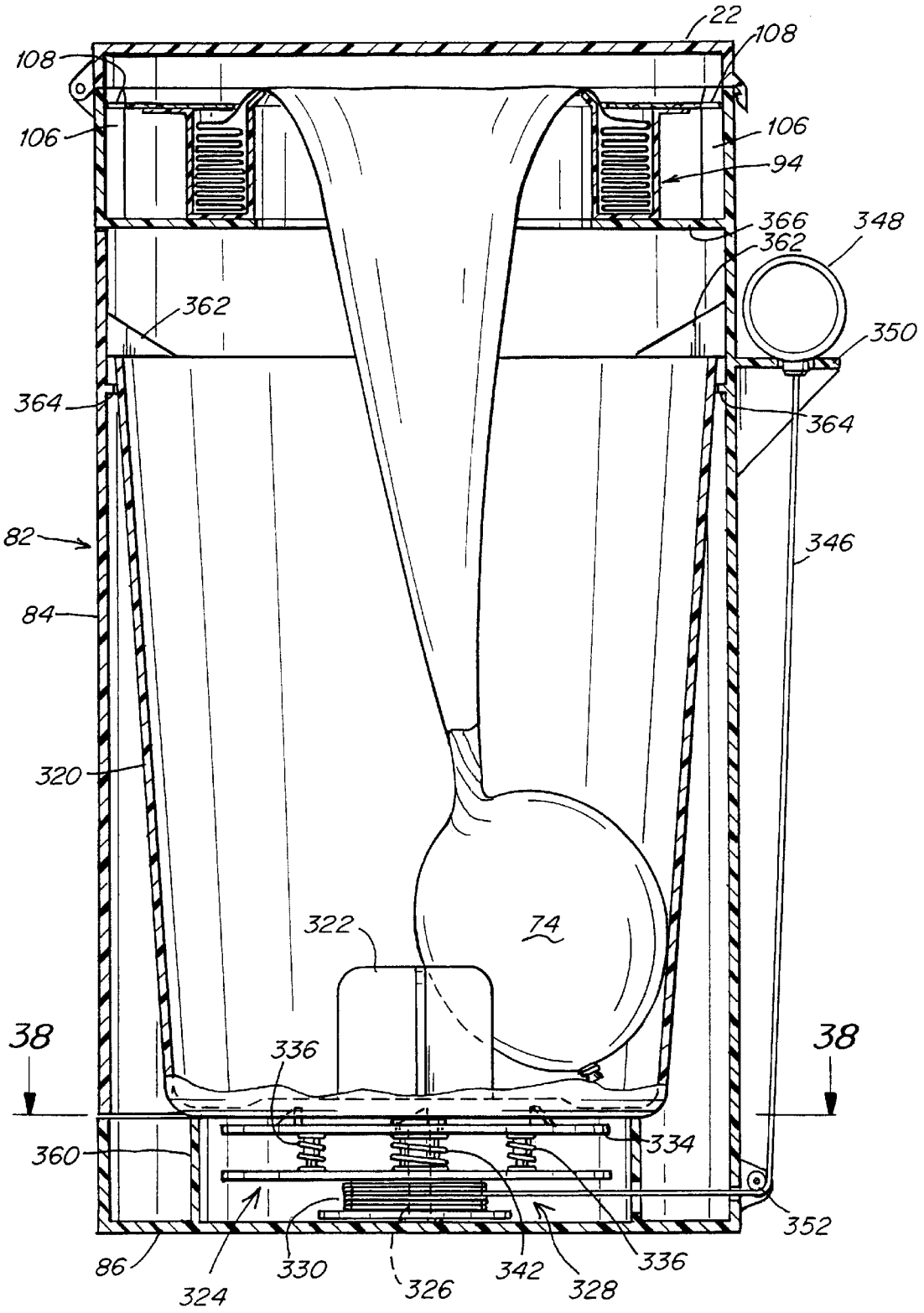
FIG. 36 is a cross-sectional view of another embodiment of the invention wherein the waste package is rotated while the cartridge is stationary.
Figure 37:
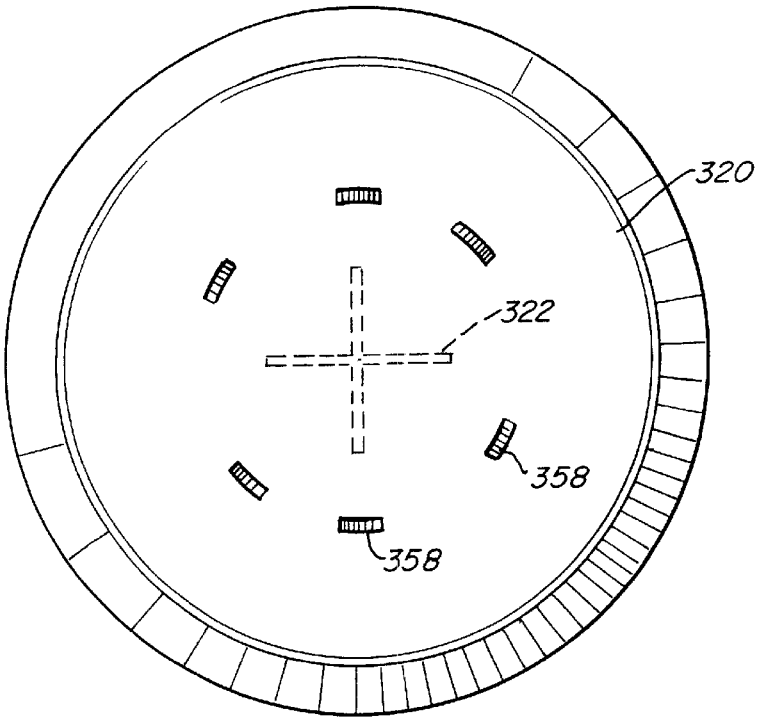
FIG. 37 is a view of the bottom of the pail in the embodiment of FIG. 36.
Figure 38:
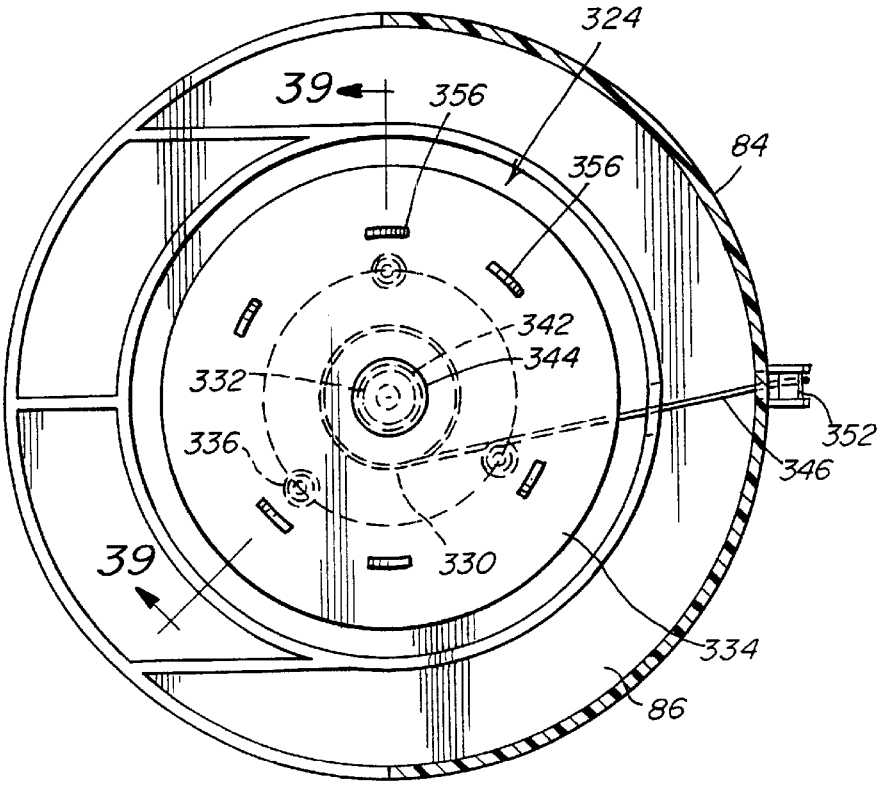
FIG. 38 is a sectional view taken along the line 38—38 of FIG. 36.
Figure 39:
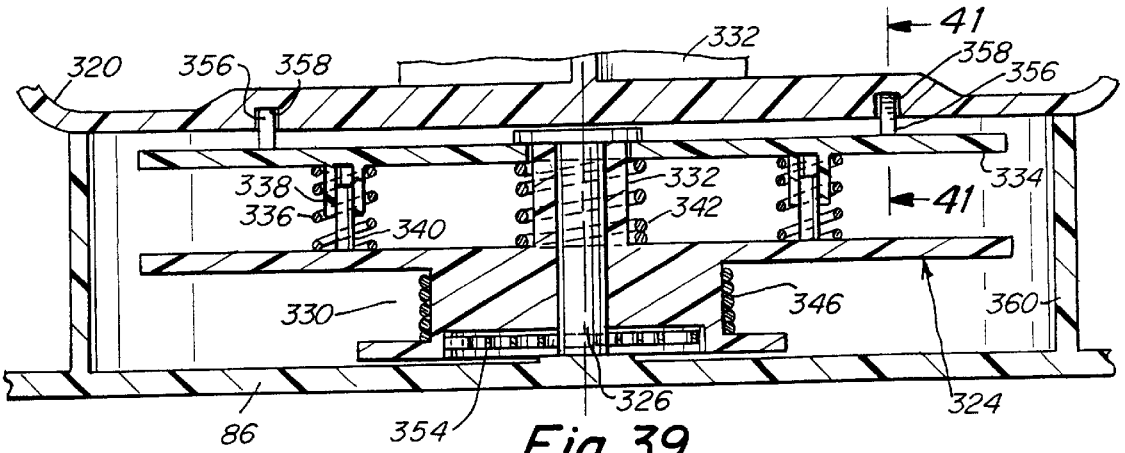
FIG. 39 is an enlarged cross-sectional view of the turntable and bottom of the pail showing a position in which the ribs on the turntable engage with depressions on the pail.
Figure 40:
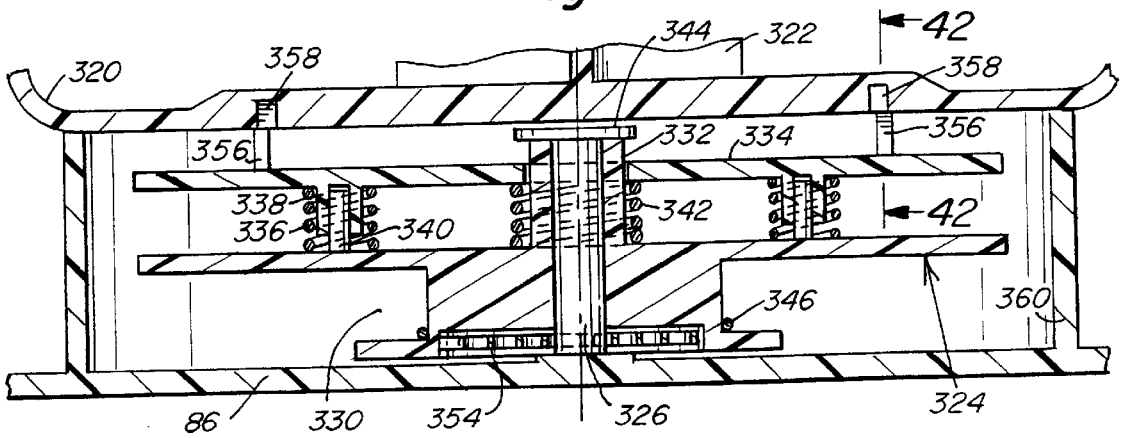
FIG. 40 is an enlarged cross-sectional view of the turntable and bottom of the pail showing a position in which the ribs on the turntable are separated from the depressions on the pail.
Figure 41:
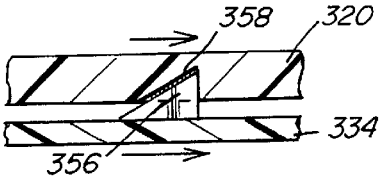
FIG. 41 is a cross-sectional view taken along the line 41—41 of FIG. 39.
Figure 42:
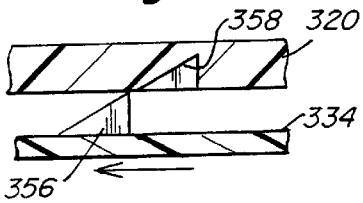
FIG. 42 is a cross-sectional view taken along the line 42—42 of FIG. 40.

Another embodiment of an encapsulation device is shown in FIG. 28 and designated 202'. Encapsulation device 202' comprises a retention unit 206' which engages and temporarily holds a waste package and a rotation mechanism 208' for rotating the retention unit 206'. The retention unit 206' is similar to retention unit 206 except that instead of an annular gear ring, it includes a pulley 266 connected to or formed integral with the frame 210. The rotation mechanism 208' includes a pair of guide pulleys 268 mounted to the container 82 and a pulley 270 attached to the shaft 246 or to the tube 248. A cable belt 272 passes over pulleys 266, 268, 270 and frictionally engages at least pulleys 266 and 270 such that movement is imparted to the pulley 270 by the rotation of the shaft 246 and/or tube 248 caused by the motor 224 which movement is transferred to the pulley 266 via the cable belt 272 to cause rotation of pulley 266. Rotation of pulley 266 causes rotation of the retention unit 206 connected thereto.

The retention unit 206' is rotatably mounted to the container, for example, by providing an annular slot which receives a flange formed on the inner wall of the container.

Another embodiment of a waste disposal device wherein the waste packages are rotated relative to the cartridge is shown in FIGS. 29–35. In this embodiment, the waste packages 74 are held by a retention unit 206, similar to the one shown in FIG. 25, which is rotated while the cartridge 94 of tubing 34 is held stationary. Also, anti-rotation tabs 106 are formed on the container 82 to prevent rotation of the cartridge 94 upon rotation of the retention unit 206.

A rotation mechanism 286 is provided for enabling rotation of the retention member 274 upon depressing a pedal 288 while preventing rotation of the retention member 274 when the pedal 288 returns to its original upper position. The pedal 288 is movable in a slot 290 formed in the wall of the container 82. The rotation mechanism 286 comprises a pulley 292 arranged inside the container 82 and which is rotatably attached to the pedal 288. A cable 294 runs over this pulley 292 and has a first end anchored to an anchor member 296 attached to a flange 298 of the container. The second end of this cable 294 is attached to a rotatable shaft 300 and a portion of the cable 294 is wound around the shaft 300. A gear 302 is mounted on the shaft 300 and is in meshed engagement with a gear portion 304 of a clutch member 306 mounted about a drive spindle 308 attached to the flange 298. A drive gear 310 is fixedly mounted on this drive spindle 308 and is in meshed engagement with an idler gear 312 which in turn is in meshed engagement with the gear rim 222.

The rotation mechanism 286 further comprises a spring clutch 314 arranged in the clutch member 306 to grab the drive spindle 308 during counterclockwise rotation of the clutch member 306, so that the clutch member 306 rotates along with the drive spindle 308 and the drive gear 310, and releases the drive spindle 308 during clockwise rotation, so that the clutch member 306 does not engage with the drive spindle 308 and does not rotate the drive spindle nor the drive gear 310. The spring clutch 314 is attached by a pin 316 to the clutch member 306.

To cause rotation of the clutch member 306 in the clockwise direction, i.e., to cause the cable 294 to wind around the shaft 300 and thus the pedal 288 to be moved upward, a return spring 318 is connected at one end to a shaft 320 mounted on the flange 298 and at an opposite end to the clutch member 306.

In operation, when the pedal 288 is moved downward, the cable 294 unwinds from the shaft 300 causing rotation of the gear 302 and the clutch member 306, since the spring clutch 314 grabs the drive spindle 308. Rotation of the clutch member 306 causes rotation of the drive gear 310 which in turn causes rotation of the idler gear 312 and finally rotation of the gear rim 222 so that the retention unit 206 connected to the gear rim 222 rotates. The rotation of the clutch member 306 is against the bias of the return spring 318. As such, when the pressure exerted on the pedal 288 is removed, the return spring 318 causes rotation of the clutch member 306 in an opposite direction, clockwise in the illustrated embodiment, so that the gear 302 rotates counterclockwise causing the cable 294 to be wound about the shaft 300 and the pedal 288 to be raised. The drive gear 310 is not rotated during the rotation of the clutch member 306 in view of the disengagement of the spring clutch 314 from the drive spindle 308, with the result that the retention unit 206 is not rotated.

Another embodiment of a waste disposal device wherein the waste packages are rotated relative to the cartridge is shown in FIGS. 36–42. In this embodiment, a pail 320 is rotated while it holds the waste packages. To this end, the pail 320 includes a retention member 322 extending upward from the base of the pail 320 and having sections designed to hold the first waste package between the retention member 322 and the walls of the pail 320. Although the retention member 320 is shown having an X-shaped, other shapes are contemplated within the scope of the invention.

The container 82 houses a turntable 324 rotatable about a shaft 326 attached to the base of the container and a rotation mechanism 328 for rotating the turntable 324. The turntable 324 is arranged below the pail 320 and includes a spool section 330 on which a string is wound, a cylindrical shaft section 332 extending upward from the spool section 330 and an annular plate 334 surrounding the shaft section 332. The spool section 330 and shaft section 332 surround the shaft 326 attached to the container 82 to enable rotation of the turntable 324 relative to the container 82.

A biasing mechanism, such as a plurality of springs 336, is arranged between the plate 334 and the spool section 330 to bias the plate 334 upward. The springs 336 are arranged around annular seats 338 formed on the lower surface of the plate 334 which accommodate projections 340 arranged on the spool section 330. Another spring 342 is arranged around the shaft 326 between the spool section 330 and the plate 334. A lip 344 is arranged at the top of the shaft section 332 to limit the upward movement of the plate 334.

One end of a string 346 is connected to the spool section 330 of the turntable 324 and the spring 346 is wound around the turntable 324 with the opposite end of the string 346 being connected to a pull ring 348 situated outside of the container. Pull ring 348 rests on a flange 350 formed integral with the container 82. A pulley 352 is also attached to the container 82 to guide the string 346 into the container 82 to the spool section 330 of the turntable 324. As such, pulling of the pull ring 348 will cause rotation of the turntable 324 in one direction. The turntable 324 is returned to its original position by a torsion spring 354 connected to the turntable 324.

A mechanism is provided to enable unidirectional rotation of the pail 320 upon rotation of the turntable 324, i.e., so that the pail 320 is rotated by the turntable 324 upon rotation of the turntable 324 in one direction and not the opposite direction. To this end, the turntable 324 is provided with a plurality of ramped ribs 356 on an upper surface while the bottom surface of the pail 320 is provided with corresponding ramped depressions 358. The pail 320 can be positioned onto the turntable 324 so that the ramped ribs 356 are present in the ramped depressions 358 (FIG. 39) or if the ramped ribs 356 are not present in the ramped depressions 358, then the ramped ribs 356 will be urged into the ramped depressions 358 by the springs 334,342 when the pull ring 348 is pulled (see FIG. 41) so that the pail 320 is rotated upon rotation of the turntable 324 in one direction. Release of the pull ring 348 allows rotation of the turntable 324 in the opposite direction and the ramped ribs 356 disengage from the ramped depressions 358 in the pail 320, against the bias of the springs 334,342, (see FIG. 42) so that the pail 320 does not rotate with the turntable 324. Prevention of rotation of the pail 320 is assisted by friction between the bottom of the pail 320 and a retaining wall 360 of the container surrounding the turntable 324.

In this embodiment, ribs 362 project from the inner surface of the wall of the container 82 to prevent upward movement of the pail 320 and centering ribs 364 project from the inner surface of the wall of the container 82 to center the pail 320 in a position in which the ramped depressions 358 can be engaged by the ramped ribs 356 of the turntable 324. Also, the cartridge 94 is seated on a flange 366 formed integral with the container 82 and held against rotation by anti-rotation tabs 106 or the like as described above In use, the lid 22 is opened and the first waste package is pushed into the pail 320 and positioned between the retention member 322 and the sides of the pail 320 so that it is held in that position. The lid is closed and the pull ring 348 is pulled causing the turntable 324 to rotate with the effect that since the ramped ribs 356 are pressed into the ramped depressions 358 on the pail 320, the pail 320 is rotated. Since the cartridge 94 is held stationary by the anti-rotation tabs, a twist is formed in the tubing 34 above the waste package. When the pull ring 348 is released, the turntable 324 rotates in the opposite direction but since the ramped ribs 356 disengage from the ramped depressions 358, in view of the direction of the incline of the ramped ribs 356 and ramped depressions 358, the pail 320 does not rotate along with the turntable 324. Upon the insertion of a subsequent waste package into the pail 320, the pull ring 348 is again pulled and since the first waste package is held, both waste packages are rotated upon rotation of the pail 320 causing the formation of a twist above the subsequent waste package. This process continues until the pail 320 is full at which time, the tubing is cut, the pail 320 is removed, emptied and then reinserted into the container 82. The end of the tubing 34 is tied and the process continues.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A waste disposal device, comprising:

a container defining a waste chamber for receiving encapsulated waste packages;

a lid coupled to said container and movable between an open position in which said chamber is accessible and a closed position in which said chamber is covered;

a cartridge arranged in said container and containing a length of flexible tubing arranged to receive waste packages, said cartridge being maintainable in a stationary position;

a retention mechanism for holding a waste package received in said tubing; and a rotation mechanism arranged to rotate said retention mechanism, and thus a waste package when held by said retention mechanism, while said cartridge is stationary in order to twist said tubing and encapsulate the waste package.

2. The waste disposal device of claim 1, further comprising an anti-rotation mechanism for holding said cartridge stationary during rotation of said retention mechanism.

3. The waste disposal device of claim 2, wherein said cartridge includes at least one flange, said anti-rotation mechanism comprising at least one pair of tabs formed on said container such that said each of said at least one flange of said container is received between a respective pair of tabs.

4. The waste disposal device of claim 1, wherein said retention mechanism comprises a gear ring and a frame attached to said gear ring and including a plurality of resilient springs adapted to engage with the waste package, said rotation mechanism engaging with said gear ring to cause rotation of said gear ring and thus said retention mechanism

5. The waste disposal device of claim 4, wherein said gear ring comprises a gear rim and an adapter rim attached to said gear rim and adapted to hold said cartridge.

6. The waste disposal device of claim 1, wherein said retention mechanism comprises a gear rim, said rotation mechanism engaging with said gear rim to cause rotation of said gear rim and thus said retention mechanism.

7. The waste disposal device of claim 6, further comprising a toothed member attached to said lid, said rotation mechanism comprising at least one gear arranged in said container for enabling the conversion of movement of said lid to rotational movement of said gear rim and thus said retention mechanism.

8. The waste disposal device of claim 7, wherein said at least one gear is part of a gear assembly constructed to convert movement of said lid in a downward direction to rotational movement of said gear rim and prevent movement of said lid in an upward direction from being converted to rotational movement of said gear rim.

9. The waste disposal device of claim 7, wherein said toothed member comprises a rack gear having a series of teeth on an outer or inner arcuate surface.

10. The waste disposal device of claim 6, wherein said rotation mechanism comprises:

a motor having a shaft and providing rotational movement to said shaft;

a gear arranged on said shaft and in engagement with said gear rim; and a motor actuation mechanism for actuating said motor to rotate said shaft.

11. The waste disposal device of claim 10, further comprising a wall defining a compartment in said container and including a slot, said gear being arranged in said compartment and said gear rim extending through said slot into said compartment to provide for engagement between said gear rim and said gear.

12. The waste disposal device of claim 10, wherein said motor actuation mechanism comprises a foot pedal coupled to said motor and arranged such that upon depression of said foot pedal, said motor is actuated.

13. The waste disposal device of claim 10, wherein said motor actuation mechanism comprises a pushbutton coupled to said motor such that upon depression of said pushbutton, said motor is actuated.

14. The waste disposal device of claim 10, wherein said motor actuation mechanism comprises a switch arranged on said container and coupled to said motor and a plunger arranged on said lid to engage said switch when said lid is closed, said switch being arranged to actuate said motor upon pressured being applied by said plunger.

15. The waste disposal device of claim 6, wherein said rotation mechanism comprises a pedal arranged in a slot partially outside of said container, a pulley connected to said pedal and a movement converting mechanism for converting unidirectional movement of said pedal in said slot and thus movement of said pulley into rotation of said gear rim.

16. The waste disposal device of claim 15, wherein said movement converting mechanism comprises a rotatable shaft, a cable running over said pulley and having a first end fixed to said container and a second end fixed to said shaft, said cable being windable about said shaft, a first gear mounted on said shaft, a drive spindle, a clutch member mounted about said drive spindle and having a gear portion meshing engagement with said first gear, a drive gear fixedly mounted on said drive spindle, and an idler gear is meshing engagement with said drive gear and said gear rim.

17. The waste disposal device of claim 16, wherein said shaft, said drive spindle, said drive gear and said idler gear are mounted on a flange of said container.

18. The waste disposal device of claim 16, wherein said clutch member comprises a spring clutch arranged to grab said drive spindle during rotation of said clutch member in one direction so that said clutch member transfers rotational force from said first gear to said drive gear and release the drive spindle during rotation in the opposite direction so that said clutch member does not engage with said drive spindle and does not transfer rotational force from said first gear to said drive gear.

19. The waste disposal device of claim 18, further comprising a return spring for rotating said clutch member in a direction opposite to the direction of rotation of said clutch member upon the unidirectional movement of said pedal.

20. The waste disposal device of claim 1, further rising a compacting mechanism for compacting the waste packages.

21. The waste disposal device of claim 20, wherein said compacting mechanism comprises a rotatable tube extending into said waste chamber, a front end of said tubing being connected to said tube, said rotation mechanism comprising a motor, said motor being arranged to rotate said tube and thereby roll said tubing having waste packages encapsulated therein around said tube.

22. The waste disposal device of claim 21, wherein said tube includes a longitudinal slot, whereby said front end of said tubing is connectable to said tube by threading said front end of said tubing through said slot and tying said front end of said tubing around said tube.

23. The waste disposal device of claim 21, wherein said retention mechanism comprises a gear rim, said rotation mechanism engaging with said gear rim to cause rotation of said gear rim and thus said retention mechanism, said motor having a shaft and providing rotational movement to said shaft, said rotation mechanism comprising said motor, a gear arranged on said shaft and in engagement with said gear rim and a motor actuation mechanism for actuating said motor to rotate said shaft.

24. The waste disposal device of claim 20, wherein said compacting mechanism comprises a rotatable tube extending into said waste chamber and a sleeve removably attached to said tube such that said sleeve rotates in conjunction with rotation of said tube, a front end of said tubing being connected to said sleeve, said rotation mechanism comprising a motor, said motor being arranged to rotate said tube and thereby roll said tubing having waste packages encapsulated therein around said tube.

25. The waste disposal device of claim 20, wherein said compacting mechanism is arranged to hold a forward edge of said tubing during encapsulation of the waste packages and wind the encapsulated waste packages about one another to thereby form a roll of encapsulated waste packages.

26. The waste disposal device of claim 1, wherein aid rotation mechanism comprises:

a frame defining a waste passage through which the waste packages pass;

resilient members connected to said frame and extending inward into said waste passage to engage with the waste packages;

a handle situated at least partially outside of said container, said handle being movable in a slot in an outer wall of said container; and movement converting means for converting movement of said handle into uni-directional rotational movement of said frame to thereby rotate said frame, said resilient members and a waste package engaged by said resilient members relative to said tubing in said cartridge.

27. The waste disposal device of claim 26, wherein said movement converting means comprises an inner ring connected to said frame and having grooves on an inner face, a first, movable outer ring surrounding said inner ring and connected to said handle, said first outer ring including a pin engaging with said grooves on said inner face of said inner ring, and a second, stationary outer ring connected to said container and having grooves on an inner face, said inner ring including a pin engaging with said grooves on said inner face of said second outer ring.

28. The waste disposal device of claim 1, wherein said retention mechanism comprises a pulley, said rotation mechanism comprising a motor having a shaft, a pulley mounted on said shaft, a cable belt running over said pulley on said shaft and said pulley of said retention mechanism and a motor actuation mechanism for actuating said motor to cause rotation of said pulley on said shaft and thus said pulley of said retention mechanism via movement of said cable.

29. The waste disposal device of claim 28, further comprising guide pulleys for guiding said cable between said pulley on said shaft and said pulley of said retention mechanism.

30. The waste disposal device of claim 28, farther comprising a compacting mechanism for compacting the waste packages, said compacting mechanism comprises a rotatable tube extending into said waste chamber, a front end of said tubing being connected to said tube, said tube being connected to said shaft such that said tube is rotated upon actuation of said motor to thereby roll said tubing having waste packages encapsulated therein around said tube.

31. The waste disposal device of claim 1,wherein retention mechanism comprises a pail having a retention member extending upward from a base of the pail and adapted to hold the waste package between said retention member and walls of said pail, said rotation mechanism comprising a turntable arranged below said pail to selectively engage said pail and a string wound partially about said turntable to cause rotation of said turntable and thus said pail when said string is pulled.

32. The waste disposal device of claim 31, wherein said turntable includes a spool section on which said string is wound, a cylindrical shaft section extending upward from said spool section and an annular plate surrounding said shaft section, further comprising a biasing mechanism arranged between said plate and said spool section to bias said plate upward.

33. The waste disposal device of claim 32, wherein one end of said string is connected to said spool section, further comprising a pull ring connected to an opposite end of said string and a torsion spring connected to said turntable for rotating said turntable in a direction opposite to the direction of rotation of said turntable upon pulling of said string.

34. The waste disposal device of claim 31, wherein said turntable includes ramped ribs and a bottom surface of said pail includes ramped depressions each receivable on at least a portion of a respective one of said ramped ribs, said ramped ribs being situated in said ramped depressions during rotation of said turntable caused by pulling of said string and being removed from said ramped depressions during rotation of said turntable in the opposite direction.

35. The waste disposal device of claim 1, wherein said container comprises a cylindrical outer wall, further comprising an access door formed in and pivotally connected to said outer wall.

36. The waste disposal device of claim 1, wherein said container comprises cylindrical outer wall and a hamper defining the waste chamber and having an outer wall constituting part of the outer wall of said container, said hamper being removable from said container.

37. The waste disposal device of claim 1, wherein said retention mechanism comprises:

a frame defining a waste passage through which the waste package passes;

resilient springs connected to said frame and extending inward into said waste passage to engage with and hold the waste package;

a support flange connected to said frame for supporting said cartridge.

38. The waste disposal device of claim 1, wherein said cartridge comprises:

a casing defining a cavity containing said tubing, said casing including opposed substantially cylindrical inner and outer walls and an annular lower wall extending between said inner and outer walls;

an annular cover connected to said casing and enclosing said tubing in said cavity such that a ring-shaped opening is defined between an inner edge of said cover and said inner wall for passage of said tubing therethrough; and first closing means for closing a front end of said tubing outside of said cavity such that a bag is formed by said tubing into which a waste package can be inserted.

39. The waste disposal device of claim 38, wherein said first closing means comprise a metal clip or clasp attached to the front end of said tubing.

40. The waste disposal device of claim 38, further comprising second closing means arranged in connection with said casing and said cover for closing and sealing a rear end of said tubing.

41. The waste disposal device of claim 1, wherein said cartridge comprises:

a casing defining a cavity containing said tubing, said casing including opposed substantially cylindrical inner and outer walls and an annular lower wall extending between said inner and outer walls;

an annular cover connected to said casing and enclosing said tubing in said cavity such that a ring-shaped opening is defined between an inner edge of said cover and said inner wall for passage of said tubing therethrough; and first closing means arranged in connection with said casing and said cover for closing and sealing a rear end of said tubing.

42. The waste disposal device of claim 41, wherein said first closing means comprise score lines arranged on said cover to enable said cover to be folded about said score lines, attachment means arranged on said cover for attaching folded parts of said cover to one another, and slits arranged through said outer, inner and lower walls of said casing in alignment with said score lines.

43. The waste disposal device of claim 42, wherein said attachment means comprise hook and loop fasteners.

44. The waste disposal device of claim 42, wherein said attachment means comprise a tie and clasp stamped into said cover.

45. The waste disposal device of claim 1, wherein said cartridge comprises:

a casing defining a cavity containing said tubing, said casing including opposed substantially cylindrical inner and outer walls and an annular lower wall extending between said inner and outer walls;

an annular cover connected to said casing and enclosing said tubing in said cavity such that a ring-shaped opening is defined between an inner edge of said cover and said inner wall for passage of said tubing therethrough, said casing being made of a fibrous material.

46. The waste disposal device of claim 1, further comprising means for holding said cartridge stationary during rotation of said retention mechanism.

47. A waste disposal device, comprising:

a container defining a waste chamber for receiving encapsulated waste packages;

a lid coupled to said container and movable between an open position in which said chamber is accessible and a closed position in which said chamber is covered;

a cartridge arranged in said container and containing a length of flexible tubing arranged to receive waste packages;

a retention mechanism for holding a waste package received in said tubing, said retention mechanism being fixed to said container;

a rotation mechanism arranged to rotate said cartridge relative to said retention mechanism in order to twist said tubing and encapsulate a waste package when held by said retention mechanism; and a toothed member attached to said lid, said cartridge comprising a gear rim, said rotation mechanism engaging with said toothed member and said gear rim during movement of said lid and comprising at least one gear arranged in said container for enabling the conversion of movement of said lid to rotational movement of said gear rim.

48. The waste disposal device of claim 47, wherein said rotation mechanism is constructed to convert movement of said lid in a downward direction to rotational movement of said gear rim and prevent movement of said lid in an upward direction from being converted to rotational movement of said gear rim.

49. The waste disposal device of claim 47, wherein said toothed member comprises a rack gear having a series of teeth on an outer or inner arcuate surface.

50. A waste disposal device, comprising:

a container defining a waste chamber for receiving encapsulated waste packages;

a lid coupled to said container and movable between an open position in which said chamber is accessible and a closed position in which said chamber is covered;

a cartridge arranged in said container and containing a length of flexible tubing arranged to receive waste packages;

a rotation mechanism for causing rotation of said cartridge; and a compacting mechanism arranged to hold a forward edge of said tubing during rotation of said cartridge such that a twist is formed in said tubing when a waste package is received in said tubing to thereby encapsulate the waste package, said compacting mechanism being arranged to wind the encapsulated waste packages about one another to thereby form a roll of encapsulated waste packages.

51. The waste disposal device of claim 50, wherein said rotation mechanism comprises a gear rim attached to said cartridge, a motor, a motor actuating mechanism for actuating said motor and a motive force transmission assembly for transferring motive force from said motor to said gear rim.

52. The waste disposal device of claim 51, wherein said rotation mechanism further comprises an adapter mating with said gear rim and said cartridge to fix said cartridge relative to said gear rim such that rotation of said gear rim causes rotation of said cartridge.

53. The waste disposal device of claim 50, wherein said compacting mechanism comprises a motor, a motor actuating mechanism for actuating said motor and a rotatable shaft arranged to receive said forward edge of said tubing and coupled to said motor such that actuation of said motor causes rotation of said shaft.

54. The waste disposal device of claim 53, wherein said shaft comprises a slot, the forward edge of said tubing being larger than a width of said slot and being inserted into said slot from an axial end of said slot.

55. The waste disposal device of claim 53, wherein said shaft comprises at least one ridge, said compacting mechanism further comprising a sleeve having at least one groove arranged to accommodate a respective one of said at least one ridge upon placement of said sleeve on said shaft, said forward edge of said tubing being fixed to said sleeve.

56. A waste disposal device, comprising:

a container defining a waste chamber for receiving encapsulated waste packages;

a lid coupled to said container and movable between an open position in which said chamber is accessible and a closed position in which said chamber is covered;

a cartridge arranged in said container and containing a length of flexible tubing arranged to receive waste packages;

a retention unit for holding a waste package received in said tubing; and rotation means for rotating said retention unit, and thus a waste package held by said retention unit, relative to said cartridge in order to twist said tubing and encapsulate the waste package.

57. The waste disposal device of claim 56, further comprising means for holding said cartridge stationary during rotation of said retention unit.

58. The waste disposal device of claim 56, wherein said retention unit comprises a gear ring and a plurality of resilient springs adapted to engage with the waste package, said rotation means engaging with said gear ring to cause rotation of said gear ring and thus said retention unit.

59. The waste disposal device of claim 58, wherein said gear ring comprises a gear rim engaging with said rotation means and an adapter rim interposed between and coupled to said gear rim and said cartridge for coupling said cartridge to said gear rim.

60. The waste disposal device of claim 58, wherein said rotation means comprise a motor having a shaft and providing rotational movement to said shaft, a gear arranged on said shaft and in engagement with said gear ring and a motor actuation mechanism for actuating said motor to rotate said shaft.

61. The waste disposal device of claim 60, wherein said motor actuation mechanism comprises a foot pedal coupled to said motor and arranged such that upon depression of said foot pedal, said motor is actuated.

62. The waste disposal device of claim 60, wherein said motor actuation mechanism comprises a pushbutton coupled to said motor such that upon depression of said pushbutton, said motor is actuated.

63. The waste disposal device of claim 60, wherein said motor actuation mechanism comprises a switch arranged on said container and coupled to said motor and a plunger arranged on said lid to engage said switch when said lid is closed.

64. The waste disposal device of claim 58, wherein said rotation means comprise a pedal arranged in a slot partially outside of said container, a pulley connected to said pedal and a movement converting mechanism for converting unidirectional movement of said pedal in said slot and thus movement of said pulley into rotation of said gear ring.

65. The waste disposal device of claim 64, wherein said movement converting mechanism comprises a rotatable shaft, a cable running over said pulley and having a first end fixed to said container and a second end fixed to said shaft, said cable being windable about said shaft, a first gear mounted on said shaft, a drive spindle, a clutch member mounted about said drive spindle and having a gear portion meshing engagement with said first gear, a drive gear fixedly mounted on said drive spindle, and an idler gear is meshing engagement with said drive gear and said gear rim.

66. The waste disposal device of claim 65, wherein said clutch member comprises a spring clutch arranged to grab said drive spindle during rotation of said clutch member in one direction so that said clutch member transfers rotational force from said first gear to said drive gear and release the drive spindle during rotation in the opposite direction so that said clutch member does not engage with said drive spindle and does not transfer rotational force from said first gear to said drive gear.

67. The waste disposal device of claim 56, wherein said retention unit comprises a pulley, said rotation means comprising a motor having a shaft, a pulley mounted on said shaft, a cable belt running over said pulley on said shaft and said pulley of said retention unit and a motor actuation mechanism for actuating said motor to cause rotation of said pulley on said shaft and thus said pulley of said retention unit via movement of said cable.

68. The waste disposal device of claim 56, wherein said retention unit comprises a pail having a retention member extending upward from a base of the pail and adapted to hold the waste package between said retention member and walls of said pail, said rotation means comprising a turntable arranged below said pail to selectively engage said pail and a string wound partially about said turntable to cause rotation of said turntable and thus said pail when said string is pulled.

69. The waste disposal device of claim 68, wherein said turntable includes a spool section on which said string is wound, a cylindrical shaft section extending upward from said spool section and an annular plate surrounding said shaft section, further comprising a biasing mechanism arranged between said plate and said spool section to bias said plate upward.

70. The waste disposal device of claim 69, wherein one end of said string is connected to said spool section, further comprising a pull ring connected to an opposite end of said string and a torsion spring connected to said turntable for rotating said turntable in a direction opposite to the direction of rotation of said turntable upon pulling of said string.

71. The waste disposal device of claim 68, wherein said turntable includes ramped ribs and a bottom surface of said pail includes ramped depressions each receivable of at least a portion of a respective one of said ramped ribs, said ramped ribs being situated in said ramped depressions during rotation of said turntable caused by pulling of said string and being removed from said ramped depressions during rotation of said turntable in the opposite direction.

72. The waste disposal device of claim 56, wherein said retention unit comprises:

a frame defining a waste passage through which the waste package passes;

resilient springs connected to said frame and extending inward into said waste passage to engage with and hold the waste package;

a support flange connected to said frame for supporting said cartridge.

73. A waste disposal device, comprising:

a container defining a waste chamber for receiving encapsulated waste packages;

a lid coupled to said container and movable between an open position in which said chamber is accessible and a closed position in which said chamber is covered;

a toothed member attached to said lid;

a cartridge arranged in said container and containing a length of flexible tubing arranged to receive waste packages;

a retention mechanism for holding a waste package received in said tubing, said retention mechanism comprising a gear rim; and a rotation mechanism for rotating said retention mechanism relative to said cartridge in order to twist said tubing and encapsulate a waste package received in said tubing, said rotation mechanism engaging with said toothed member and said gear rim during movement of said lid and comprising at least one gear for enabling the conversion of movement of said lid to rotational movement of said gear rim and thus said retention mechanism.

74. The waste disposal device of claim 73, wherein said retention mechanism further comprises a frame attached to said gear rim and including a plurality of resilient springs adapted to engage with the waste package.

75. The waste disposal device of claim 73, wherein said retention mechanism further comprises an adapter rim attached to said gear rim and adapted to hold said cartridge.

76. The waste disposal device of claim 73, wherein said rotation mechanism is constructed to convert movement of said lid in a downward direction to rotational movement of said gear rim and prevent movement of said lid in an upward direction from being converted to rotational movement of said gear rim.

77. The waste disposal device of claim 73, wherein said toothed member comprises a rack gear having a series of teeth on an outer or inner arcuate surface.

78. The waste disposal device of claim 73, further comprising an anti-rotation mechanism for holding said cartridge stationary during rotation of said retention mechanism.

79. The waste disposal device of claim 78, wherein said cartridge includes at least one flange, said anti-rotation mechanism comprising at least one pair of tabs formed on said container such that said each of said at least one flange of said container is received between a respective one of said at least one pair of tabs.

80. A waste disposal device, comprising:

a container defining a waste chamber for receiving encapsulated waste packages;

a lid coupled to said container and movable between an open position in which said chamber is accessible and a closed position in which said chamber is covered;

a foldable cartridge arranged in said container and containing a length of flexible tubing arranged to receive waste packages;

a retention mechanism for holding a waste package received in said tubing; and a rotation mechanism for causing relative rotation between said cartridge and said retention mechanism in order to twist said tubing and encapsulate a waste package when held by said retention mechanism.

81. The waste disposal device of claim 80, wherein said cartridge is made of fibrous material.

82. A waste disposal device, comprising:

a container defining a waste chamber for receiving encapsulated waste packages;

a lid coupled to said container and movable between an open position in which said chamber is accessible and a closed position in which said chamber is covered;

a cartridge arranged in said container and containing a length of flexible tubing arranged to receive waste packages;

a retention mechanism for holding a waste package received in said tubing;

a rotation mechanism for rotating said retention mechanism relative to said cartridge in order to twist said tubing and encapsulate a waste package when held by said retention mechanism; and compacting means for compacting the waste packages.

83. The waste disposal device of claim 82, wherein said compacting means comprises a rotatable tube extending into said chamber, a front end of said tubing being connected to said tube.

84. The waste disposal device of claim 83, wherein said compacting means further comprise a motor arranged to rotate said tube and thereby roll said tubing having waste packages encapsulated therein around said tube.

85. The waste disposal device of claim 83, wherein said tube includes a longitudinal slot, whereby said front end of said tubing is connectable to said tube by threading said front end of said tubing through said slot and tying said front end of said tubing around said tube.

86. The waste disposal device of claim 82, wherein said retention mechanism comprises a gear rim, said rotation mechanism engaging with said gear rim to cause rotation of said gear rim and thus said retention mechanism.

87. The waste disposal device of claim 86, wherein said compacting means comprise a motor arranged to rotate said tube and thereby roll said tubing having waste packages encapsulated therein around said tube, said motor having a shaft and providing rotational movement to said shaft, said rotation mechanism comprising a gear arranged on said shaft and in engagement with said gear rim and a motor actuation mechanism for actuating said motor to rotate said shaft.

88. The waste disposal device of claim 82, wherein said compacting mechanism comprises a rotatable tube extending into said chamber and a sleeve removably attached to said tube such that said sleeve rotates in conjunction with rotation of said tube, a front end of said tubing being connected to said sleeve.

89. The waste disposal device of claim 88, wherein said compacting means further comprise a motor arranged to rotate said tube and thereby roll said tubing having waste packages encapsulated therein around said tube.

* * * * *